US011300281B2

(12) United States Patent
Ghasabi

(10) Patent No.: US 11,300,281 B2
(45) Date of Patent: Apr. 12, 2022

(54) LIGHT FIXTURE

(71) Applicant: LUMINIZ INC., Etobicoke (CA)

(72) Inventor: Amir Ghasabi, Etobicoke (CA)

(73) Assignee: Luminiz Inc., Etobicoke (CA)

( * ) Notice: Subject to any disclaimer, the term of this patent is extended or adjusted under 35 U.S.C. 154(b) by 331 days.

(21) Appl. No.: 16/026,604

(22) Filed: Jul. 3, 2018

(65) Prior Publication Data

US 2019/0285261 A1 Sep. 19, 2019

Related U.S. Application Data

(63) Continuation-in-part of application No. 29/640,775, filed on Mar. 16, 2018, now Pat. No. Des. 880,041.

(51) Int. Cl.
*F21K 9/237* (2016.01)
*F21V 29/70* (2015.01)
(Continued)

(52) U.S. Cl.
CPC ..... *F21V 29/70* (2015.01); *F21K 9/237* (2016.08); *F21S 2/005* (2013.01); *F21V 15/01* (2013.01);
(Continued)

(58) Field of Classification Search
CPC ..... F21V 15/01; F21V 19/0055; F21V 29/70; F21V 21/14; F21V 19/02; F21V 21/04; F21V 14/02; F21V 21/30; F21V 21/29; F21V 23/00; F21V 23/001; F21V 17/12; F21V 21/049; F21K 9/237; F21S 2/005; F21S 8/02; F21Y 2115/10
See application file for complete search history.

(56) References Cited

U.S. PATENT DOCUMENTS

D291,253 S 8/1987 Ortega
5,457,617 A * 10/1995 Chan ..... F21S 8/02 362/148
(Continued)

FOREIGN PATENT DOCUMENTS

DE 102012101228 A1 * 8/2012 ..... F21V 21/049
GB 2509772 A 7/2014

OTHER PUBLICATIONS

Examiner's Report dated Dec. 5, 2019 in related CA Patent Application No. 3,010,273 (4 pages).
(Continued)

*Primary Examiner* — Fatima N Farokhrooz
(74) *Attorney, Agent, or Firm* — Bereskin & Parr LLP/S.E.N.C.R.L., s.r.l.; Isis E. Caulder; Ahmed Elmallah

(57) ABSTRACT

There is provided a light fixture comprising a light source. The light source has a housing terminating in a first end, and the housing has a housing connector proximate the first end. The housing also has a heat sink disposed inside the housing and a light emitter disposed inside the housing. The light emitter is positioned to allow a light emitted by the light emitter to exit the housing through the first end. The light source also has a connector in electrical communication with the light emitter. The housing connector is configured for reversibly securing the light source to one or more of: an adaptor reversibly securable to a trim configured for securing the light fixture to a substrate, and the trim.

22 Claims, 57 Drawing Sheets

(51) Int. Cl.

| | |
|---|---|
| ***F21V 15/01*** | (2006.01) |
| ***F21S 2/00*** | (2016.01) |
| ***F21V 19/00*** | (2006.01) |
| *F21Y 115/10* | (2016.01) |

(52) U.S. Cl.
CPC ..... *F21V 19/0055* (2013.01); *F21Y 2115/10* (2016.08)

(56) References Cited

U.S. PATENT DOCUMENTS

D383,564 S 9/1997 Lecluze
5,738,436 A * 4/1998 Cummings ..... F21S 2/00 362/294
D397,486 S 8/1998 Engle et al.
D399,590 S 10/1998 Lecluze
D437,074 S 1/2001 Johnson
D488,583 S 4/2004 Benghozi
6,758,578 B1 * 7/2004 Chou ..... F21V 17/06 362/391
D510,151 S 9/2005 Rashidi
D544,128 S 6/2007 Carro
D544,979 S 6/2007 Hartmann, Jr. et al.
D568,522 S 5/2008 Engel
D569,024 S 5/2008 Redfern
D622,434 S 8/2010 Ward et al.
D627,913 S 11/2010 Gielen
D633,636 S 3/2011 Gielen
D639,994 S 6/2011 Wauters
D642,317 S 7/2011 Rashidi
D646,416 S 10/2011 Wauters
D655,436 S 3/2012 Johnson
D668,372 S 10/2012 Renshaw et al.
D671,668 S 11/2012 Rowlette, Jr. et al.
D677,418 S 3/2013 Wilson et al.
8,613,529 B2 * 12/2013 Watanabe ..... F21V 29/73 362/294
D697,651 S 1/2014 Carpenter et al.
D698,069 S 1/2014 Messisaen
D698,071 S 1/2014 Messiaen
D699,880 S 2/2014 Szoke
D705,473 S 5/2014 Messisaen
D726,360 S 4/2015 Messiaen
D740,996 S 10/2015 Tragatschnig
D766,497 S 9/2016 Salomon
D767,194 S 9/2016 Lee
D767,809 S 9/2016 Gotz-Schafer
D772,466 S 11/2016 Zhang et al.
D779,700 S 2/2017 Lee
D779,701 S 2/2017 Lazalier et al.
D789,586 S 6/2017 Guzzini
D793,579 S 8/2017 Kristensen
9,803,844 B2 * 10/2017 Chad ..... F21V 31/005
D808,058 S 1/2018 Johnson
D816,256 S 4/2018 Benghozi et al.
D816,257 S 4/2018 Ghasabi
D824,566 S 7/2018 Santoro et al.
D824,568 S 7/2018 Farzan
D827,904 S 9/2018 Benghozi et al.
D828,944 S 9/2018 Xie
D831,873 S 10/2018 Rybol et al.
10,247,384 B1 * 4/2019 Feinbloom ..... H05K 1/181
D848,048 S 5/2019 Baumeister et al.
D854,218 S 7/2019 Coirier
D854,726 S 7/2019 Goetz-Schaefer
D855,235 S 7/2019 Goetz-Schaefer
D855,861 S 8/2019 Perrone
D866,040 S 11/2019 Wu
D867,645 S 11/2019 Ye
D880,041 S 3/2020 Ghasabi
D912,298 S 3/2021 Leijh
2005/0265016 A1 * 12/2005 Rappaport ..... F21V 17/105 362/147
2007/0159816 A1 * 7/2007 Bayat ..... F21V 7/0075 362/184
2008/0158893 A1 * 7/2008 Gauthier ..... F21V 21/30 362/368
2009/0147517 A1 * 6/2009 Li ..... F21V 29/75 362/249.02
2010/0328960 A1 * 12/2010 Wang ..... F21V 31/005 362/373
2011/0261572 A1 * 10/2011 Watanabe ..... F21V 29/73 362/373
2012/0025020 A1 * 2/2012 Plithides ..... C08L 65/02 244/129.1
2012/0243241 A1 * 9/2012 Hsieh ..... F21V 29/773 362/373
2013/0021784 A1 * 1/2013 Jang ..... F21V 29/70 362/147
2014/0003061 A1 * 1/2014 Chen ..... F21V 21/30 362/311.02
2014/0104846 A1 * 4/2014 Wronski ..... F21V 15/01 362/294
2014/0355274 A1 * 12/2014 Santiago ..... F21V 15/01 362/374
2015/0292692 A1 * 10/2015 Elmvang ..... F21V 21/043 362/294
2016/0123545 A1 * 5/2016 Li ..... F21V 21/0832 362/101
2016/0348861 A1 * 12/2016 Bailey ..... F21V 23/006
2018/0003365 A1 * 1/2018 Nanni ..... F21V 17/14
2018/0017243 A1 * 1/2018 Palmer ..... F21V 29/673
2018/0045399 A1 * 2/2018 Chen ..... F21V 31/005
2018/0266635 A1 * 9/2018 Dong ..... F21V 21/047
2019/0113193 A1 * 4/2019 Serak ..... F21S 8/04
2019/0234577 A1 8/2019 Zhan et al.
2019/0346120 A1 11/2019 Dong et al.
2020/0217484 A1 * 7/2020 Millson ..... H04R 1/026
2021/0215305 A1 7/2021 Mandy et al.

OTHER PUBLICATIONS

Notices of Allowance and References dated Jan. 2, 2020 in corresponding U.S. Appl. No. 29/640,775 (8 pages).
Restriction Requirement and Notice of References dated Jul. 5, 2019 in corresponding Design U.S. Appl. No. 29/640,775.
Ex parte Quayle Office Action and Notice of References dated Oct. 14, 2020 in Design U.S. Appl. No. 29/704,793 (6 pages).
Ex parte Quayle Office Action and Notice of References dated Oct. 30, 2020 in Design U.S. Appl. No. 29/704,788 (6 pages).
Notices of Allowance and References Cited dated Sep. 15, 2021 in corresponding U.S. Appl. No. 29/704,779 (6 pages).

* cited by examiner

LIGHT FIXTURE

CROSS-REFERENCE TO RELATED APPLICATION

This application claims the benefit of and priority from U.S. Design patent application Ser. No. 29/640,775 filed on Mar. 16, 2018, which is incorporated herein in its entirety.

FIELD

The present specification relates to light fixtures, and in particular to light fixtures configured for modular assembly.

BACKGROUND

Some indoor spaces do not receive sufficient natural light. Moreover, the availability of natural light is limited to daylight hours. Artificial light sources, such as electrical light fixtures, can be used to provide artificial lighting in indoor spaces and outside of daylight hours.

SUMMARY

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

It is understood that for the purpose of this specification, language of "at least one of X, Y, and Z" and "one or more of X, Y and Z" can be construed as X only, Y only, Z only, or any combination of two or more items X, Y, and Z (e.g., XYZ, XY, YZ, ZZ, and the like). Similar logic can be applied for two or more items in any occurrence of "at least one . . . " and "one or more . . . " language.

An aspect of the present specification provides a light fixture comprising: a light source, comprising: a housing terminating in a first end, the housing having a housing connector proximate the first end; a heat sink disposed inside the housing and secured to the housing; a light emitter comprising a light emitting diode (LED), the light emitter disposed inside the housing and in thermal communication with the heat sink, the light emitter positioned to allow a light emitted by the light emitter to exit the housing through the first end; and a connector in electrical communication with the light emitter, the connector configured to allow electrically connecting the light emitter to a power source external to the light source; and the housing connector configured for reversibly securing the light source to one or more of: an adaptor reversibly securable to a trim configured for securing the light fixture to a substrate; and the trim.

The housing connector can comprise a housing spiral threading.

The housing spiral threading can be disposed on an outer surface of the housing.

The housing can comprise a cylindrical portion proximate the first end, the housing spiral threading being on the cylindrical portion.

The heat sink can comprise: a heat sink base having a substantially circular shape, the heat sink base receivable in the cylindrical portion; an annular extension extending out of a plane defined by the heat sink base and from a first side of the heat sink base; and a plurality of blades extending radially from the annular extension, the blades configured to facilitate heat exchange between the heat sink and an environment surrounding the heat sink by increasing a surface area of the heat sink.

The light emitter can be disposed on a second side of the heat sink base, the second side opposite the first side.

The heat sink can further comprise an opening in the heat sink base, the connector passing through the opening.

The opening can extend at least partly through the annular extension.

The light fixture can further comprise a lens at least partially received inside the housing proximate the first end and secured to the housing, the lens configured to modify the light propagating form the light emitter out of the first end.

The light fixture can further comprise a cover configured to at least partially cover a second end of the housing, the second end opposite the first end, the cover comprising one or more cover openings to facilitate heat exchange between an inside of the housing and an environment outside the housing.

The cover can be secured to the heat sink and the cover can comprise a further cover opening, the connector passing through the further cover opening.

The light fixture can further comprise a ridge extending from an inner surface of at least a portion of the cylindrical portion and oriented about axially along the cylindrical portion.

One or more of the heat sink and the cover can comprise a respective notch shaped to receive the ridge to allow for aligning the one or more of the heat sink and the cover respectively in the cylindrical portion.

The light fixture can further comprise the adaptor, the adaptor reversibly secured to the light source, the adaptor comprising: a first connector reversibly securable to the housing spiral threading; and a second connector coupled to the first connector, the second connector reversibly securable to the trim.

The adaptor can further comprise a light conduit extending from the first connector to the second connector.

The light conduit can comprise a frustoconical inner shape having a small open end and a large open end opposite the small open end; the first connector comprises a first adaptor spiral threading proximate the small open end, the first adaptor spiral threading configured to be reversibly mateable with the housing spiral threading for reversibly securing the adaptor to the housing; and the second connector comprises a second adaptor spiral threading proximate the large open end, the second adaptor spiral threading configured for reversibly securing the adaptor to the trim.

One or more of: the first connector can comprise a spiral threading disposed on an inner surface of the light conduit proximate the small open end; and the second connector can comprise a respective spiral threading disposed on an outer surface of the light conduit proximate the large open end.

The first connector can be pivotably coupled to the second connector, the second connector being able to reversibly tilt along an axis relative to the first connector.

The first connector can be moveably coupled to the second connector, the second connector being able to reversibly tilt along three different axes relative to the first connector.

The first connector can comprise a hollow spherical segment having an outer equatorial diameter; and the second connector can comprise a receiving component having an inner space receiving the hollow spherical segment, the inner space having a first open end and having a first diameter and a second open end opposite the first open end, the second open end having a second diameter, the inner space having an inner diameter measured at a point between the first open end and the second open end, the first diameter and the second diameter being smaller than the outer equatorial diameter and the inner diameter being larger than the outer equatorial diameter, whereby the hollow spherical segment is captured in the inner space.

The light fixture can further comprise the trim, the trim comprising: a trim base configured to interface with the substrate, the trim base comprising a trim opening configured to allow passage of the light emitted by the light emitter; and a trim connector coupled to the trim base, the trim connector configured to reversibly couple the trim to one or more of: the light source; and the adaptor.

The trim connector can comprise a trim spiral threading proximate the trim opening.

The trim connector can comprise at least one trim connector clip coupled to the trim base proximate the trim opening, the trim connector clip configured to be resiliently deformed by a received component comprising one of the light source and the adaptor when the received component is coupled to the trim such that a resilient force of the trim connector clip pushes against the received component to secure the received component to the trim.

The trim base can be movably coupled to the trim connector.

Another aspect of the present specification provides a kit for a light fixture, the kit comprising: a light source, comprising: a housing terminating in a first end, the housing having a housing connector proximate the first end; a heat sink disposed inside the housing and secured to the housing; a light emitter comprising a light emitting diode (LED), the light emitter disposed inside the housing and in thermal communication with the heat sink, the light emitter positioned to allow a light emitted by the light emitter to exit the housing through the first end; and a connector in electrical communication with the light emitter, the connector configured to allow electrically connecting the light emitter to a power source external to the light source; and the housing connector configured for reversibly securing the light source to one or more of: an adaptor reversibly securable a trim configured for securing the light source to a substrate; and the trim. The kit also comprises one of more of: the adaptor, comprising: a first connector reversibly securable to the housing connector; and a second connector coupled to the first connector, the second connector reversibly securable to the trim; and the trim comprising: a trim base configured to interface with the substrate, the trim base comprising a trim opening configured to allow passage of the light emitted by the light emitter; and a trim connector coupled to the trim base, the trim connector configured to reversibly couple the trim to one or more of: the housing connector of the light source; and the second connector of the adaptor.

One or more of: the housing connector and the first connector can comprise spiral threading reversibly mateable with one another; and the second connector and the trim connector can comprise respective spiral threading reversibly mateable with one another.

Another aspect of the present specification provides a trim for a light fixture, the trim comprising: a trim base configured to interface with a substrate in which the light fixture is to be installed, the trim base comprising a trim opening configured to allow passage of a light emitted by a light source of the light fixture; and a trim connector coupled to the trim base, the trim connector configured to reversibly couple the trim to the light source, the trim connector comprising a trim spiral threading proximate the trim opening.

The trim base can be movably coupled to the trim connector.

The trim connector can be configured to couple the trim to the light source by connecting reversibly to a connector of an adaptor, the adaptor having another connector for reversibly connecting to the light source.

Another aspect of the present specification provides an adaptor for a light fixture, the adaptor comprising: a first connector reversibly securable to a light source of the light fixture; and a second connector coupled to the first connector, the second connector reversibly securable to a trim of the light fixture, the trim configured for securing the light source to a substrate.

One or more of: the first connector can comprise a first adaptor spiral threading; and the second connector can comprise a second adaptor spiral threading.

The adaptor can further comprise a light conduit extending from the first connector to the second connector.

The light conduit can comprise a frustoconical inner shape having a small open end and a large open end opposite the small open end; the first connector can comprise a first adaptor spiral threading proximate the small open end, the first adaptor spiral threading configured to reversibly securing the adaptor to the light source; and the second connector can comprise a second adaptor spiral threading proximate the large open end, the second adaptor spiral threading configured for reversibly securing the adaptor to a trim.

One or more of: the first connector can comprise a spiral threading disposed on an inner surface of the light conduit proximate the small open end; and the second connector can comprise a respective spiral threading disposed on an outer surface of the light conduit proximate the large open end.

The first connector can be pivotably coupled to the second connector, the second connector being able to reversibly tilt along an axis relative to the first connector.

The first connector can be moveably coupled to the second connector, the second connector being able to reversibly tilt along three different axes relative to the first connector.

The first connector can comprise a hollow spherical segment having an outer equatorial diameter; and the second connector can comprise a receiving component having an inner space receiving the hollow spherical segment, the inner space having a first open end having a first diameter and a second open end opposite the first open end, the second open end having a second diameter, the inner space having an inner diameter measured at a point between the first open end and the second open end, the first diameter and the second diameter being smaller than the outer equatorial diameter and the inner diameter being larger than the outer equatorial diameter, whereby the hollow spherical segment is captured in the inner space.

Another aspect of the present specification provides a method of installing a light fixture, the method comprising: providing a light source, the light source comprising: a housing terminating in a first end, the housing having a housing connector proximate the first end; a heat sink disposed inside the housing and secured to the housing; a light emitter comprising a light emitting diode (LED), the light emitter disposed inside the housing and in thermal communication with the heat sink, the light emitter positioned to allow a light emitted by the light emitter to exit the housing through the first end; and a connector in electrical communication with the light emitter, the connector configured to allow electrically connecting the light emitter to a power source external to the light source. The method also comprises coupling the light source to a trim to form the light fixture, the coupling being reversible, the trim comprising: a trim base configured to interface with a substrate in which the light fixture is to be installed, the trim base comprising a trim opening configured to allow passage of the light emitted by the light source; and a trim connector coupled to the trim base, the trim connector reversibly couplable with the housing connector to reversibly couple the trim to the light source. Moreover, the method comprises inserting the light fixture into an opening in the substrate; and securing the trim to the substrate.

The housing connector can comprise a housing spiral threading proximate the first end; the trim connector comprises a trim spiral threading proximate the trim opening; and the coupling the light source to the trim can comprise reversibly mating the housing spiral threading with the trim spiral threading.

The method can further comprise: providing an adaptor, the adaptor having a first connector comprising a first connector spiral threading and a second connector coupled to the first connector, the second connector comprising a second connector spiral threading; and wherein: the housing connector can comprise a housing spiral threading proximate the first end; the trim connector can comprise a trim spiral threading proximate the trim opening; and the coupling the light source to the trim can comprise: reversibly mating the housing spiral threading with the first connector spiral threading; and reversibly mating the second connector spiral threading with the trim spiral threading.

BRIEF DESCRIPTION OF THE DRAWINGS

Some examples of the present specification will now be described, with reference to the attached Figures, wherein.

DETAILED DESCRIPTION

Light fixtures can be secured to a substrate such as a ceiling or a wall. Such light fixtures can comprise a light source to generate the light. In some examples, the light fixture can also comprise a trim configured for securing the light source to the substrate. The trim can comprise both functional and decorative characteristics. In addition, some light fixtures can comprise adaptors disposed between the light source and the trim connecting the light source to the trim. The adaptors can help shape the light beam, provide various tilting functionalities, and the like. As such, in some examples one light fixture can comprise the light source, the adaptor, and the trim.

Given the decorative and functional elements of the trim and the adaptor, there may be many different possible combinations of light source, adaptor, and trim for a given line of light fixtures. To produce and stock an inventory of such a large number of possible products can be expensive and inefficient. The light source can be the most expensive component of the light fixture. In addition, the light source can be subject to a higher level of safety testing and certification compared to the adaptor and the trim. A modular light fixture wherein a few light sources can be used with any one of a plurality of adaptors and/or trims can reduce the cost and difficulty of providing a full set of light source, adaptor, and trim combinations, and can reduce the amount of cost and time spent for safety testing and certification.

In order to allow modular assembly of the light fixture from one or a few light sources connectable to one of a plurality of different adaptors and trims, the light source, adaptor, and trim can be reversibly securable to one another. In addition, in some example light fixtures the connection between the light source, adaptor, and trim components can also be measured and/or tested against engineering or safety specifications. For example, some example specifications may indicate that the connections are to be mechanically secure and also provide a water vapor barrier. In such examples, the reversible connections between the light source, adaptor, and the trim can act as water vapor- or air-tight barriers to comply with the specifications.

Figure 1:
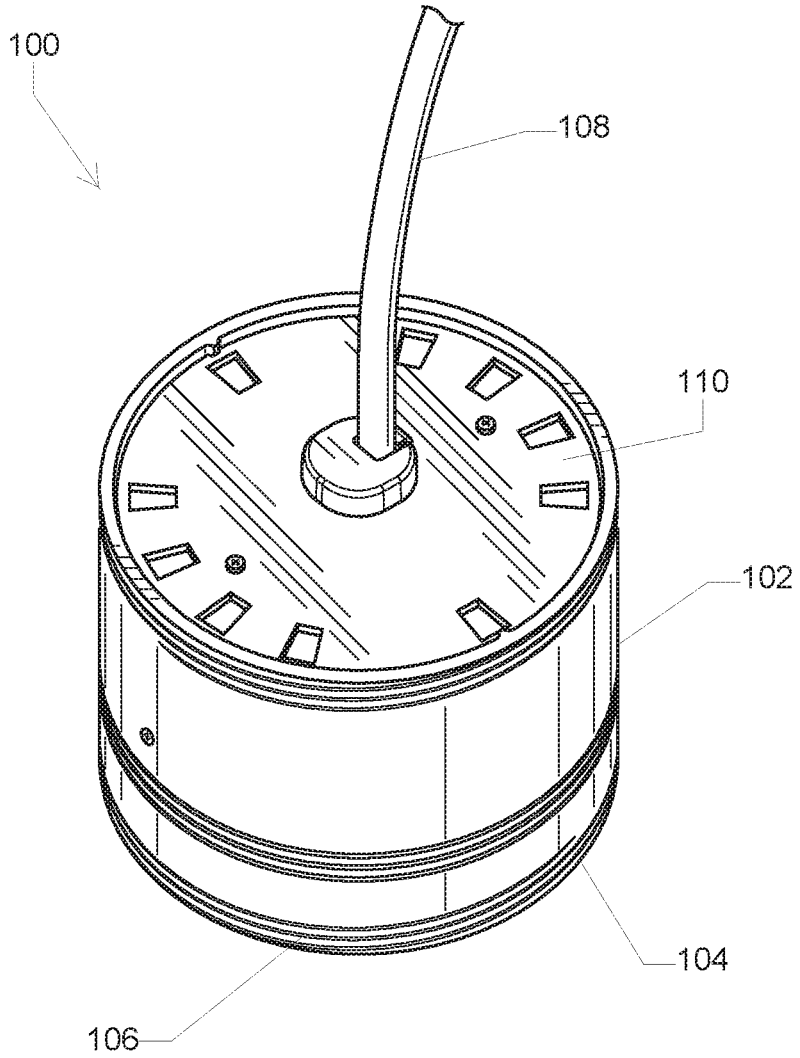
FIG. 1 shows a perspective view of an example light source.

FIG. 1 shows a top perspective view of an example light source 100. Light source 100 can be used as a component in a light fixture configured for modular assembly of the light source, the adaptor, and the trim. In some examples the light fixture can comprise light source 100, and need not comprise the adaptor or the trim. Light source 100 comprises a housing 102 terminating in a first end 104. Housing 102 comprises a housing connector 106 disposed proximate first end 104. Housing connector 106 can be used for reversibly securing light source 100 to an adaptor and/or to a trim. Housing connector 106 can be disposed at, adjacent to, and/or abutting first end 104. In some examples, housing connector can be spaced from first end 104.

While FIG. 1 shows housing 102 as having a cylindrical shape, it is contemplated that in some examples a portion or all of the housing can have a shape other than cylindrical. Moreover, housing connector 106 can comprise spiral threading which can be disposed on an outer surface of the housing. In other examples, the spiral threading can be disposed on an inner surface of housing 102. This spiral threading can be used to reversibly connect light source 100 to one of a plurality of trims and/or one of a plurality of adaptors which can in turn connect to trims.

While FIG. 1 shows housing connector 106 as comprising spiral threading, it is contemplated that in other examples the housing connector can comprise a different type of connector, including but not limited to, resiliently- or spring-biased members and the like. In addition, a light emitter can be disposed inside housing 102 to emit the light generated by light source 100.

Housing 102 can also comprise a second end opposite first end 104. Moreover, light source 100 can also comprise a cover 110 to at least partially cover the second end of housing 102. Furthermore, light source 100 can comprise a connector 108 in electrical communication with the light emitter. Connector 108 can be configured for electrically connecting the light emitter to a power source external to light source 100.

Figure 2:
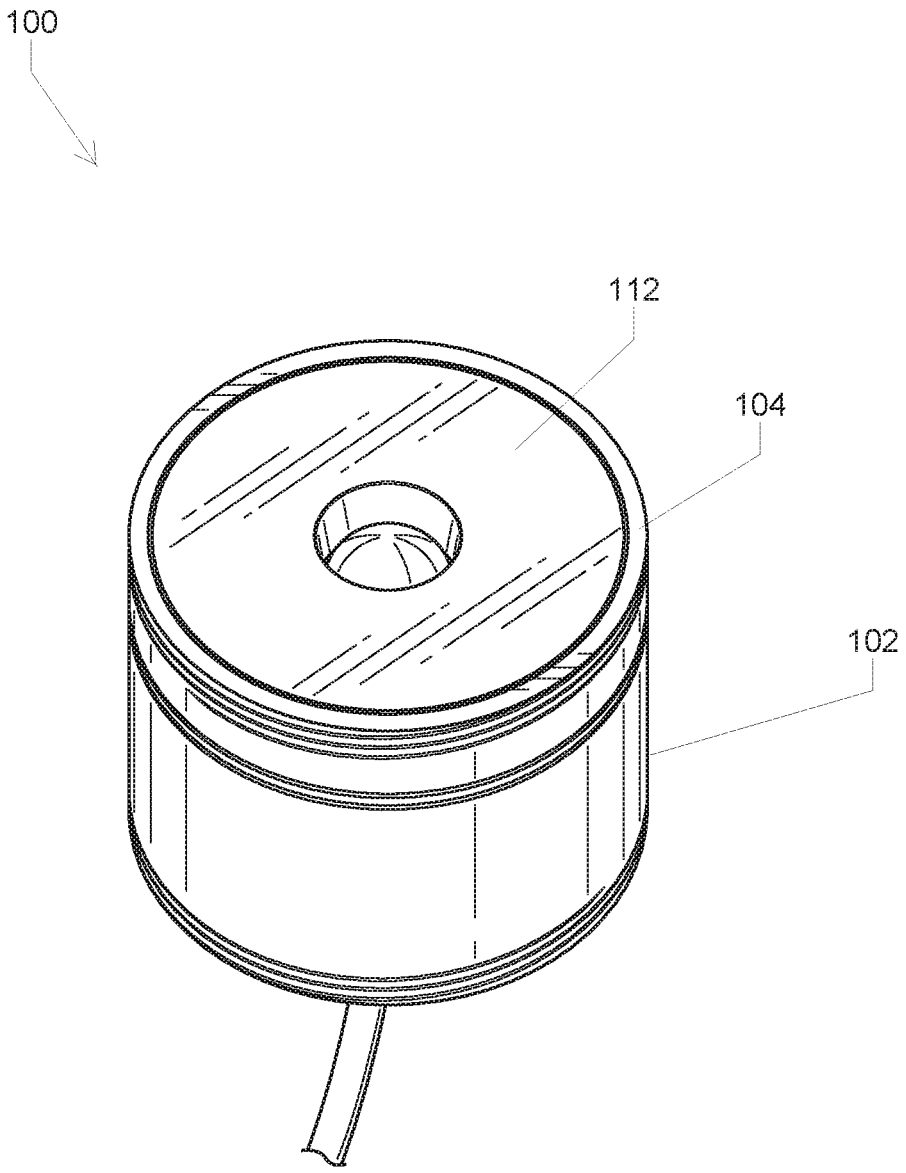
FIG. 2 shows another perspective view of the light source of FIG. 1.

FIG. 2 shows another perspective view of light source 100. FIG. 2 shows a lens 112 received inside housing 102 proximate first end 104 and secured to housing 102. Lens 112 can be configured to modify the light propagating form the light emitter out of first end 104. While FIG. 2 shows lens 112 received fully inside housing 102, it is contemplated that in other examples the lens can be partially received inside the housing.

Figure 3:
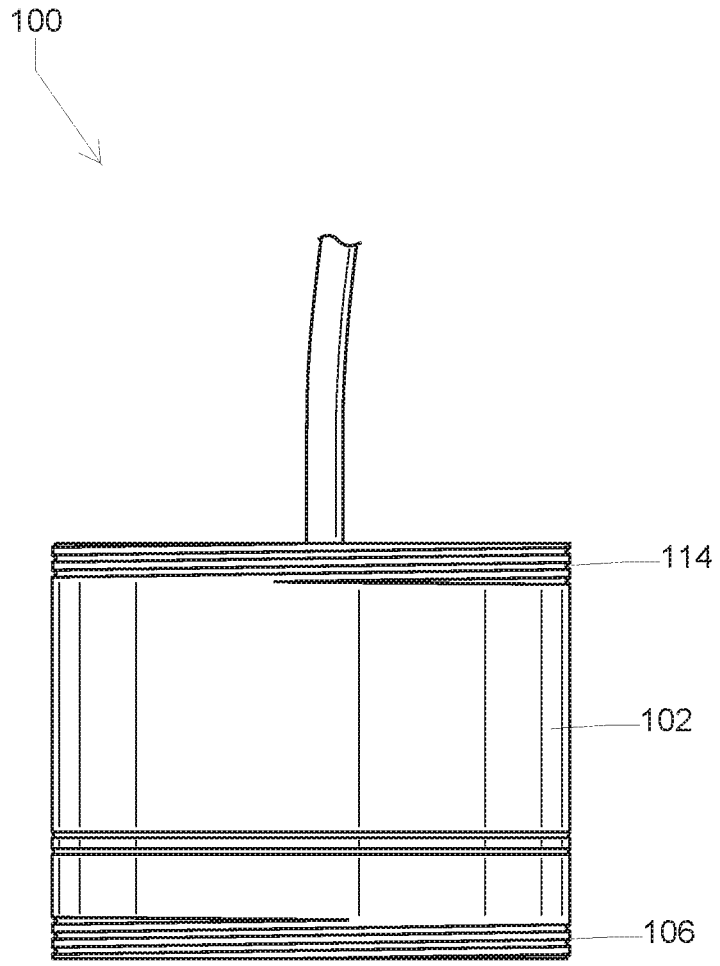
FIG. 3 shows a side elevation view of the light source of FIG. 1.

FIG. 3 shows a side elevation view of light source 100. FIG. 3 shows housing 102, and housing connector 106 proximate the first end of housing 102. Housing connector 106 comprises spiral threading. FIG. 3 also shows a further housing connector 114 disposed proximate the second end of housing 102. Housing connector 114 can also comprise spiral threading disposed on the outer surface of housing 102. While FIG. 3 shows housing 102 as have two housing connectors one proximate each end, it is contemplated that in some examples the housing need not comprise housing connector 114.

Figure 4:
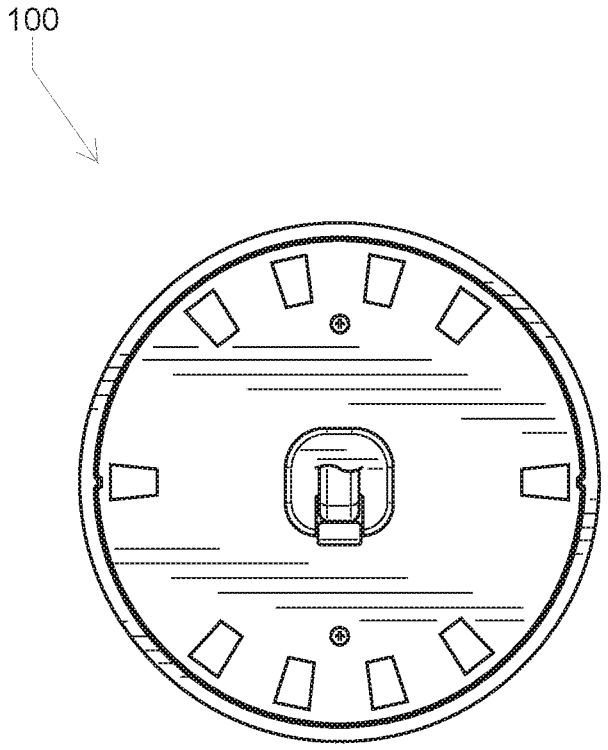
FIG. 4 shows a top plan view of the light source of FIG. 1.
Figure 5:
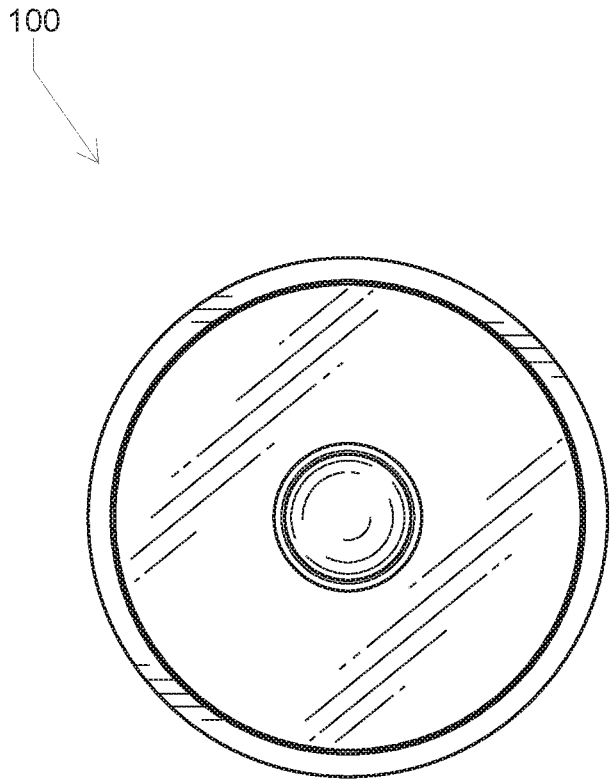
FIG. 5 shows a bottom plan view of the light source of FIG. 1.
Figure 6:
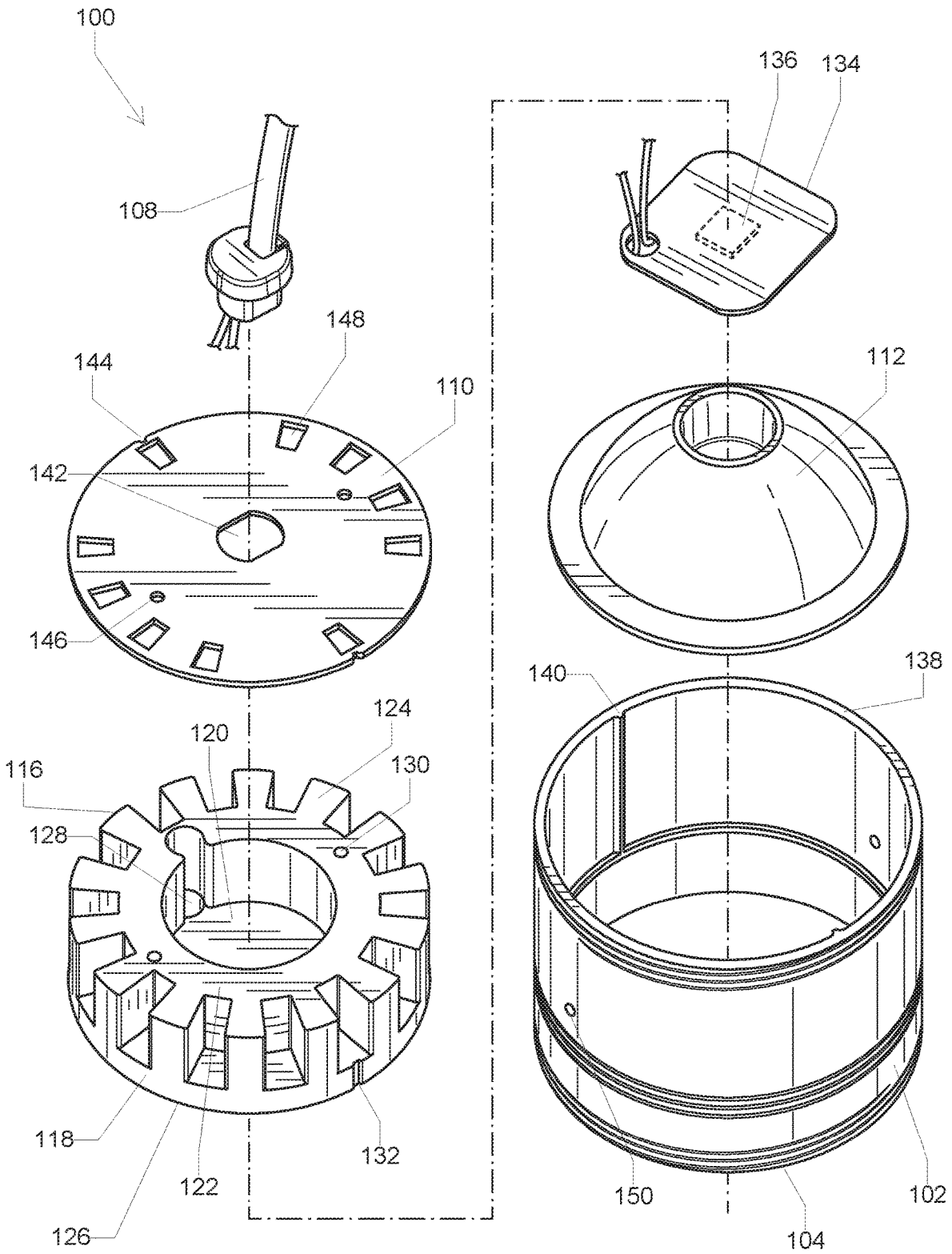
FIG. 6 shows an exploded view of the light source of FIG. 1.

FIG. 4 shows a top plan view of light source 100. FIG. 5 in turn shows a bottom plan view of light source 100. FIG. 6 shows an exploded view of light source 100. FIG. 6 shows a heat sink 116 disposed inside housing 102. Screw holes 150 in housing 102 can be used to secure heat sink 116 to housing 102. Heat sink 116 can comprise a heat sink base 118 having a substantially circular shape. Heat sink base 118 can be receivable in the cylindrical housing 102. In examples where the housing can have a shape other than cylindrical, the heat sink and its based can have a shape to allow the heat sink to be received inside the housing.

Heat sink base 118 can comprise a first side 120 and a second side 126 opposite first side 120. Moreover, heat sink 116 can comprise an annular extension 122 extending out of a plane defined by heat sink base 118 and from first side 120 of heat sink base 118. In other examples the extension out of the plane of the heat sink base can have a shape other than annular, such as solid cylindrical, polygonal, and the like. Heat sink 116 can further comprise a plurality of blades 124 extending radially from annular extension 122. Blades 124 can be configured to facilitate heat exchange between heat sink 116 and an environment surrounding heat sink 116 by increasing a surface area of heat sink 116.

FIG. 6 also shows a light emitter 134 comprising a light emitting diode (LED) 136 disposed on a support. LED 136 is shown in dashed lines because the LEDs are disposed on the side of the support that is not visible in FIG. 6. It is contemplated that light emitter 134 can comprise one LED or any number of LEDs. The support can comprise an opening in a corner to allow for passage of electrical leads connecting to the LED. In addition, while FIG. 6 shows the light emitter comprising an LED, it is contemplated that in some examples light source 100 can comprise a light generator other than an LED, such as an incandescent, fluorescent, or halogen light generator.

Light emitter 134 can be disposed inside housing 102 and in thermal communication with heat sink 116. Light emitter 134 can be positioned to allow the light emitted by light emitter 134 to exit housing 102 through first end 104. For example, light emitter 134 can be disposed on second side 126 of heat sink 116. In some examples, light emitter 134 can be secured on second side 126 using thermal adhesive, and the like. In order to allow for the electrical leads of light emitter 134 to pass, heat sink 116 can comprise an opening 128 in heat sink base 118. The leads of light emitter 134 can also be considered as a portion or extension of connector 108. As shown in FIG. 6, opening 128 can extend at least partly through annular extension 122. In other examples, opening 128 can be positioned differently in heat sink base 118, and need not extend through annular extension 122.

Moreover, as shown in FIG. 6, light source 100 can also comprise cover 110 configured to at least partially cover second end 138 of housing 102. Cover 110 can comprise one or more cover openings 148 to facilitate heat exchange between an inside of housing 102 and an environment outside housing 102. The shape, size, number, and position of openings 148 can be chosen to provide sufficient heat exchange between inside and outside housing 102, while also providing some protection for the components inside housing 102 against external elements.

Cover 110 can also comprise screw holes 146, which can be aligned with screw holes 130 in heat sink 116. The screw holes in cover 110 and heat sink 116 can be used to secure cover 110 to heat sink 116. It is contemplated that in other examples the cover need not be secured to the heat sink, and can instead and/or in addition be secured to housing 102 or other components of light source 100. Cover 110 can also comprise a further cover opening 142 to allow for passage of connector 108 into housing 102.

Furthermore, FIG. 6 shows that housing 102 comprises a ridge 140 extending from an inner surface of housing 102, which housing has a cylindrical shape in FIG. 6. Ridge 140 can be oriented about axially along the cylindrical body of housing 102. Ridge 140 can be integrally formed with housing 102, or it can be separately form and then secured to housing 102. It is contemplated that in some examples the housing need not comprise a ridge.

Ridge 140 can be used to align heat sink 116 and cover 110 in relation to housing 102. Heat sink 116 can comprise notch 132 and cover 110 can comprise notch 144, the notches shaped to receive ridge 140 to allow for aligning heat sink 116 and/or cover 110 in the cylindrical portion of housing 102. Housing 102 can comprise two ridges at diametrically opposite points of its inner surface, and heat sink 116 and cover 110 can also each comprise a pair of notches shaped, sized, and positioned to receive the ridges.

Figure 7:
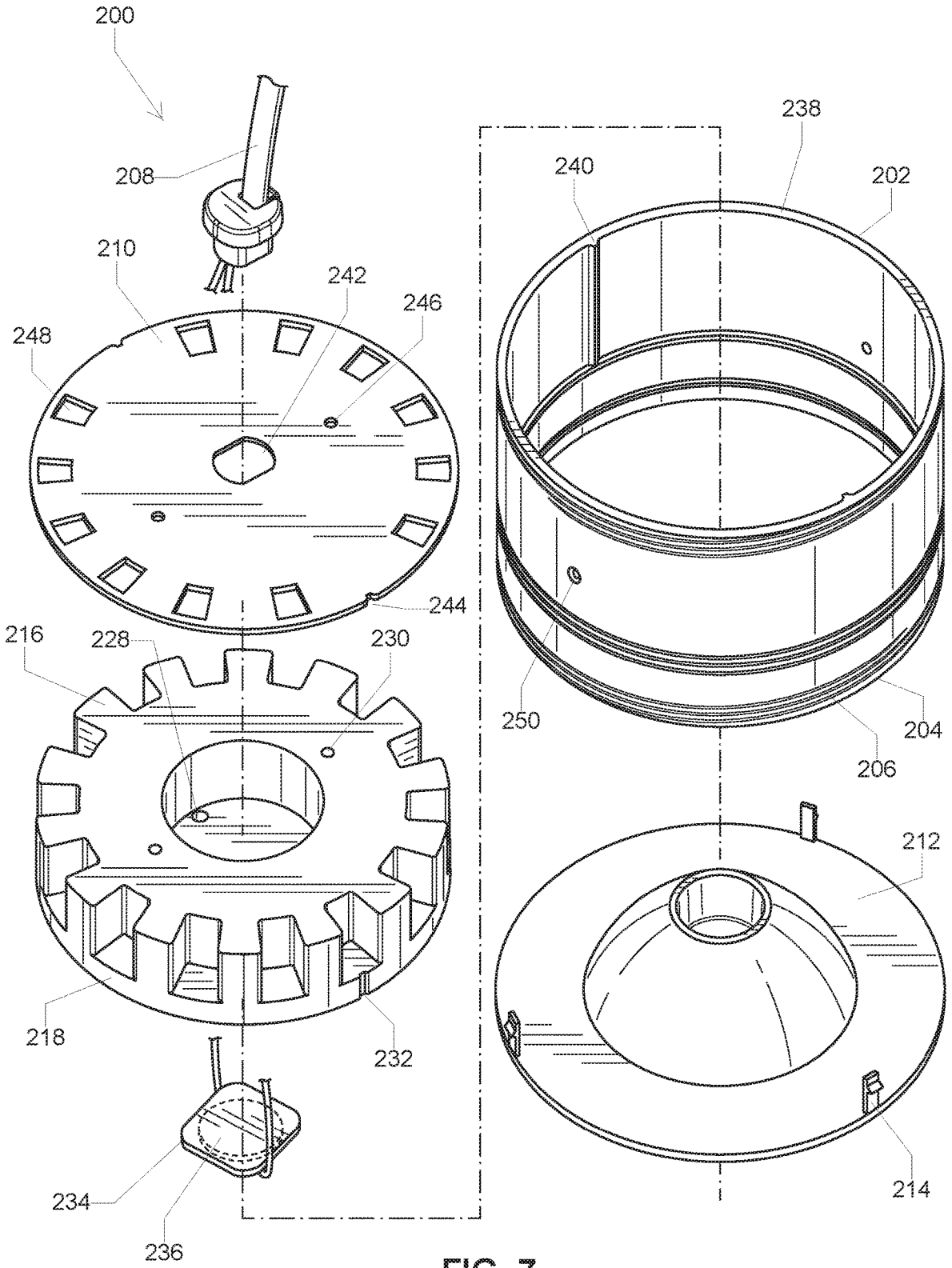
FIG. 7 shows an exploded view of another example light source.

FIG. 7 shows an exploded view of a light source 200. Light source 200 can have a larger diameter than light source 100, and light source 200 can comprise similar components with similar functions and arrangement as in light source 100. Light source 200 can comprise a housing 202 having a first end 204 and a second end 238 opposite the first end. Housing 202 can comprise a housing connector 206 disposed on housing 202 proximate first end 204. Housing connector 206 can comprise a spiral threading on an outer surface of housing 202. Housing 202 can also comprise a ridge 240 and a screw hole 250.

Light source 200 can also comprise a lens 212 shaped and size to be secured to housing 202 proximate first end 204. Lens 212 can comprise resiliently biased snap fasteners 214 for securing lens 212 to housing 202. In other examples, the lens can be secured to the housing using fasteners or securing elements other than snap fasteners.

Moreover, light source 200 can comprise a heat sink 216 comprising a heat sink base 218, an annular extension extending from a side of heat sink base 218, and a plurality of blades extending radially from the annular extension. Heat sink 216 can comprise two openings 228 (only one is visible in the view shown in FIG. 7) which can allow electrical leads of light emitter 234 to pass through heat sink base 218 and connect with connector 208. The leads can comprise two separate wires, with each wire passing through a corresponding one of the two openings 228. Heat sink base 218 can also comprise notch 232 to receive ridge 240. Moreover, heat sink 216 can comprise screw holes 230, to allow for connecting a cover 210 to heat sink 216.

Light emitter 234 can, in turn, comprise one or more LEDs 236, disposed on a support. LEDs 236 are shown in dashed lines because they are disposed on the side of the support that is not visible in FIG. 7. Light emitter 234 can be disposed on, and in thermal communication with, the side of heat sink base 218 opposite the annular extension. Furthermore, light source 200 can comprise a cover 210 having a plurality of openings 248, a further opening 242 for allowing the passage of connector 208, screw holes 246 for connecting to heat sink 216, and notches 244 for receiving ridges 240 of housing 202.

Figure 8:
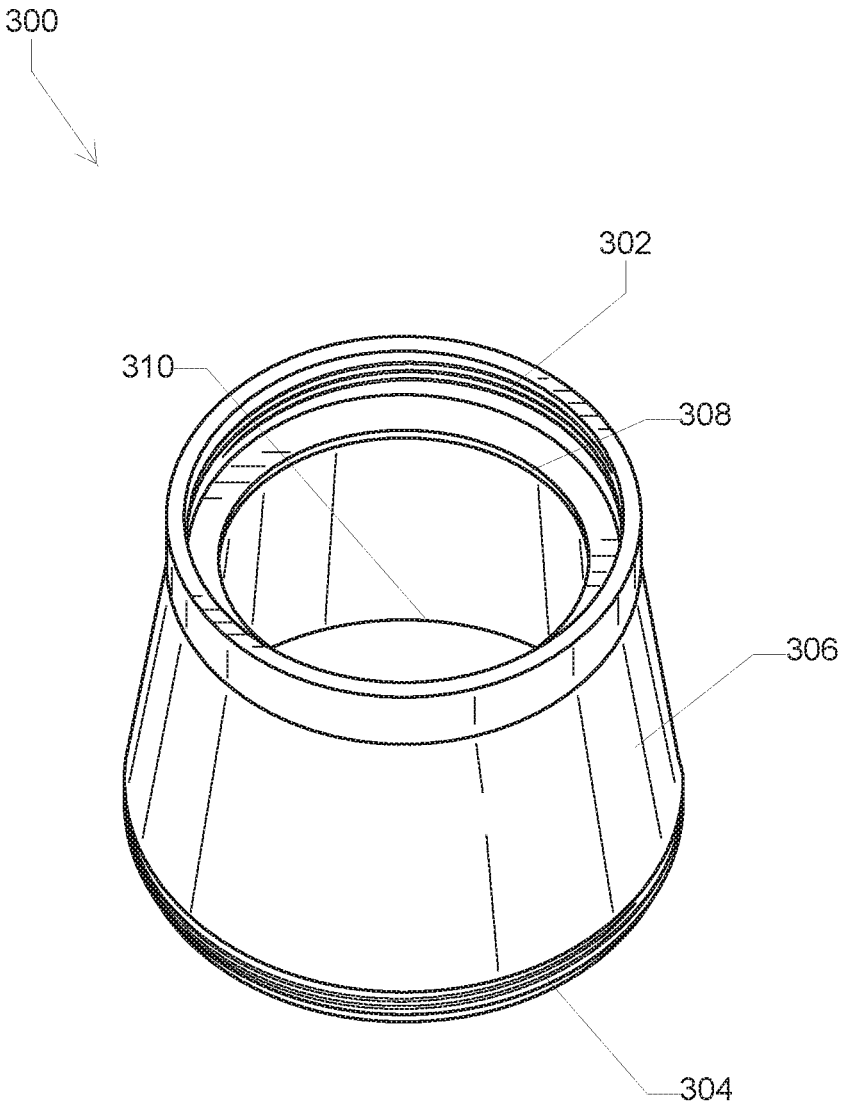
FIG. 8 shows a perspective view of an example adaptor.

Turning now to FIG. 8, a top perspective view of an example adaptor 300 is shown. Adaptor 300 can be reversibly securable to light sources, including but not limited to light sources 100 or 200. Adaptor 300 can comprise a first connector 302 and a second connector 304 coupled to first connector 302. Adaptor 300 can also comprise a light conduit 306 extending from first connector 302 to second connector 304 and coupling the two connectors.

As shown in FIG. 8, adaptor 300 can generally have a frustoconical shape. In some examples, light conduit 306 can have a frustoconical inner shape, terminating in a small open end 308 and a large open end 310. First connector 302 can comprise a spiral threading proximate small open end 308 and disposed on the inner surface of the adaptor. This spiral threading can be configured for reversibly mating with the housing spiral threading for reversibly securing the adaptor to the housing, such as housing 102 of light source 100. Similarly, second connector 304 can comprise a spiral threading proximate large open end 310 and disposed on the outer surface of the adaptor. This spiral threading can be configured for reversibly mating the adaptor to a trim.

While FIG. 8 shows the spiral threading at the first connector 302 and second connector 304 on the inner and outer surfaces of adaptor 300 respectively, it is contemplated that in other examples, both spiral threadings can be on the same inner or outer surface of adaptor 300, or the spiral threading proximate small open end 308 can be on the outer surface while the spiral threading proximate the large open end 310 can be on the inner surface of adaptor 300. Moreover, it is contemplated that in other example adaptors, first and second connectors can comprise connection mechanisms other than spiral threading. The structure and positioning of the connectors can be selected to be mateable with the housing connector of the light source and the connector for the trim.

Moreover, it is contemplated that the light conduit can comprise a passage for allowing light emitted by the light source to pass through the adaptor towards the trim. Furthermore, the light conduit can be continuous (e.g. as shown in FIG. 8) or in some examples it can have openings in addition to the small and large open ends. In some examples, the light conduit can have a shape other than frustoconical. In addition, in some examples the light conduit can comprise a light guide such as a light rod or an optical fiber.

Furthermore, in some examples the inner shape of the light conduit can be used to control or shape the profile of the light beam that emerges from the adaptor. For example, a converging light conduit in an adaptor (e.g. where the light receiving open end of the conduit is larger than the light emitting open end) can tighten or reduce a light beam's cross-section or diameter. Conversely, a diverging light conduit (e.g. where the light receiving open end is smaller than the light emitting open end, as for example in the frustoconical shape of adaptor 300) can allow the light emitted by the light source to diverge and spread out further as it passes through the light conduit of the adaptor. In some examples, the adaptor can comprise materials including, but not limited to metals, polymers, composites, and the like.

Figure 9:
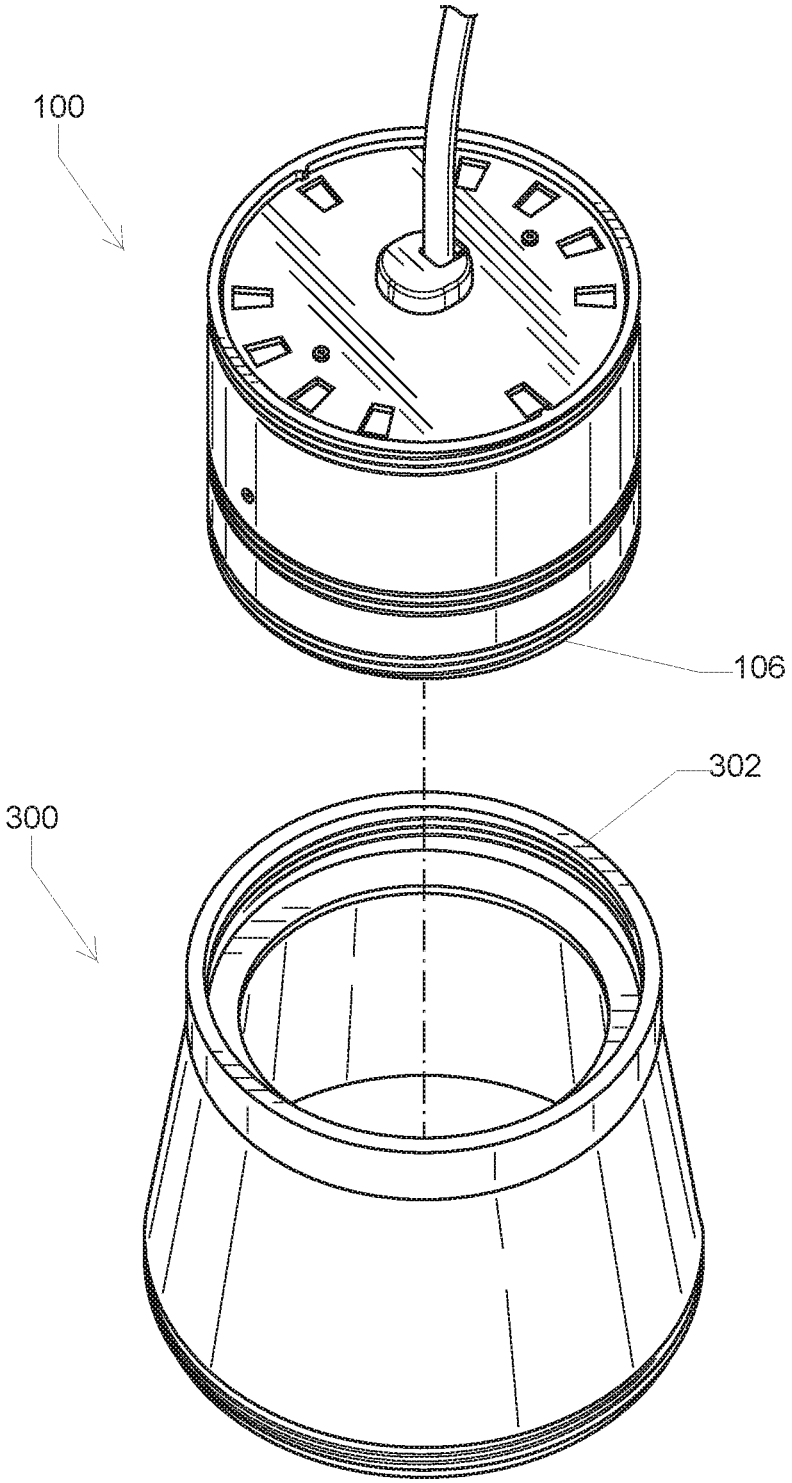
FIG. 9 shows a perspective view of the light source of FIG. 1 and the adaptor of FIG. 8.
Figure 10:
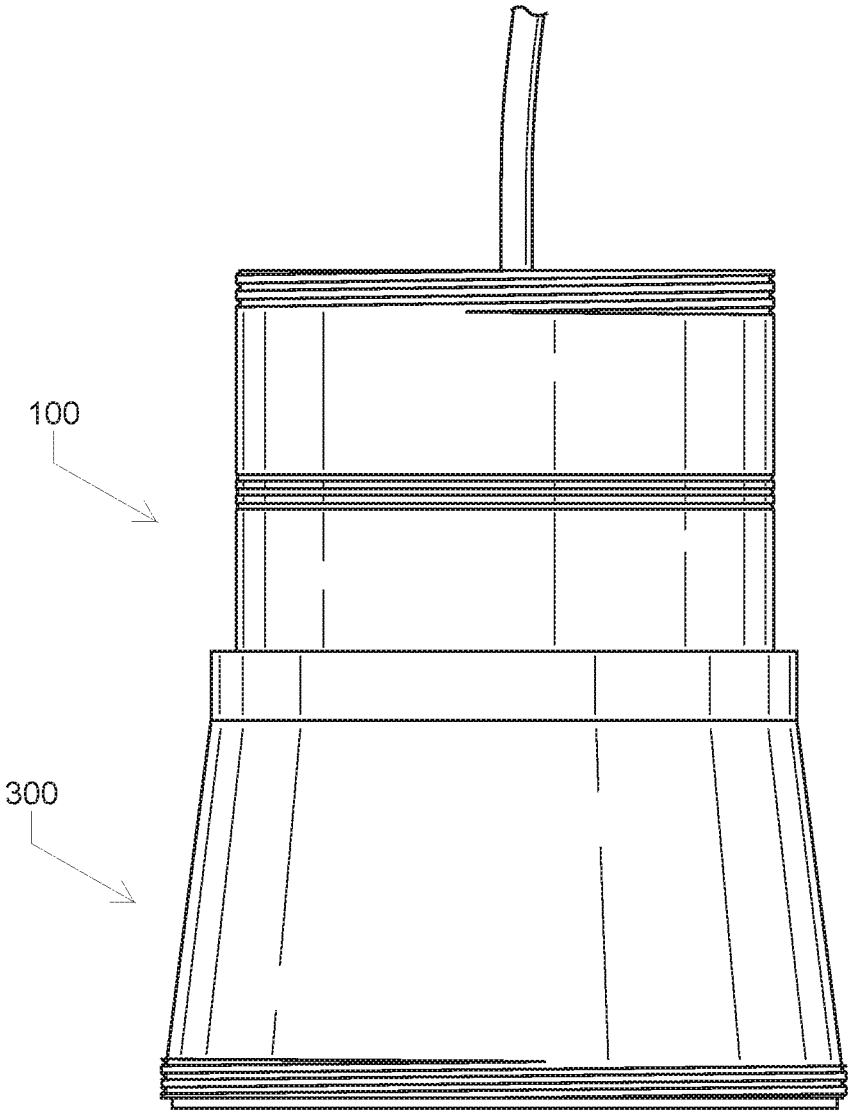
FIG. 10 shows a perspective view of the light source of FIG. 1 connected to the adaptor of FIG. 8.

FIG. 9 shows light source 100 and adaptor 300 separate from one another. FIG. 10, in turn, shows light source 100 and adaptor 300 connected to one another. The light source and the adaptor can be reversibly connected or coupled to one another by connecting housing connector 106 (shown in FIG. 9) of light source 100 to first connector 302 of adaptor 300. When the housing and first connectors comprise spiral threading, connecting the light source to the adaptor can comprise mating the two spiral threadings together, or in other words, by screwing the light source and the adaptor together. The use of spiral threading in the housing and first connectors can allow for a mechanically strong coupling that can be reversible. In addition, it can allow for either the light source or the adaptor to be reversibly couplable with other components, including other light sources, adaptors, and trims, that have complementary spirally threaded connectors. In some examples, connection using spiral threading can also provide a connection that is substantially air-, gas-, and/or water vapor-impermeable. Such impermeability can address at least some of the requirements for the engineering, safety, and/or certification specifications against which the light fixture can be tested.

Figure 11:
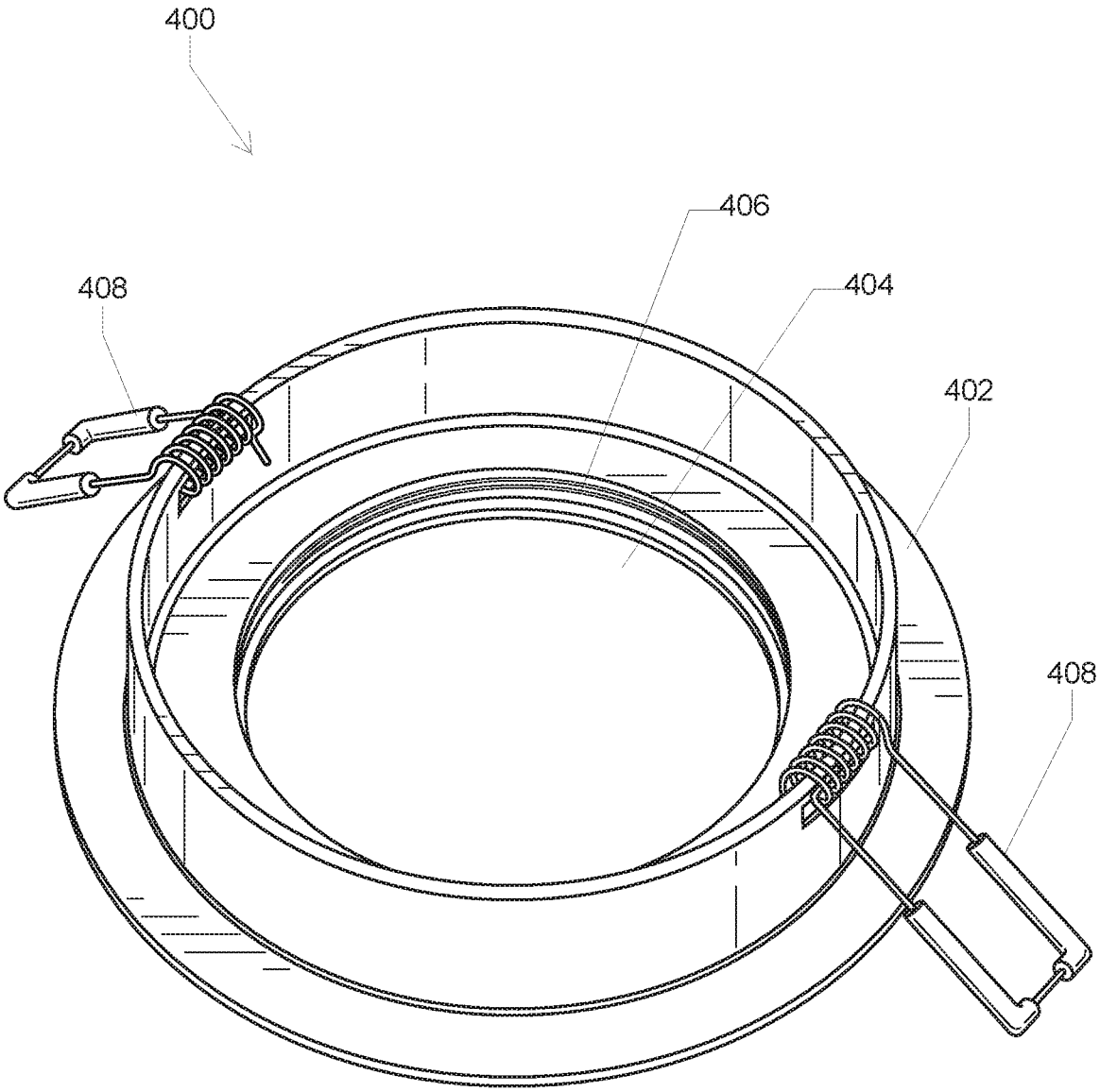
FIG. 11 shows a perspective view of an example trim.

FIG. 11 shows a top perspective view of an example trim 400 for securing a light fixture to a substrate. In some examples, the trim can be partially or entirely decorative. Trim 400 can comprise a trim base 402 configured to interface with the substrate. Trim base 402 can comprise a trim opening 404 configured to allow passage of the light emitted by the light emitter of a light source such as light source 100. Moreover, trim 400 can comprise a trim connector 406 coupled to trim base 402. Trim connector 406 can be configured to reversibly couple trim 400 to one or more of a light source such as light source 100 and an adaptor such as adaptor 300.

As shown in FIG. 11, trim connector 406 can comprise a trim spiral threading proximate trim opening 404. In other examples, the trim connector can comprise a fastening or connecting mechanism other than spiral threading, and the trim connector can be located at a position on trim 400 different than being proximate to the trim opening. The spiral threading of trim connector 406 can be shaped and sized to reversibly mate and connect with the housing connector of a light source such as light source 100 or the second connector of an adaptor such as adaptor 300.

Moreover, trim 400 can comprise trim connector clips 408 coupled to trim base 402. Clips 408 can be biased in the position shown in FIG. 11 by springs. When installing trim 400 in a substrate, a hole is made in the substrate. Clips 408 are bent inwards towards one another and against the resilient force of the springs. Then trim 400 is installed in the hole and clips 408 are allowed to return towards the position shown in FIG. 11 under the resilient force of the springs. This movement and force of the clips pinches the edges of the substrate between trim base 402 and the resiliently-biased clips 408, thereby securing trim 400 to the substrate.

Figure 12:
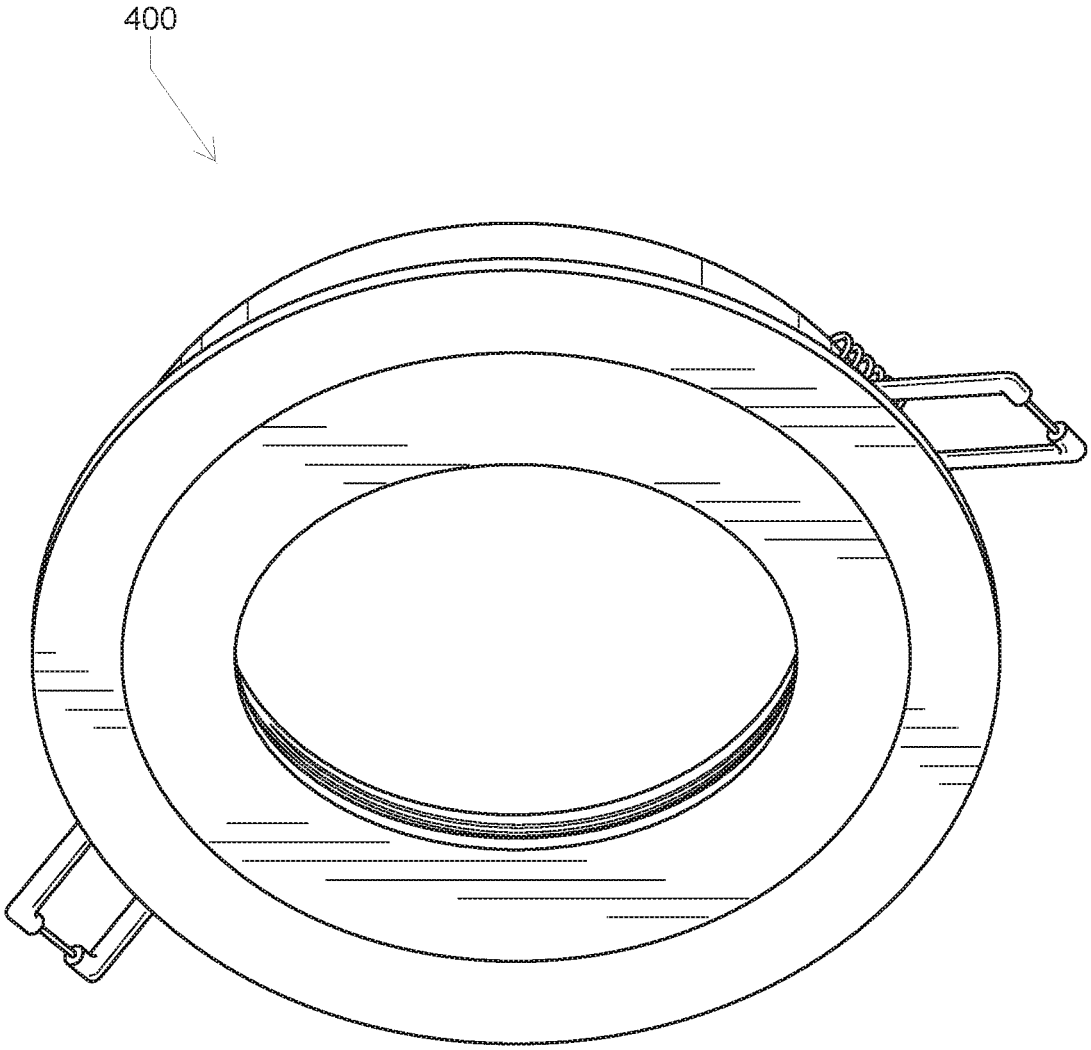
FIG. 12 shows another perspective view of the trim of FIG. 11.

While FIG. 11 shows trim base 402 as having a circular outer perimeter, it is contemplated that in other examples the trim and its base can have a different shape such as square, square with rounded corners, rectangle, oval, and the like. In addition, a portion of the trim can rest outside of the substrate and be a visible portion of the light fixture when installed in the substrate. This portion can also have different shapes and profiles. FIG. 12 shows a bottom perspective view of trim 400, depicting the shape of the portion of trim base 402 that would be visible when trim 400 is installed in the substrate.

Figure 13:
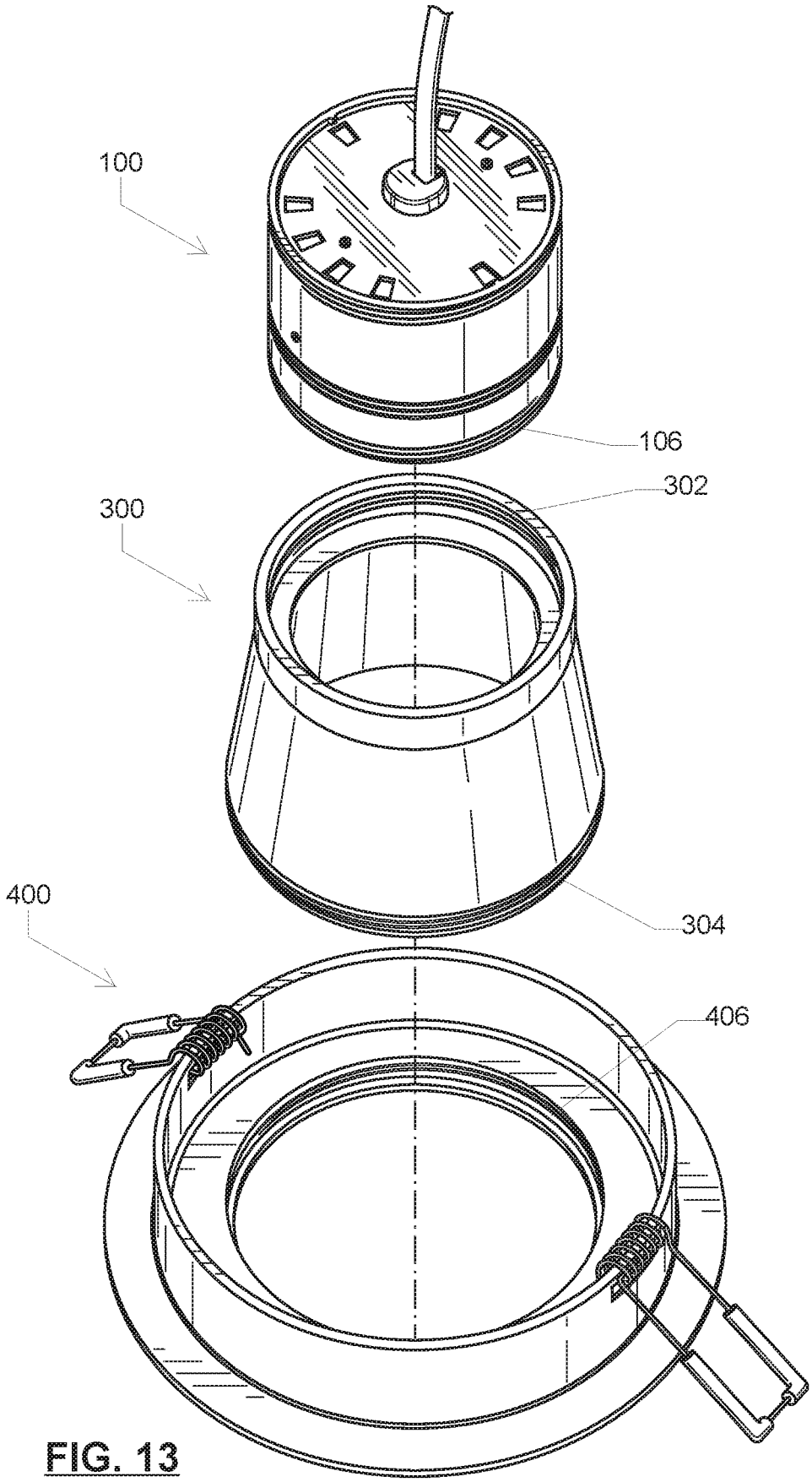
FIG. 13 shows a perspective view of the light source of FIG. 1, the adaptor of FIG. 8, and the trim of FIG. 11.
Figure 14:
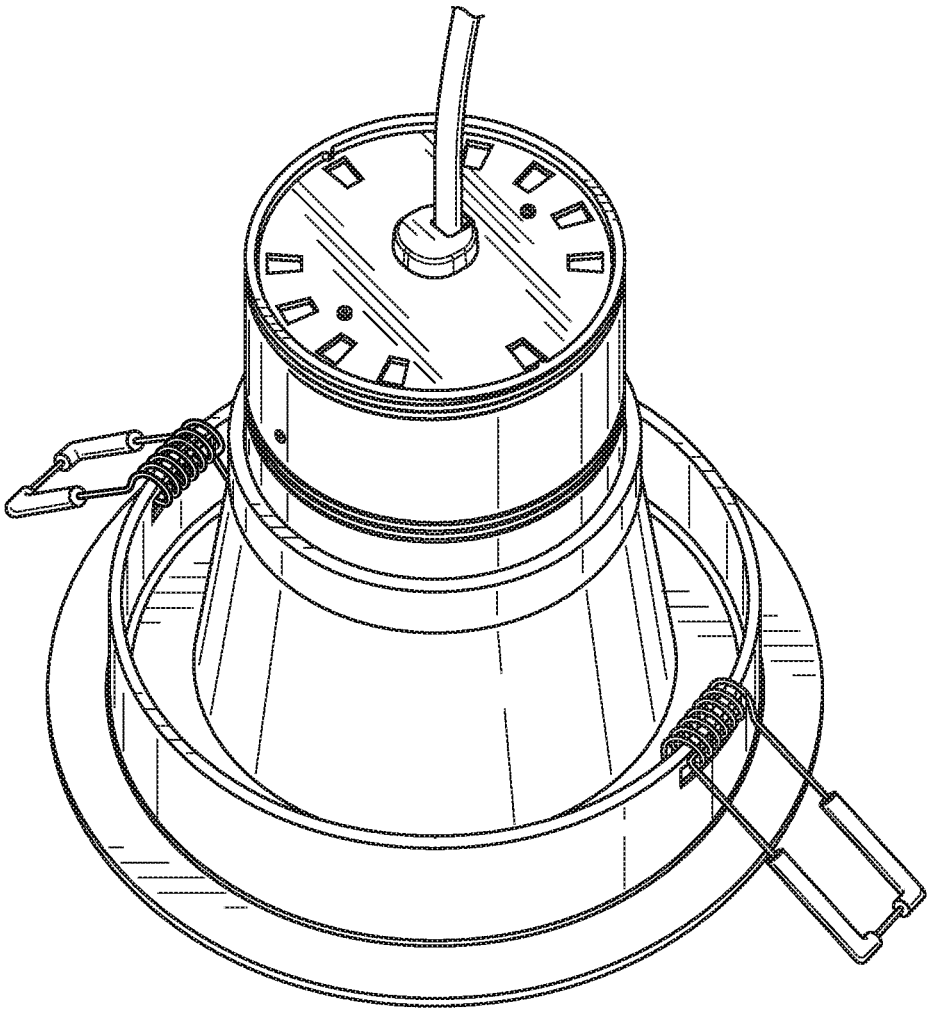
FIG. 14 shows a perspective of the light source of FIG. 1, the adaptor of FIG. 8, and the trim of FIG. 11 connected together.

Turning now to FIG. 13, light source 100, adaptor 300, and trim 400 are shown. Light source 100 can reversibly connected to adaptor 300 by screwing housing connector 106 with first connector 302. In turn, second connector 304 and trim connector 406 can also both comprise spiral threading. This can allow adaptor 300 to be connected to trim 400 by screwing second connector 304 with trim connector 406. These connections can allow for assembling a light fixture as shown in FIG. 14, which fixture can comprise the light source, the adaptor, and the trim. It is also contemplated that in other examples (not shown), the light fixture can comprise the light source connected directly to the trim.

Figure 15:
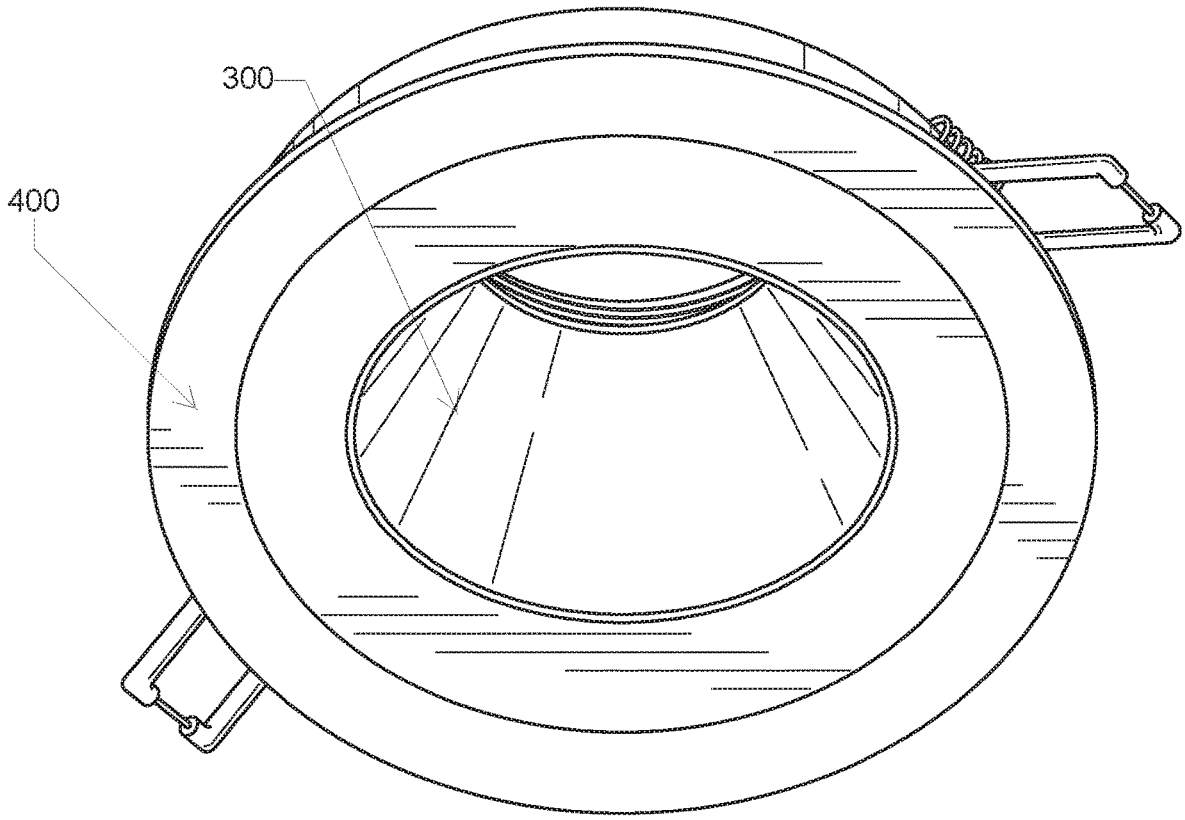
FIG. 15 shows a perspective view of the adaptor of FIG. 8 connected to the trim of FIG. 11.
Figure 16:
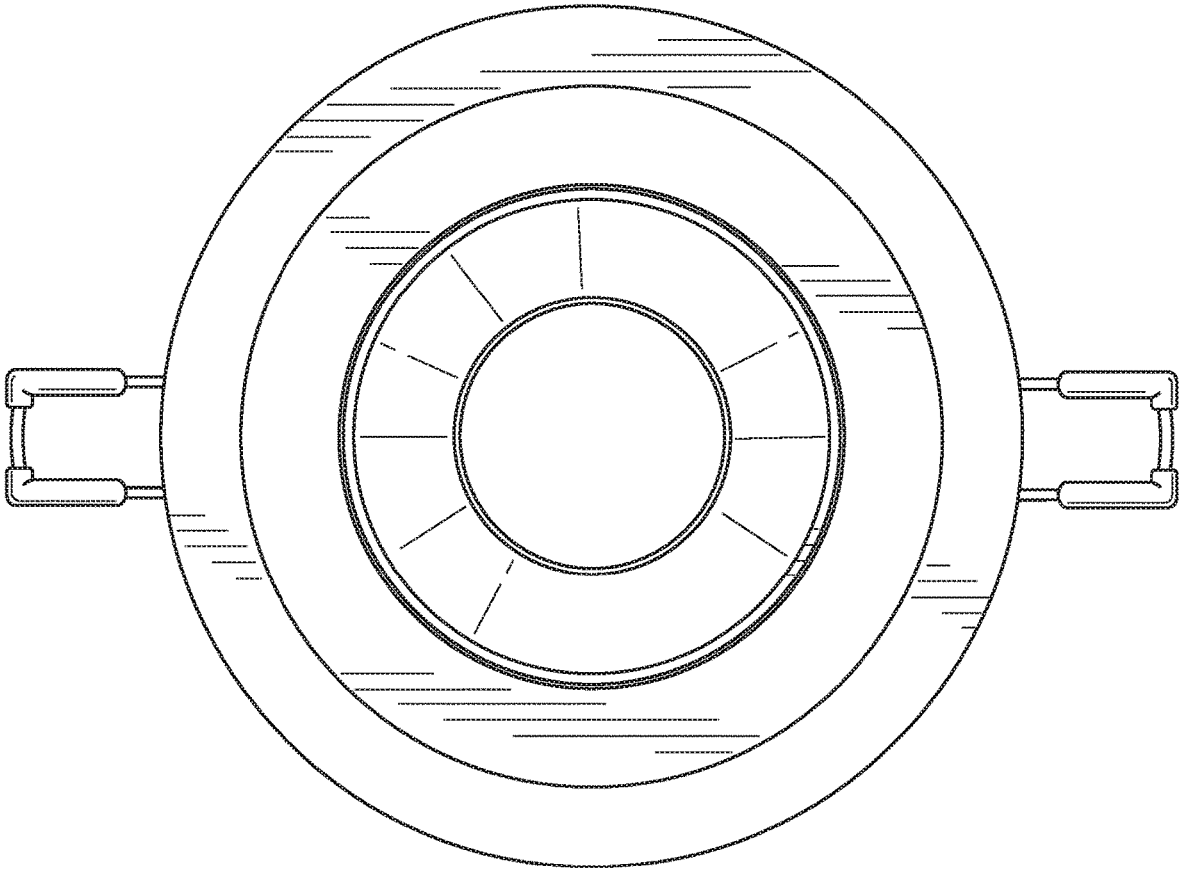
FIG. 16 shows a bottom plan view of the adaptor of FIG. 8 connected to the trim of FIG. 11.
Figure 17:
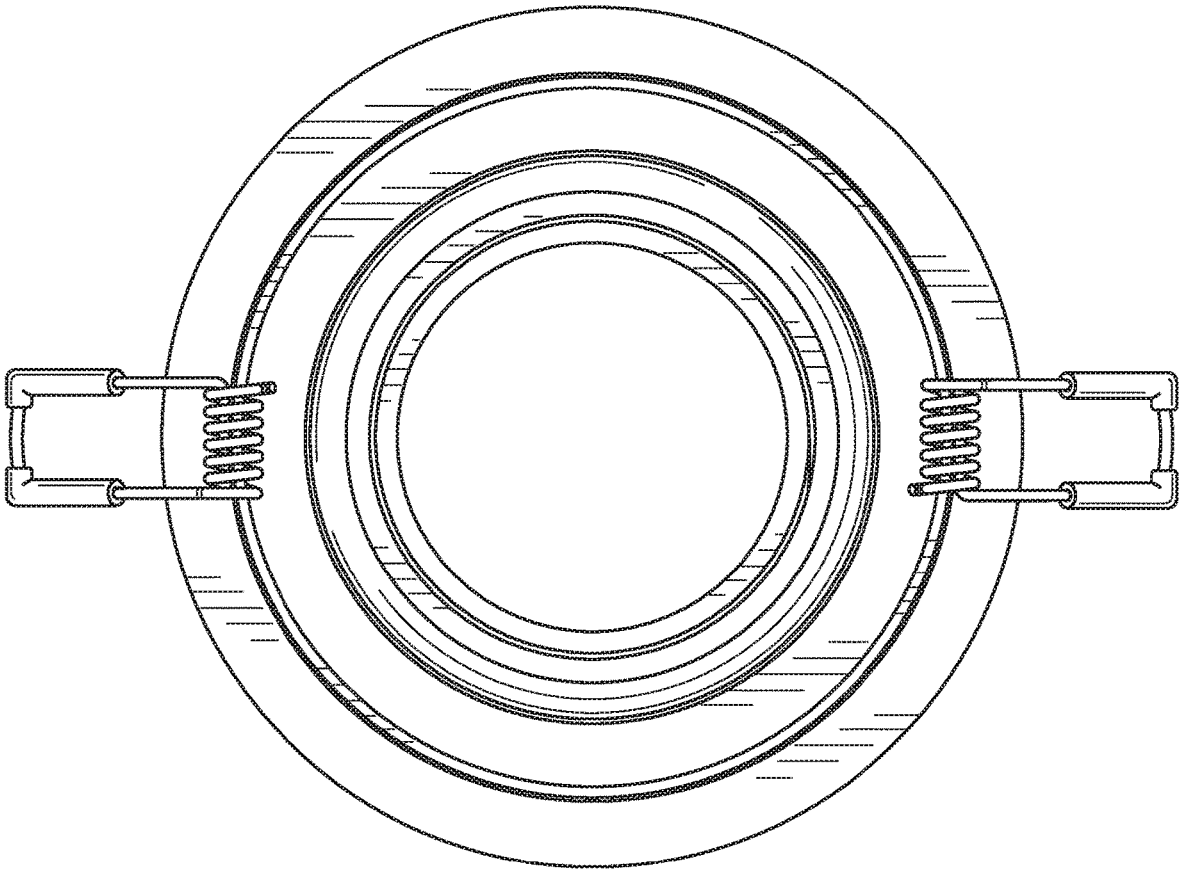
FIG. 17 shows a top plan view of the adaptor of FIG. 8 connected to the trim of FIG. 11.
Figure 18:
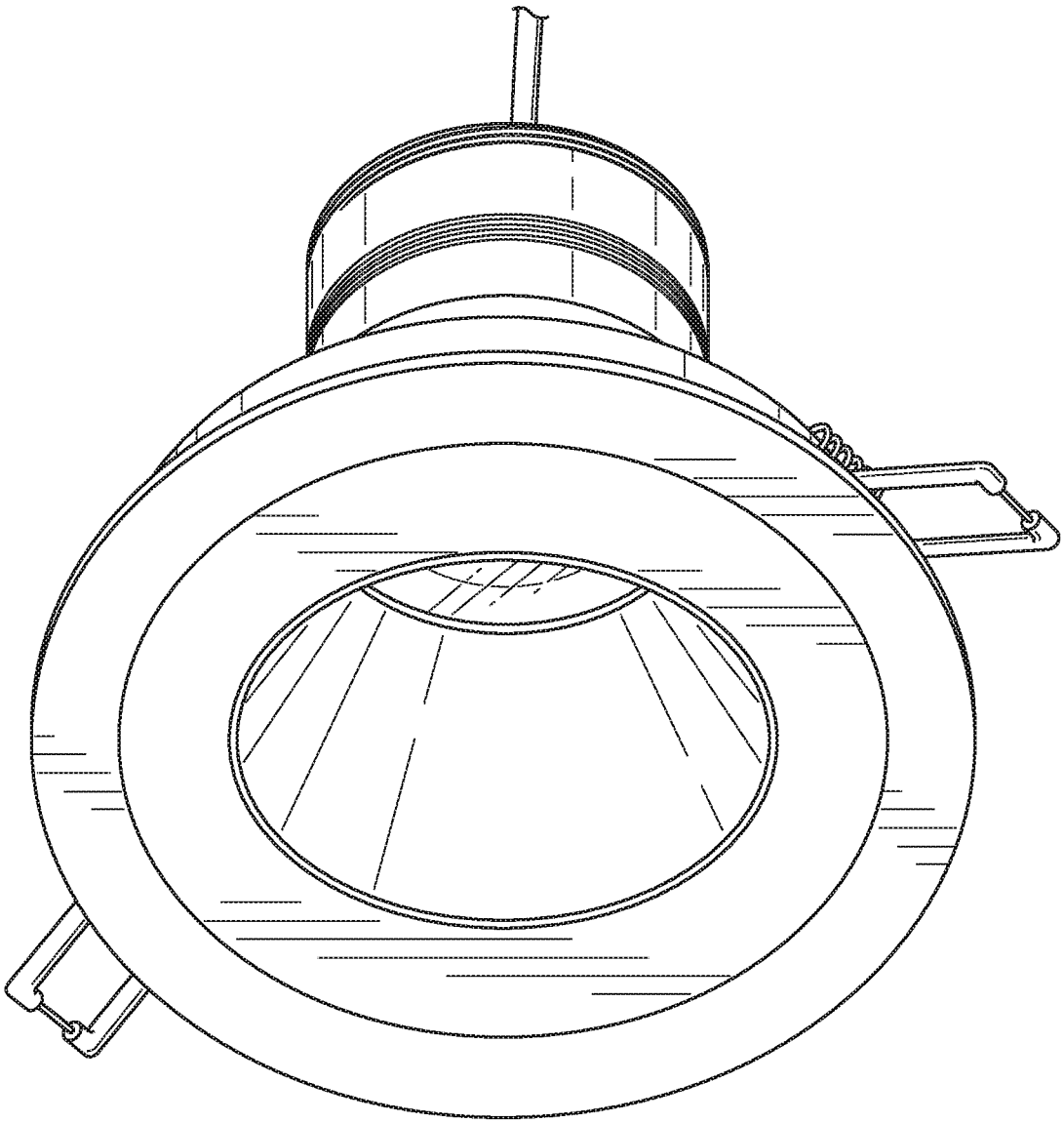
FIG. 18 shows a perspective view of the light source of FIG. 1, the adaptor of FIG. 8, and the trim of FIG. 11 connected together.
Figure 19:
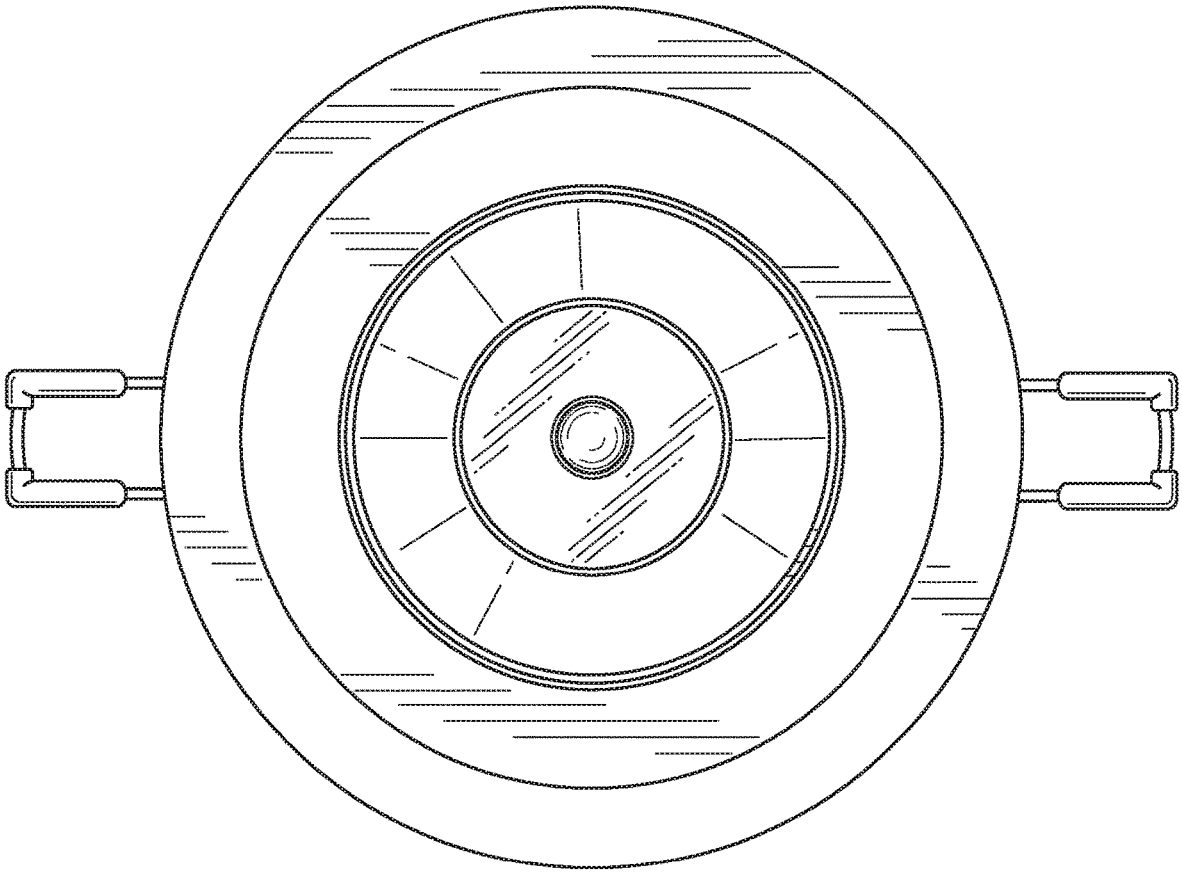
FIG. 19 shows a bottom plan view of the light source of FIG. 1, the adaptor of FIG. 8, and the trim of FIG. 11 connected together.
Figure 20:
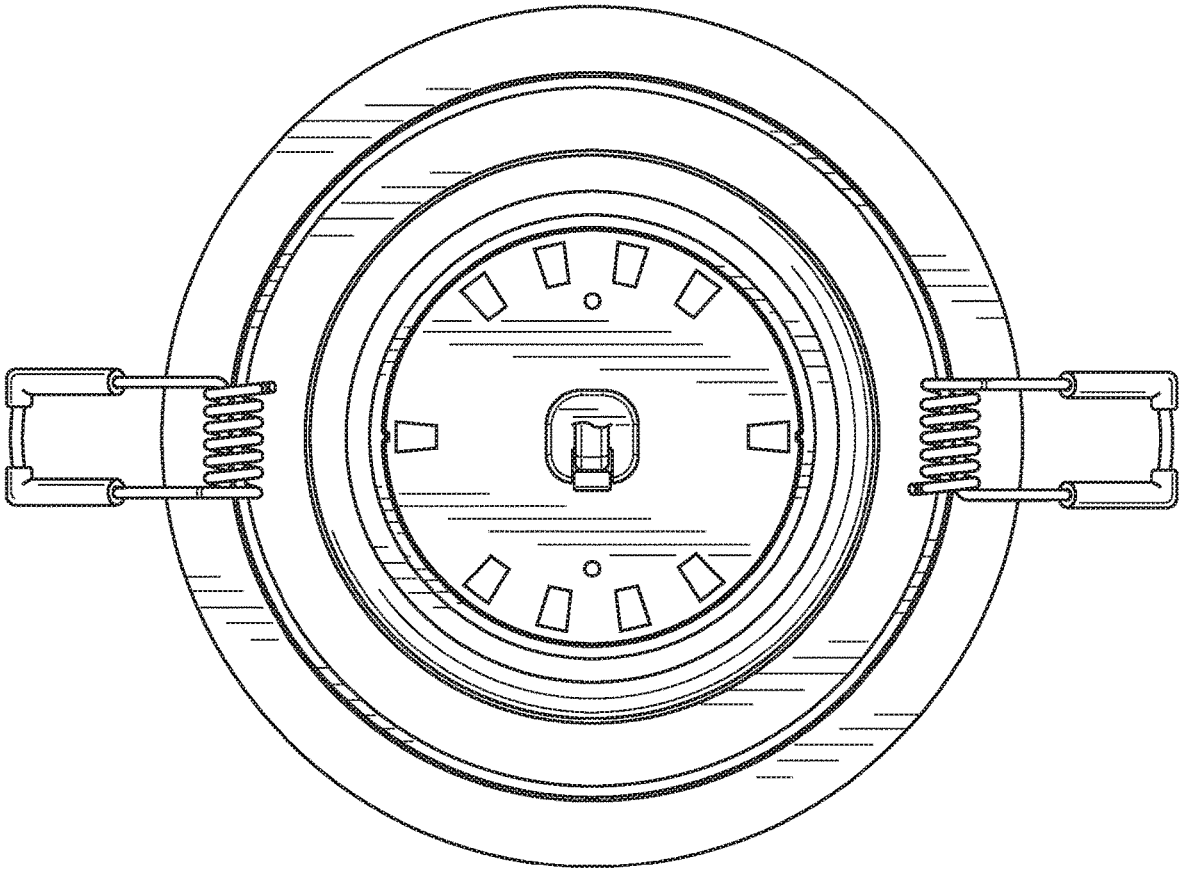
FIG. 20 shows a top plan view of the light source of FIG. 1, the adaptor of FIG. 8, and the trim of FIG. 11 connected together.

FIG. 15 shows a bottom perspective view of trim 400 and adaptor 300 connected together. FIG. 16 shows a bottom plan view of the trim and adaptor shown in FIG. 15. FIG. 17 shows a top plan view of the trim and adaptor shown in FIG. 15. Moreover, FIG. 18 shows a bottom perspective view of the light fixture shown in FIG. 14. FIG. 19 shows a bottom plan view of the light fixture shown in FIG. 14. FIG. 20 shows a top plan view of the light fixture shown in FIG. 14.

Figure 21:
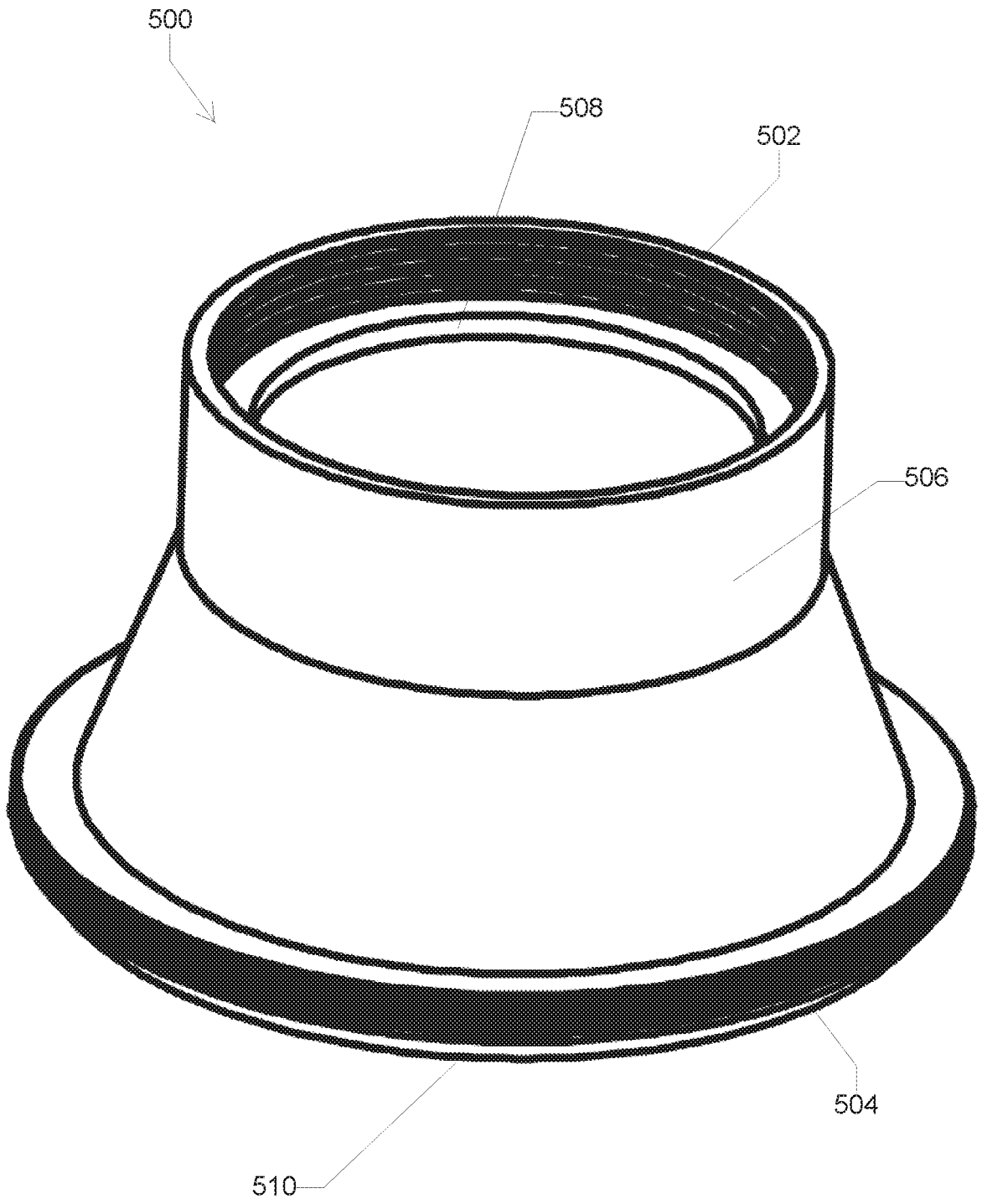
FIG. 21 shows a perspective of another example adaptor.

FIG. 21 shows another example adaptor 500, which can comprise a first connector 502, a second connector 504 connected to first connector 502, and a light conduit extending from first connector 502 to second connector 504. Light conduit 506 can comprise a frustoconical inner shape having a small open end 508 and a large open end 510. First connector 502 can comprise spiral threading disposed on an inner surface of the light conduit 506 proximate small open end 508. Second connector 504 can comprise spiral threading disposed on an outer surface of the light conduit 506 proximate large open end 510. While the outer surface of light conduit 506 is shown as having two portions at different slopes and/or orientations, the inner surface of light conduit 506 can define a frustoconical shape with a single slope along the axial length of the conduit.

Figure 22:
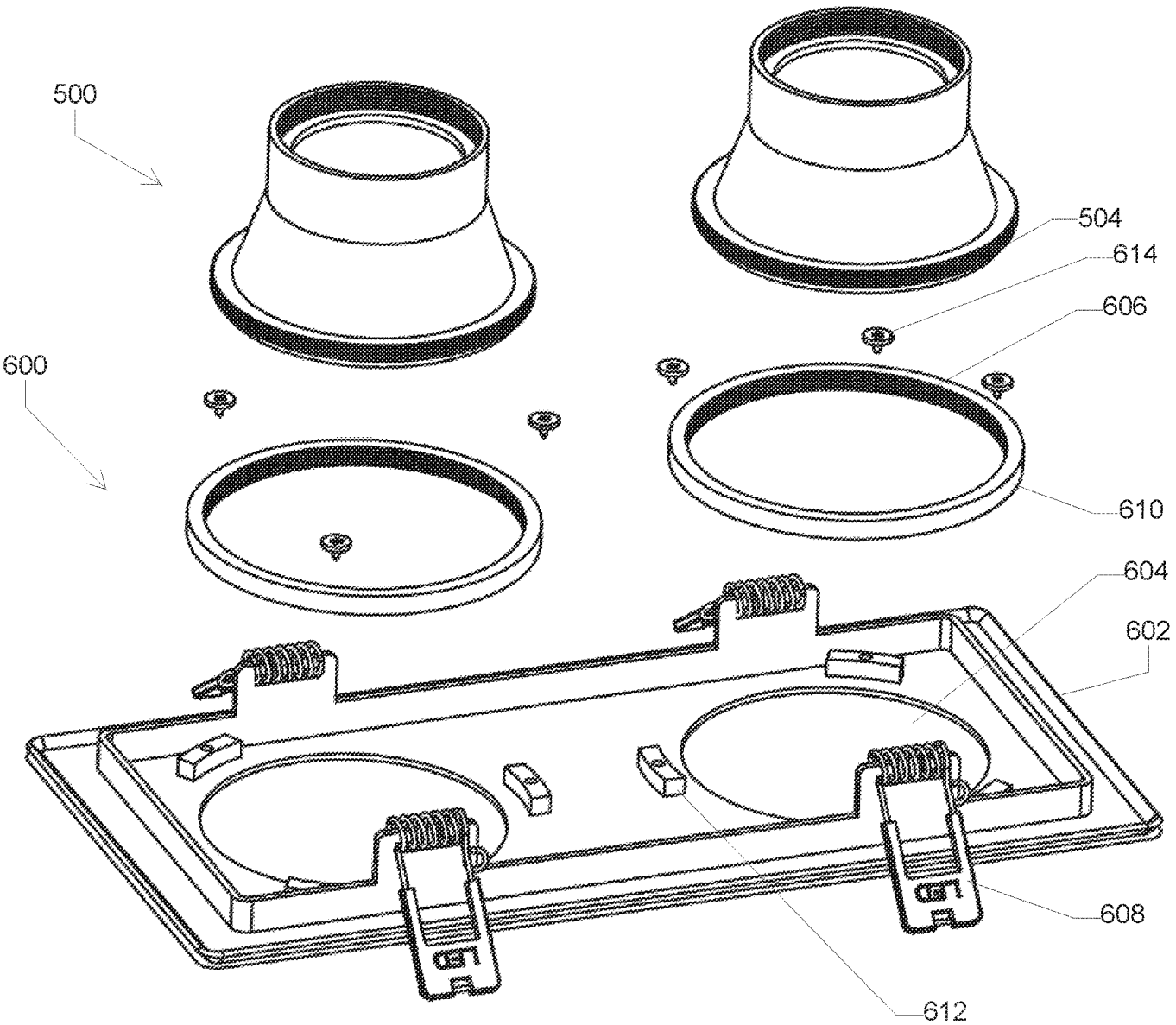
FIG. 22 shows an exploded view of adaptors of FIG. 21 and an example trim.

FIG. 22 shows an exploded view of adaptors 500 and a trim 600. Trim 600 comprises a trim base 602 having two trim openings 604. A trim connector 606 can be secured proximate each trim opening 604 using blocks 612 and respective screws 614 receivable into blocks 612. In other examples (not shown in FIG. 22), the trim connector can be integrally formed with the trim base, or can be secured to the trim base using a securing mechanism other than blocks and screws. Trim connector 606 can comprise a ring 610 having spiral threading on its inner surface for reversibly mating with the spiral threading on second connector 504 of adaptor 500. Trim connector 606 can also directly connect to housing connector of light sources. Moreover, trim 600 can comprise clips 608 for securing trim 600 to the substrate in which trim 600 is installed.

Figure 23:
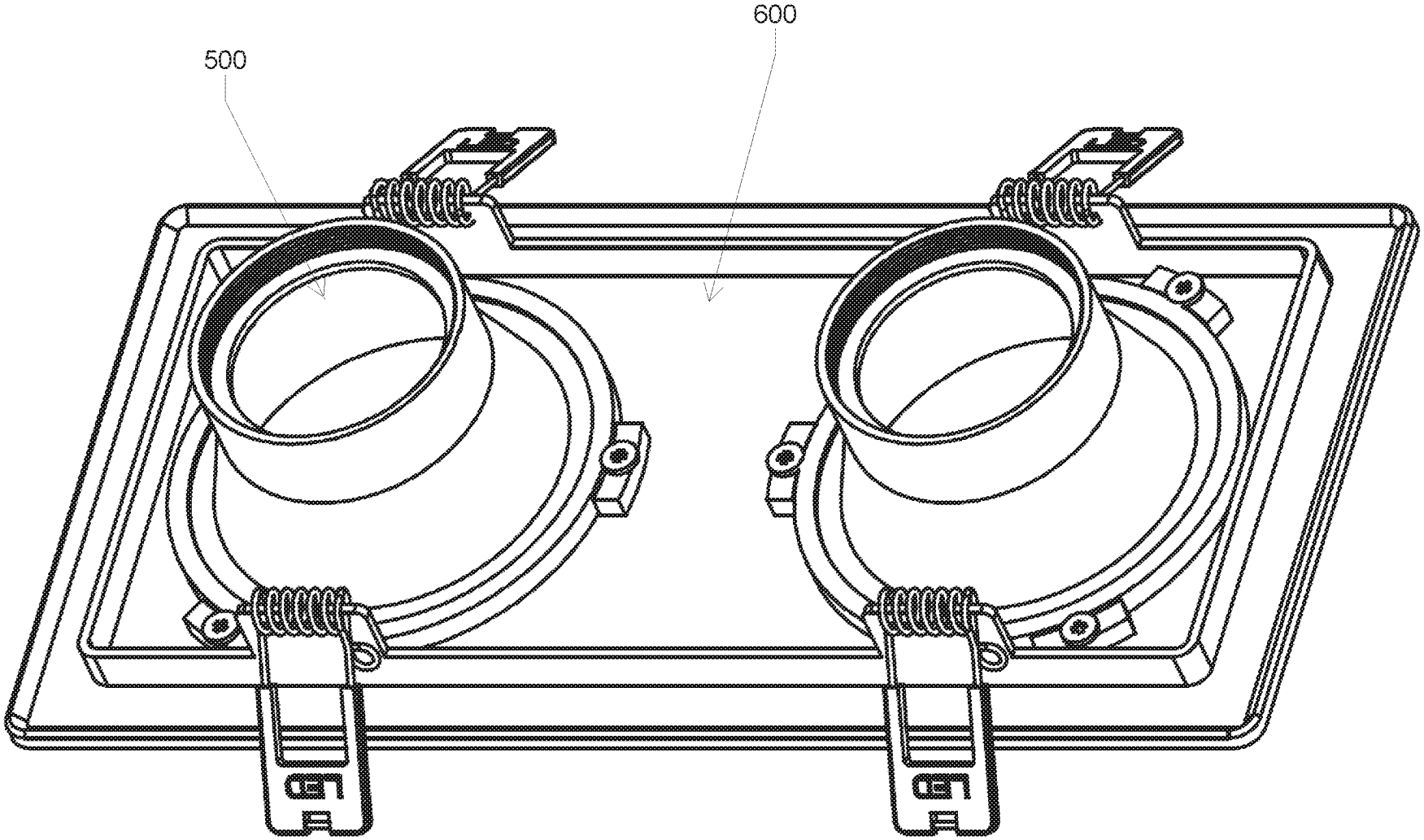
FIG. 23 shows a perspective view of the adaptors of FIG. 21 connected to the trim of FIG. 22.
Figure 24:
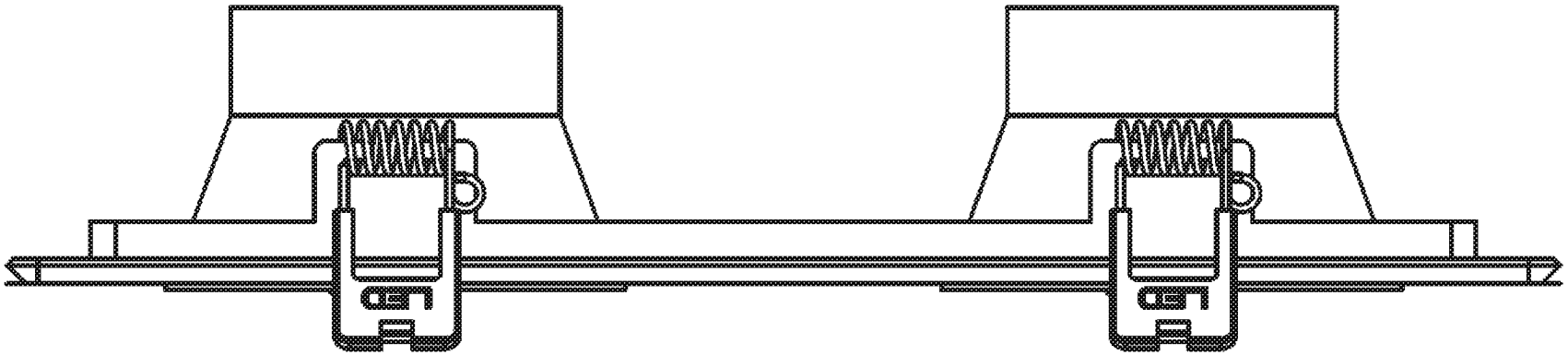
FIG. 24 shows a side elevation view f the adaptors of FIG. 21 connected to the trim of FIG. 22.
Figure 25:
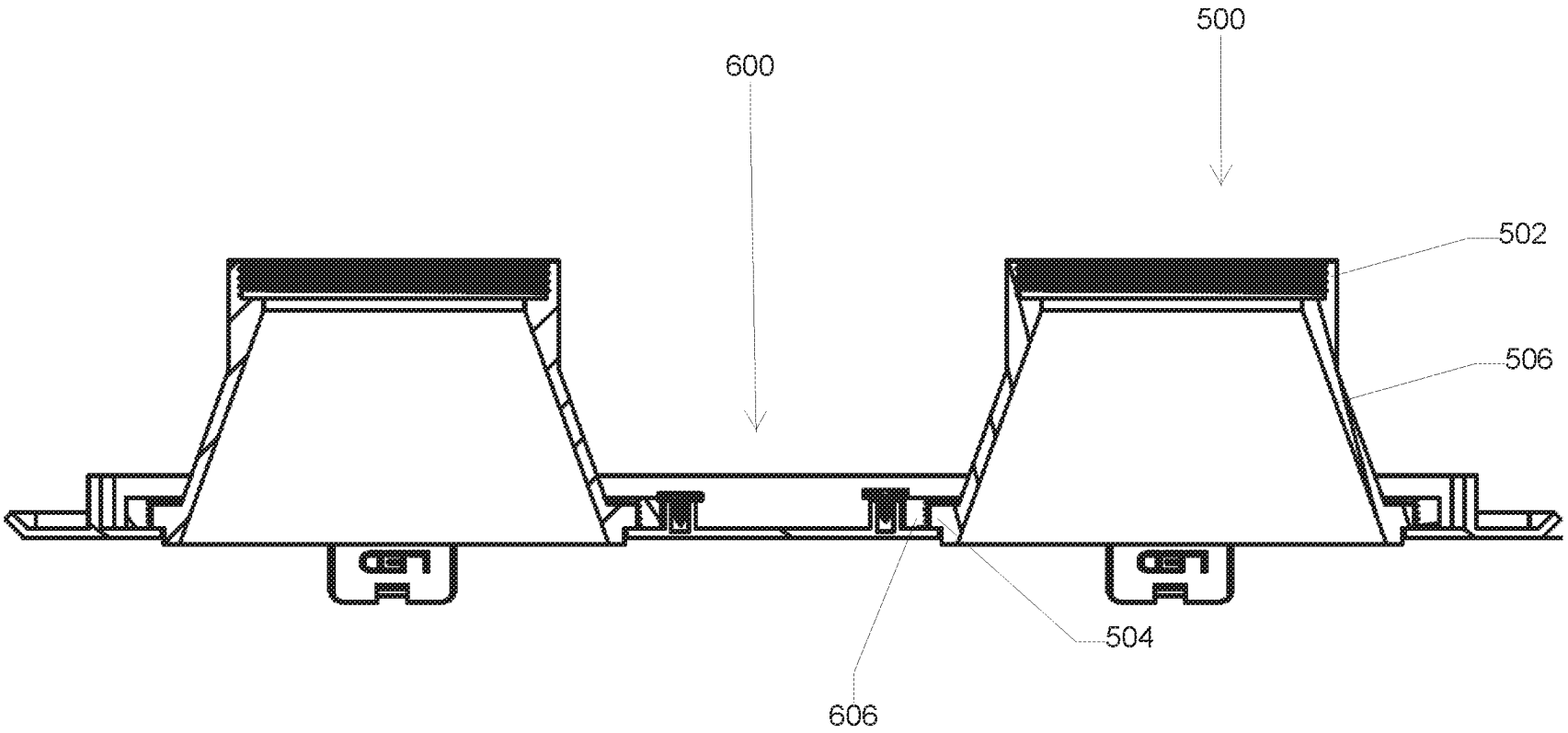
FIG. 25 shows a cross-sectional side elevation view f the adaptors of FIG. 21 connected to the trim of FIG. 22.
Figure 26:
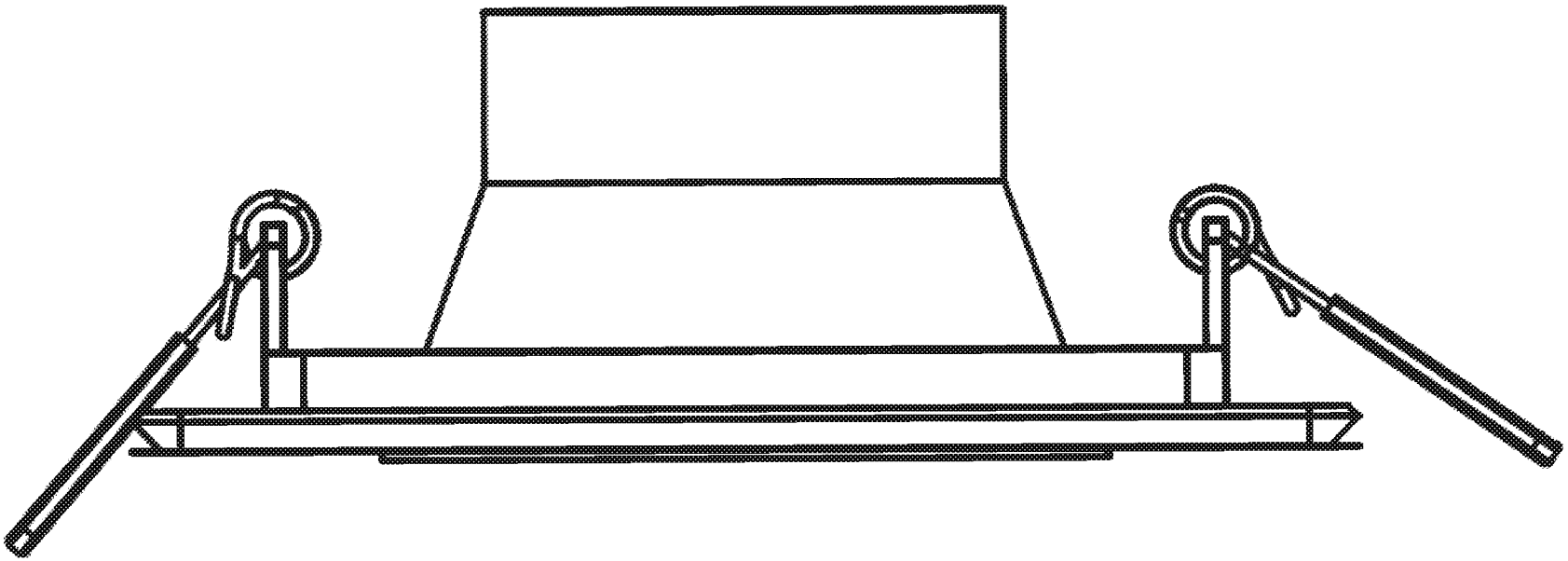
FIG. 26 shows another side elevation view of the adaptors of FIG. 21 connected to the trim of FIG. 22.
Figure 27:
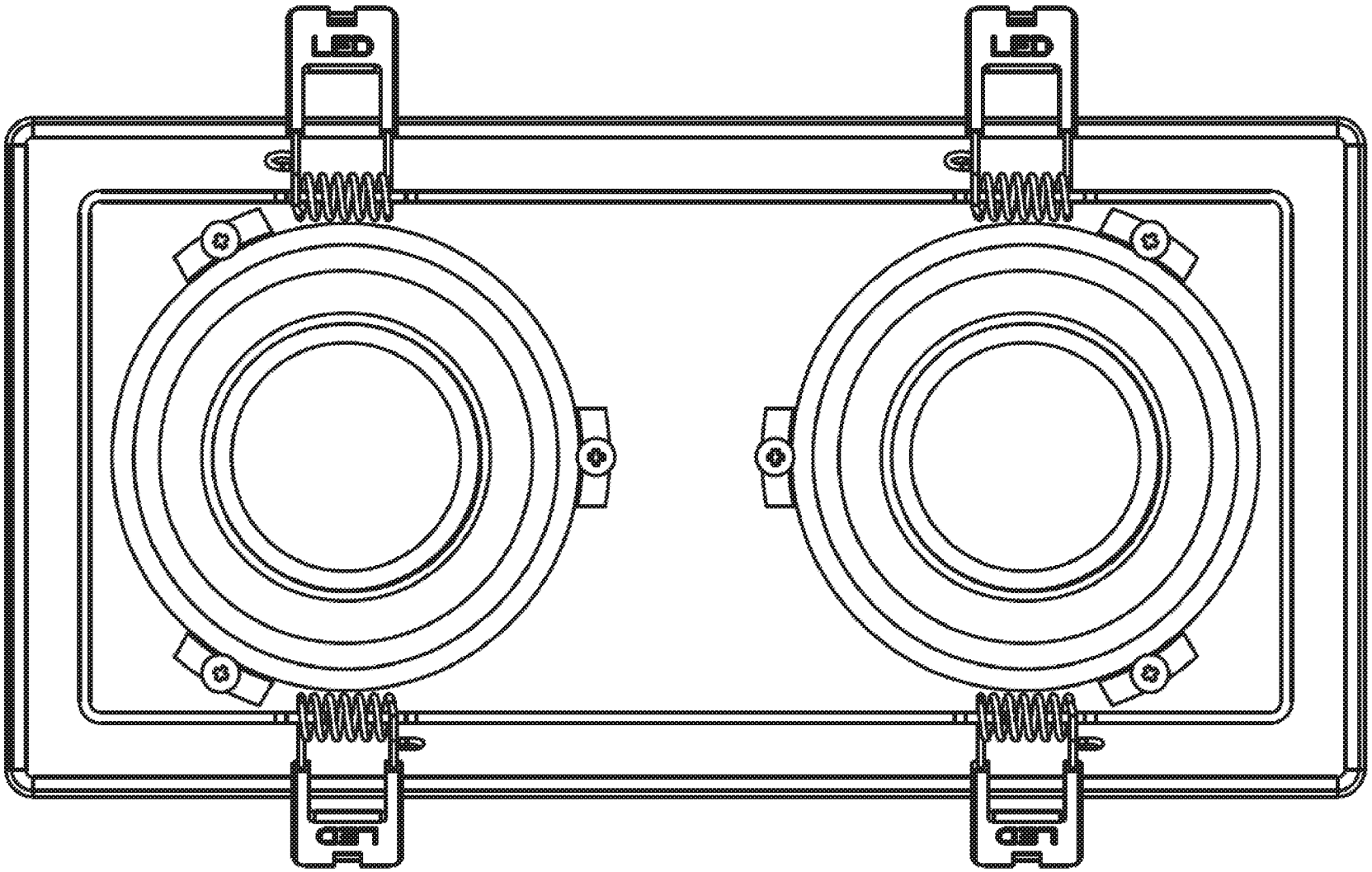
FIG. 27 shows a top plan view of the adaptors of FIG. 21 connected to the trim of FIG. 22.

FIG. 23 shows a top perspective view of trim 600 connected to adaptors 500. FIG. 24 shows a right side elevation view of trim 600 connected to adaptors 500. FIG. 25 shows a cross-sectional view of trim 600 connected to adaptors 500. FIG. 25 shows the spiral threading at first connector 502 of adaptors 500. FIG. 25 also shows spiral threading of second connector 504 cooperating and mating with the spiral threading of trim connector 606. FIG. 25 also shows that light conduit 506 can comprise an outer surface that has at least two sections with two different slopes, while the inner surface of light conduit 506 can define a frustoconical shape having a constant slope. Furthermore, FIG. 26 shows a front side elevation view of trim 600 connected to adaptors 500. FIG. 27, in turn, shows a top plan view of trim 600 connected to adaptors 500.

Figure 28:
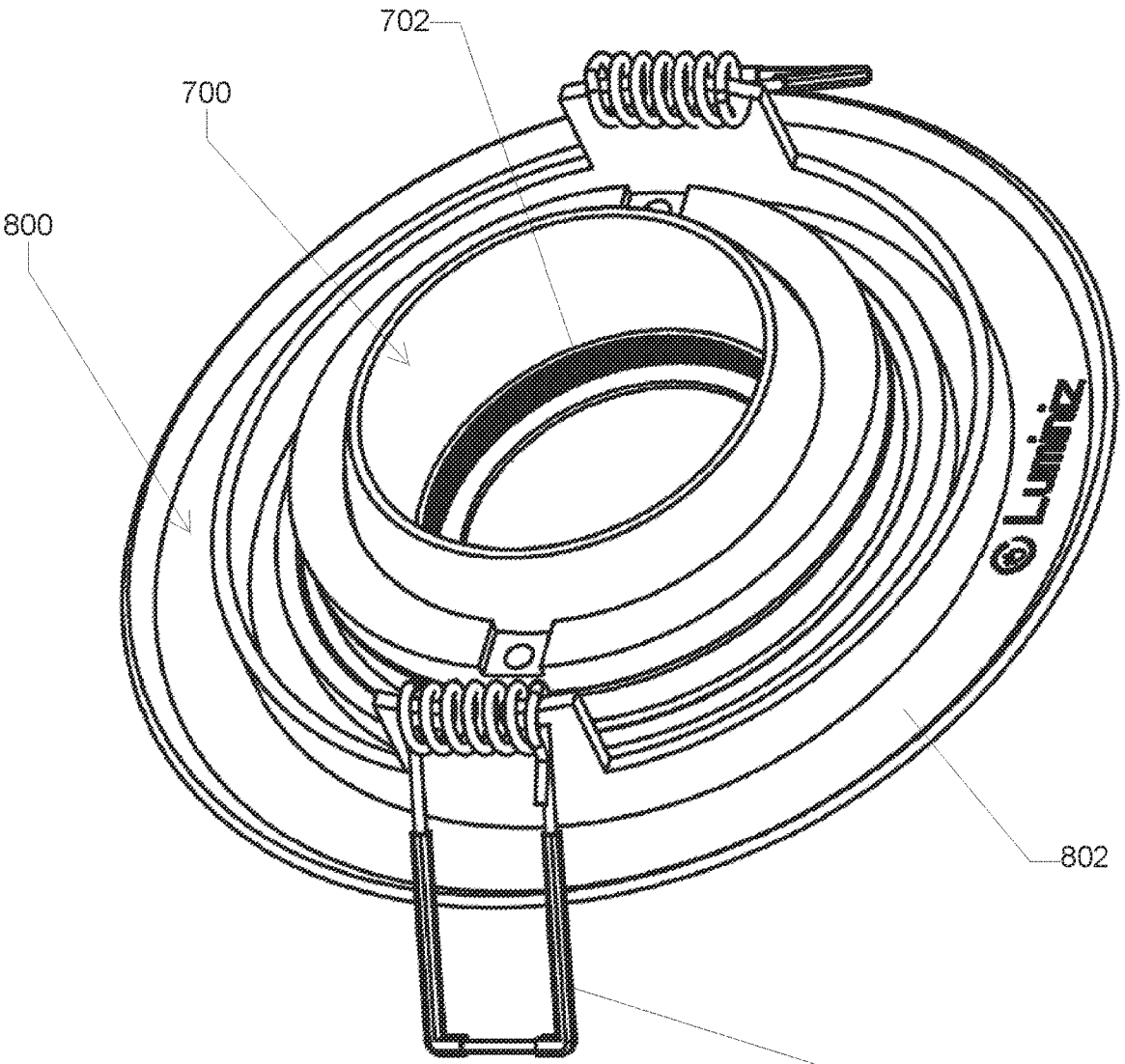
FIG. 28 shows a perspective view of another example adaptor connected to another example trim.
Figure 29:
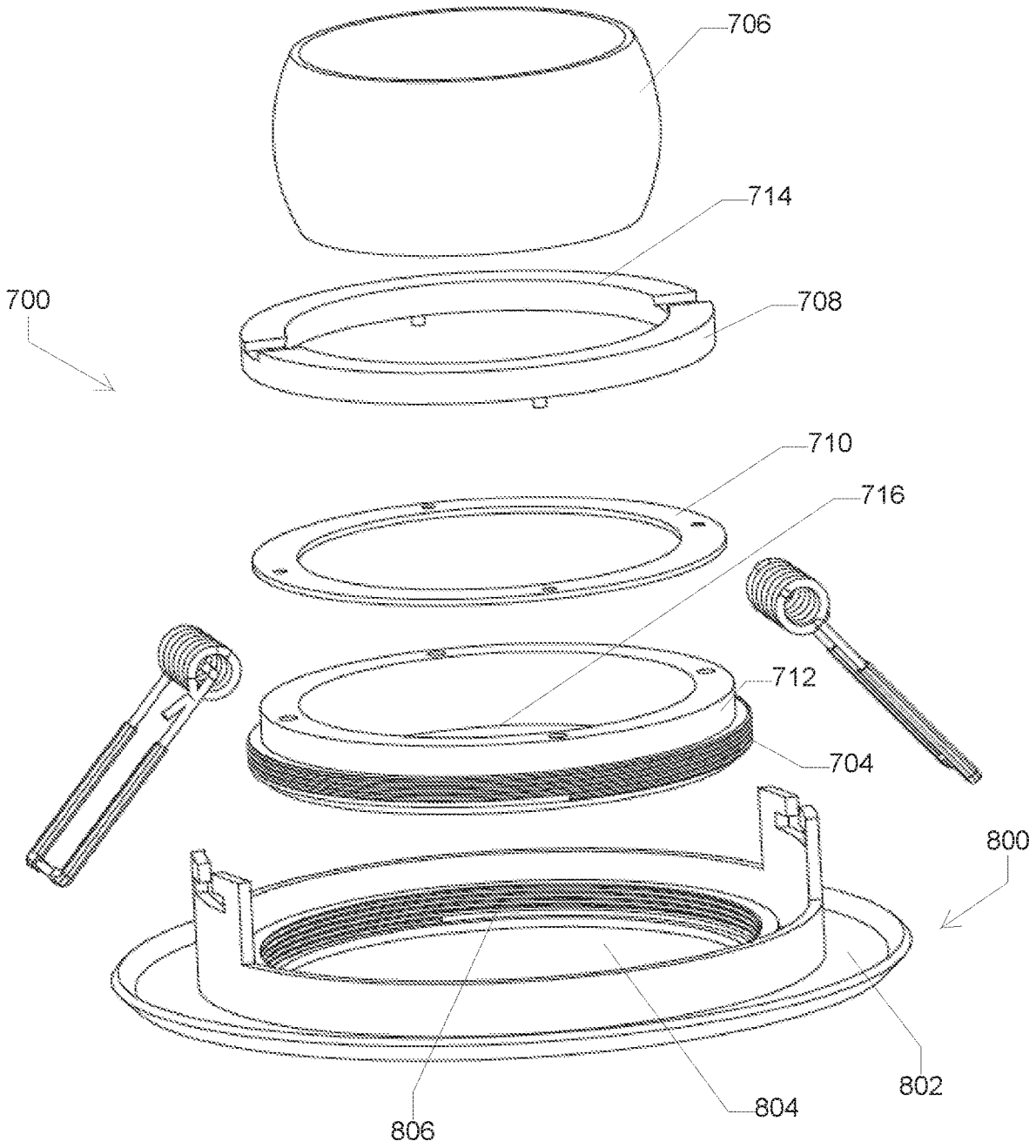
FIG. 29 shows an exploded view of the adaptor and trim of FIG. 28.

Turning now to FIG. 28, a top perspective view is shown of an example adaptor 700 connected to an example trim 800. Trim 800 can comprise a trim base 802 and clips 808. Adaptor 700, in turn, can comprise a first connector 702. FIG. 29 shows as exploded view of trim 800 and adaptor 700. Trim 800 comprises a trim opening 804 in trim base 802, and a trim connector 806 disposed proximate trim opening 804. In FIG. 29, trim connector 806 is shown as comprising a spiral threading. In other examples (not shown in FIG. 29), the trim connector can comprise a mechanism for reversibly securing the trim to adaptors and/or light sources, which mechanism can be different than a spiral threading.

In adaptor 700, first connector 702 (shown in FIG. 28) can be moveably coupled to a second connector 704, such that second connector 704 is able to reversibly tilt along three different axes relative to first connector 702. Such multi-axis tilting can be achieved using a gimbal mechanism. The gimbal can comprise a hollow spherical segment 706 received inside a receiving component formed from first ring 708, spacer ring 710, and second ring 712. These three rings together can define an inner space for receiving spherical segment 706.

The inner space can have a first open end 714 having a first diameter and a second open end 716 opposite first open end 714, second open end 716 having a second diameter. The inner space can further have an inner diameter measured at a point between first open end 714 and second open end 716. The first diameter and the second diameter can be smaller than the outer equatorial diameter of spherical segment 706, and the inner diameter can be larger than the outer equatorial diameter. In this arrangement hollow spherical segment 706 can be captured in the inner space while remaining moveable relative to the receiving component.

The gimbal structure of adaptor 700 can be assembled by placing spherical segment 706 into ring 712. Spherical segment 706 does not pass through ring 712 because the outer equatorial diameter of spherical segment 706 is larger than the diameter at second open end 716. Next, spacer ring 710 can be placed on ring 712 and around spherical segment 706. Subsequently, ring 708 can be placed on spacer ring 710 and also around spherical segment 706. Then, first ring 708, spacer ring 710, and second ring 712 can be secured to one another, using for example fasteners such as screws that extend through all three rings. As the diameter at open end 714 is smaller than the outer equatorial diameter of spherical segment 706, spherical segment 706 cannot pass through open end 714 either, and is as such captured in the inner space defined by rings 708, 710, and 712 and between first open end 714 and second open end 716. While captured, spherical segment 706 can tilt relative to the rings 708, 710, and 712 along three different axes. This type of movement can be analogous to a gimbal or a universal joint movement. Moreover, while FIG. 29 shows one example structure of achieving gimbal movement between the first connector (which is part of spherical segment 706) and second connector 704 (which is part of second ring 712), it is contemplated that in other examples different structures can be used, including but not limited to, ball and socket joints, universal joints, and the like.

In other examples of the gimbal structure, the inner component need not be a spherical segment, and can be substantially spherical or have a different curvature profile. Moreover, the receiving component need not be formed of three rings, and can have a structure different than that shown in FIG. 29. For example, the receiving component can comprise one piece and can be formed around the inner component to capture the inner component.

Hollow spherical segment 706 can define a light conduit for passage of the light generated by a light source such as light source 100 or 200. Moreover, first connector 702 (shown in FIG. 28) and second connector 704 can comprise spiral threading. First connector 702 can be configured to reversibly mate with the housing connector of a light source such as light source 100 or 200. Second connector 704 can be configured to reversibly mate with a trim connector such as trim connector 806 of trim 800.

Figure 30:
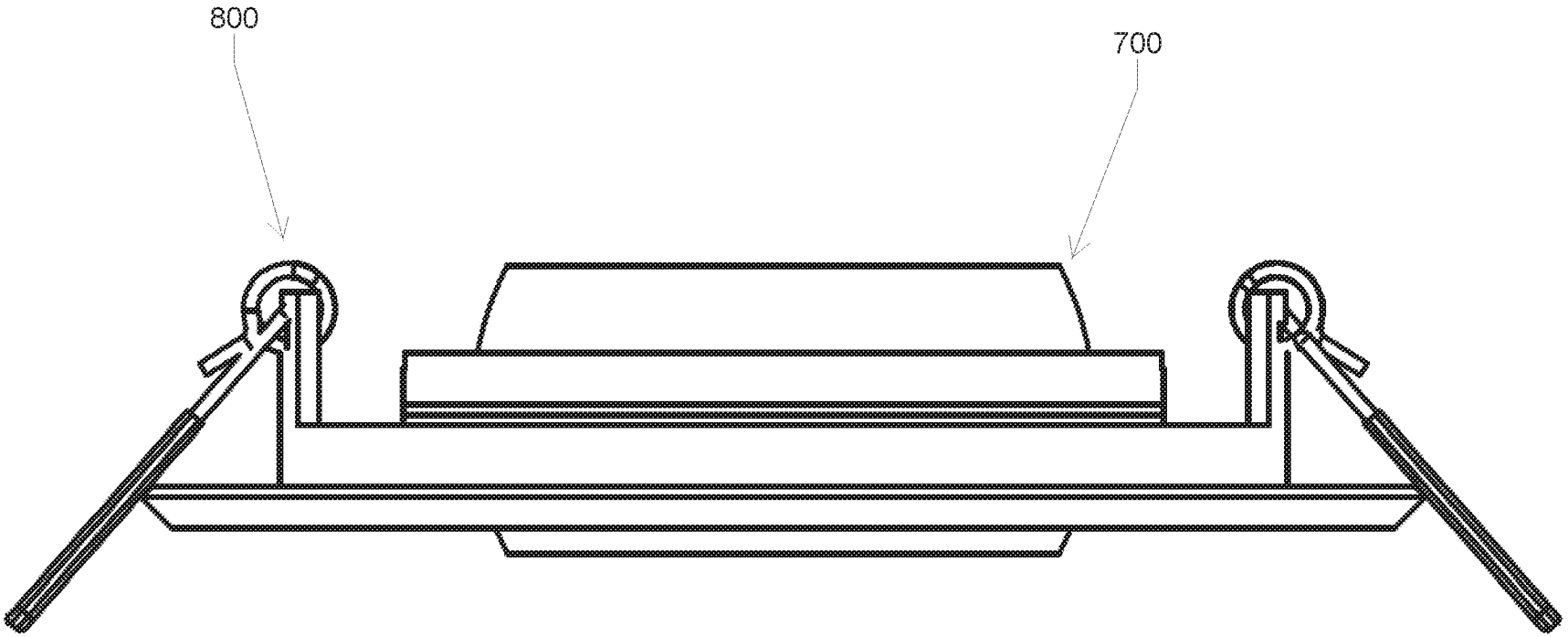
FIG. 30 shows a side elevation view of the adaptor and trim of FIG. 28.
Figure 31:
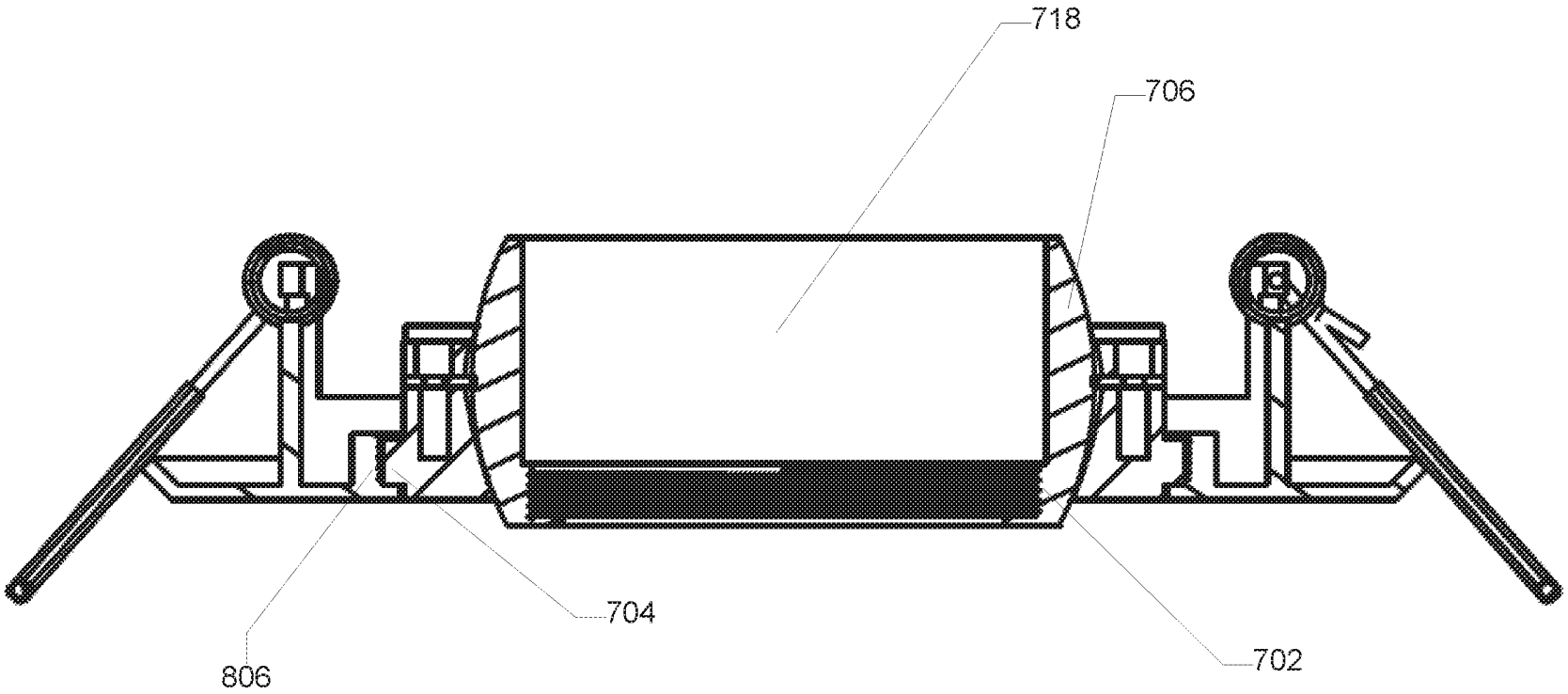
FIG. 31 shows a cross-sectional side elevation view of the adaptor and trim of FIG. 28.
Figure 32:
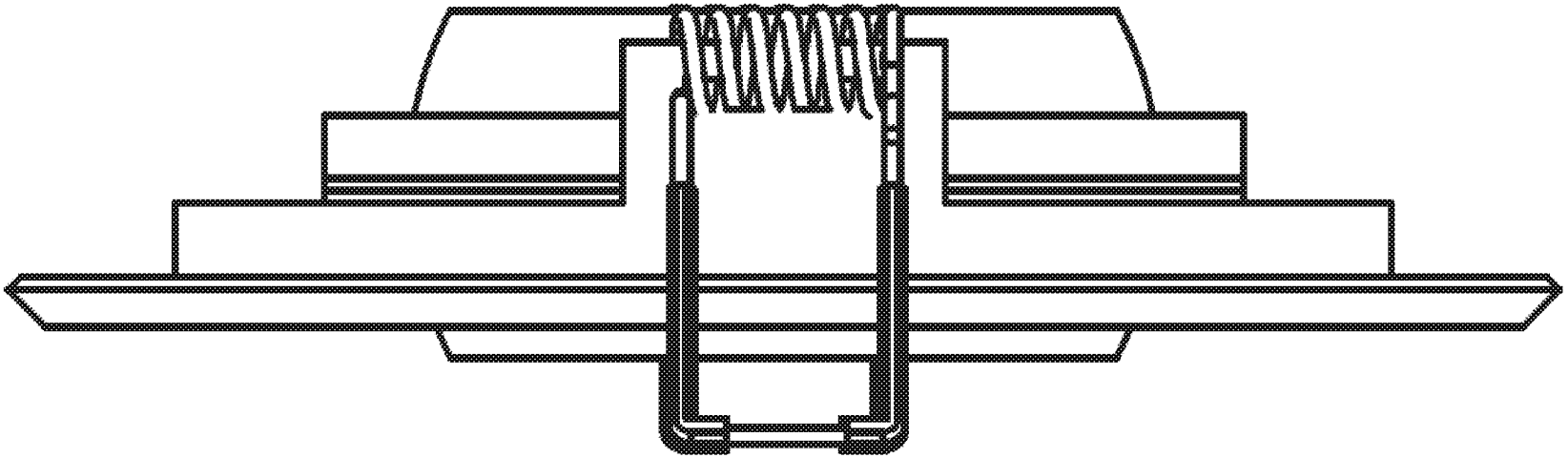
FIG. 32 shows another side elevation view of the adaptor and trim of FIG. 28.
Figure 33:
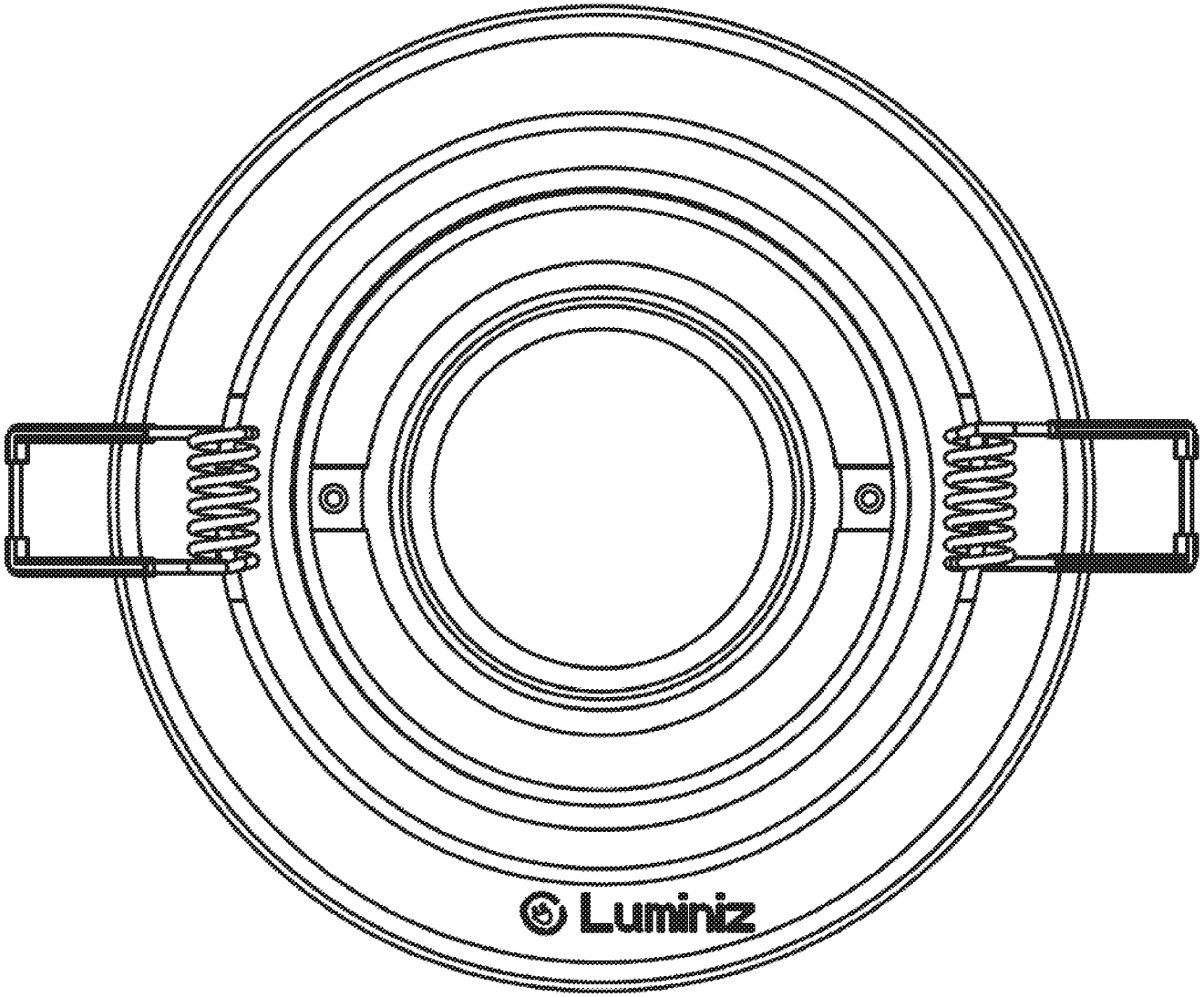
FIG. 33 shows a top plan view of the adaptor and trim of FIG. 28.

FIG. 30 shows a front side elevation view of the of adaptor 700 connected to trim 800. FIG. 31 shows a cross-sectional side elevation view of adaptor 700 connected to trim 800. FIG. 31 shows a light conduit 718 formed inside spherical segment 706. FIG. 31 also shows spiral threading of first connector 702, and also spiral threading of second connector 704 mated with the spiral threading of trim connector 806. FIG. 32 shows a right side elevation view of adaptor 700 connected to trim 800. FIG. 33 shows a top plan view of adaptor 700 connected to trim 800.

While FIGS. 28-33 are described as showing a gimbal adaptor and a trim, in some examples the gimbal structure or functionality can be incorporated into the trim whereby the trim connector can tilt about three different axes, or gimbal, relative to the trim base. In such examples, the first connector of the gimbal (see for example first connector 702 shown in FIG. 28) can act as the trim connector for such a gimbal trim. Moreover, in such an example, the trim connector can be moveable or tiltable about three different axes relative to the trim base.

Figure 34:
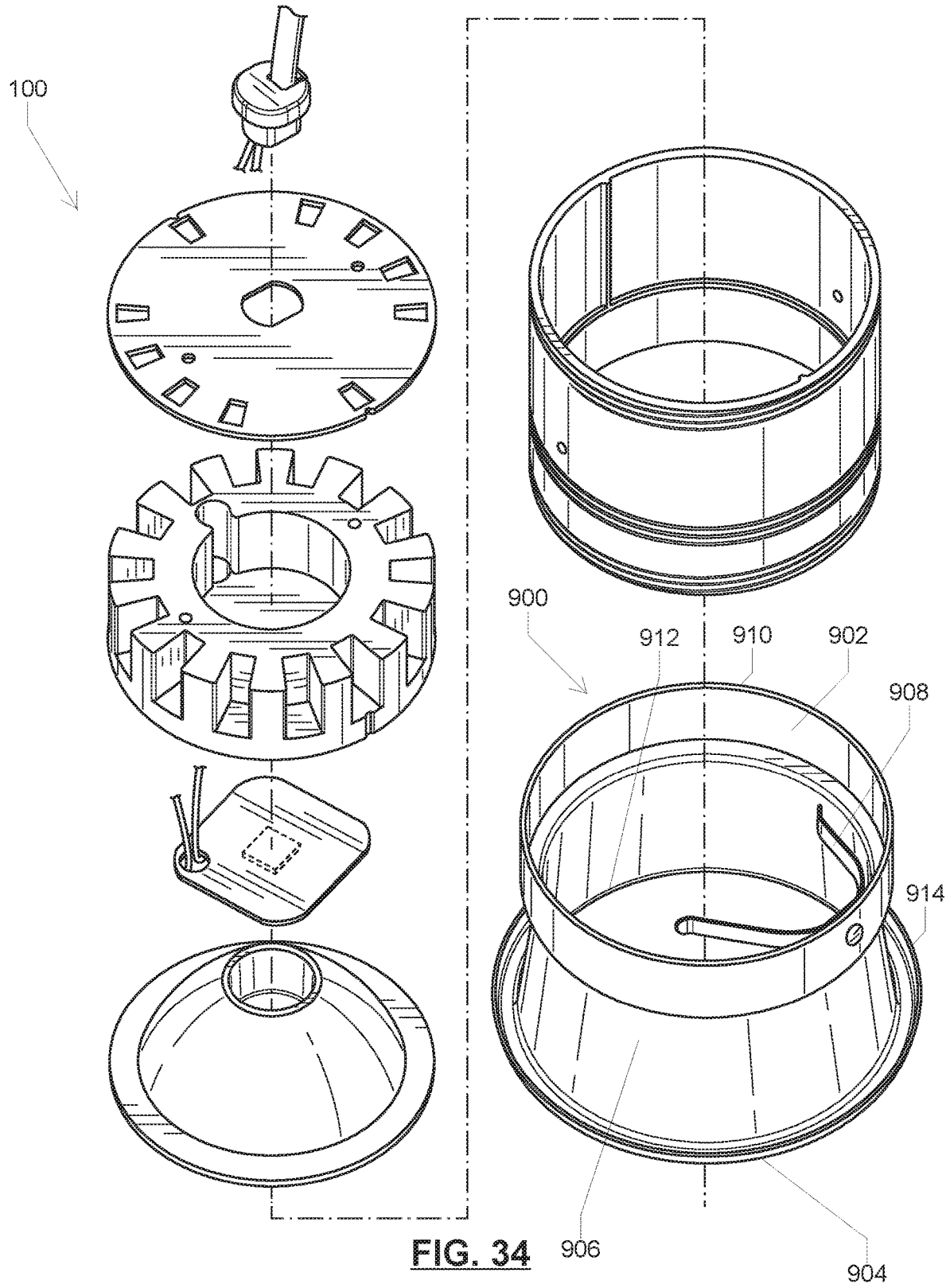
FIG. 34 shows an exploded view of the light source of FIG. 1 and another example adaptor.

FIG. 34 shows an exploded view of light source 100 and an example adaptor 900. Adaptor 900 comprises a first connector 902, a second connector 904, and a light conduit 906 extending from first connector 902 to second connector 904. Instead of spiral threading, adaptor 900 comprises a pair of resilient tines 908 secured to light conduit 906 and disposed inside light conduit 906 proximate a first open end 910 of adaptor 900.

To connect a light source such as light source 100 to adaptor 900 via first connector 902, the housing connector can be received into light conduit 906 through first open end 910. The housing of the light source can deform the two tines 908 away from one another and also away from a central axis of light conduit 906, against the resilient force of tines 908. This resilient force can, in turn, secure the light source to adaptor 900.

Adaptor 900 can also comprise a second open end 912 opposite first open end 910. Walls of light conduit 906 can be turned back or doubled back at second open end 912 to form a lip 914 proximate second open end 912. Lip 914 can form part of second connector 904.

Figure 35:
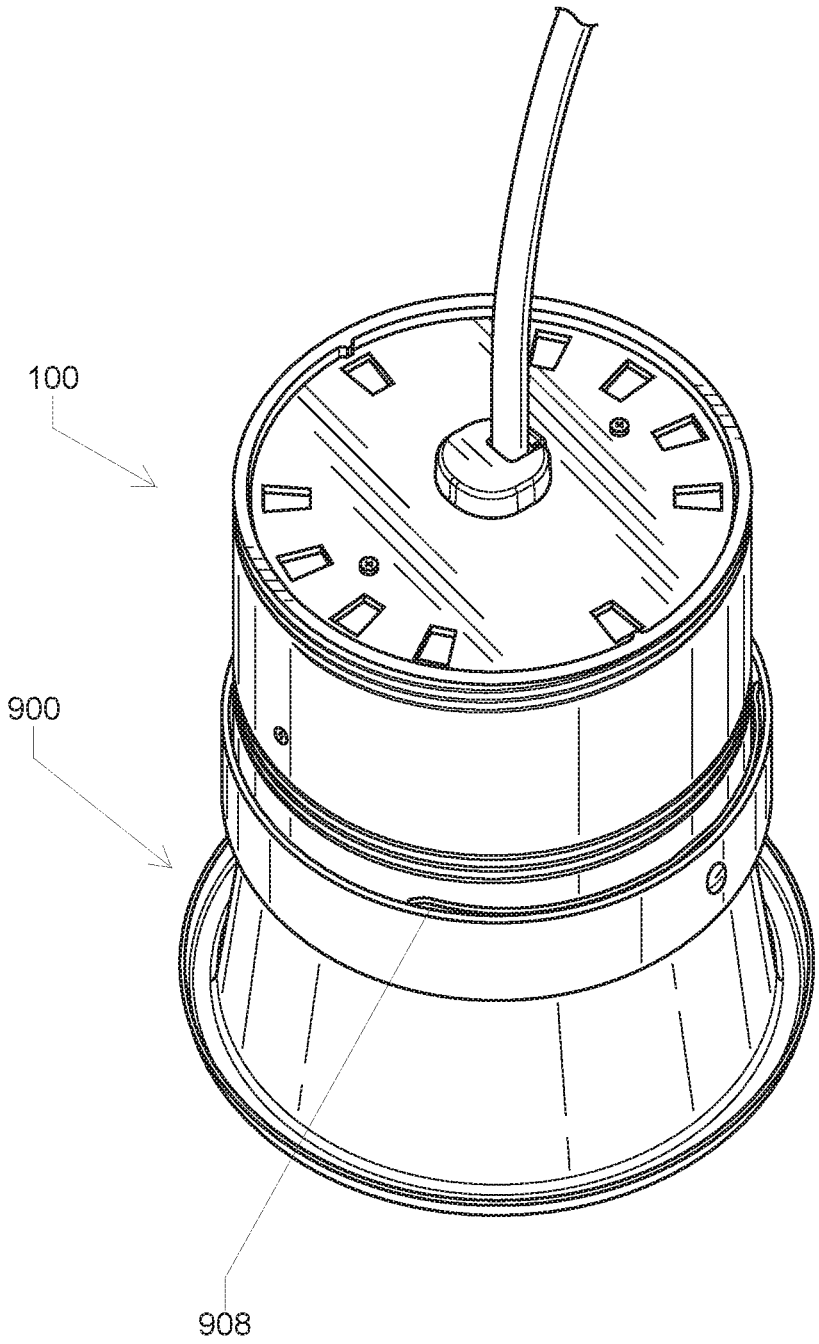
FIG. 35 shows the light source and adaptor of FIG. 34 connected together.
Figure 36:
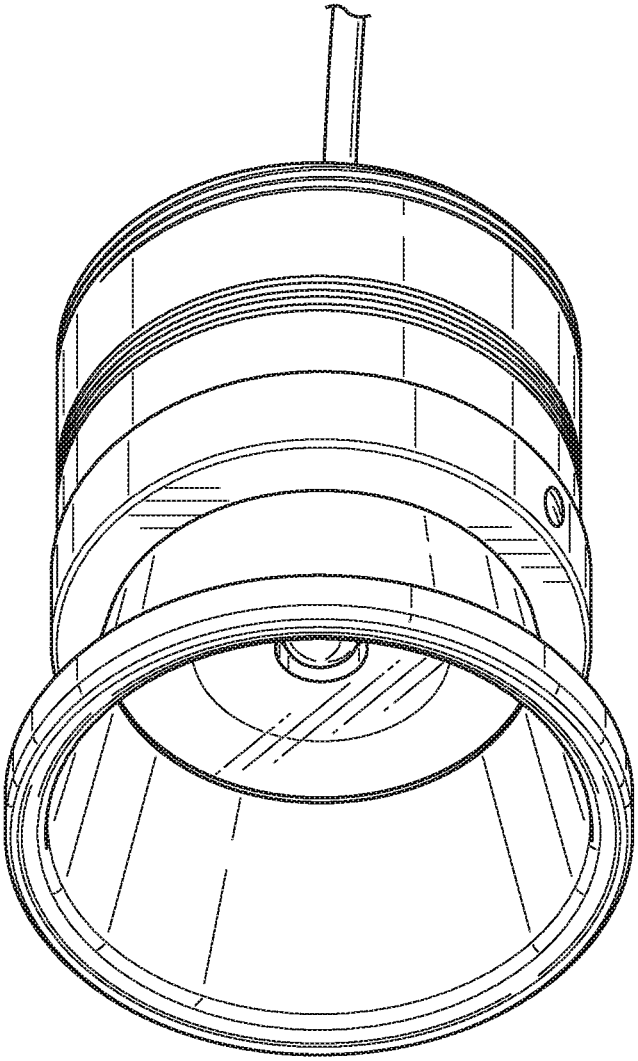
FIG. 36 shows another perspective view of the light source and adaptor of FIG. 35.
Figure 37:
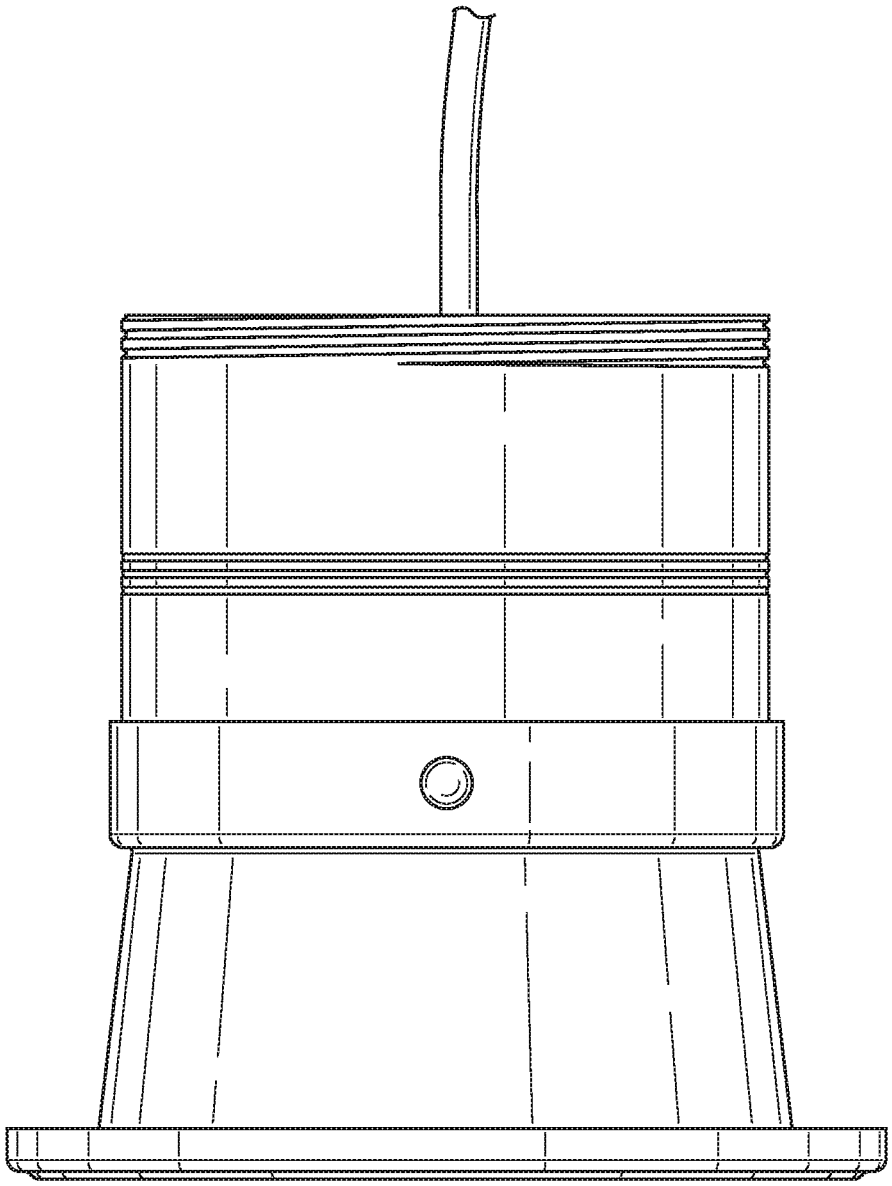
FIG. 37 shows a side elevation view of the light source and adaptor of FIG. 35.
Figure 38:
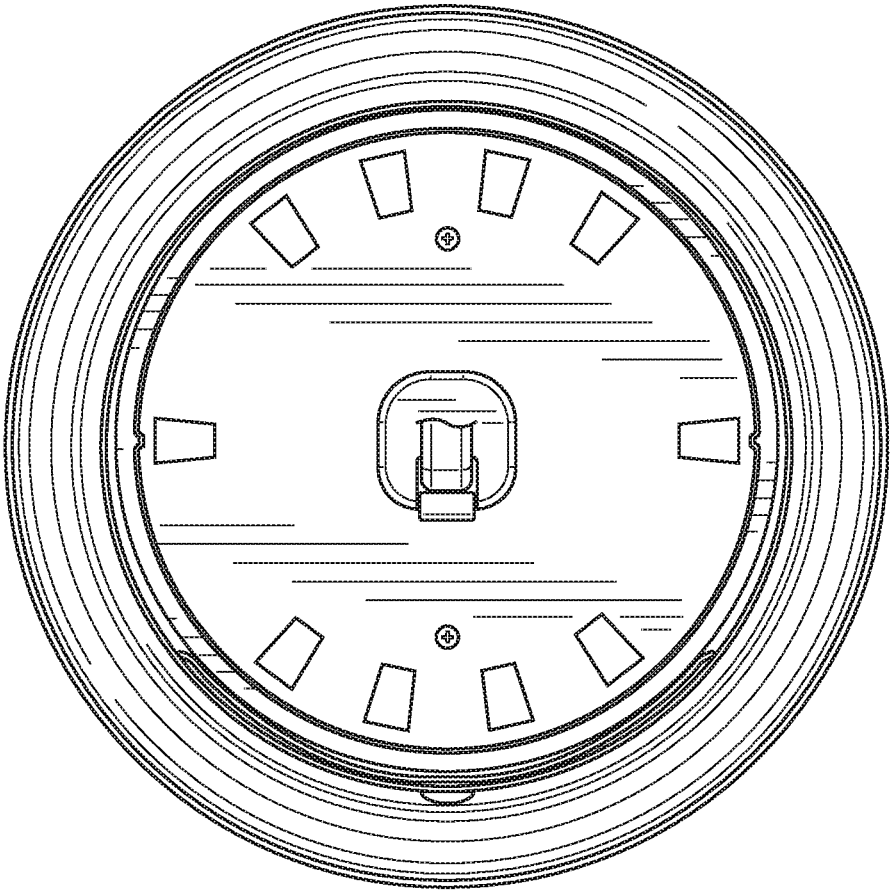
FIG. 38 shows a top plan view of the light source and adaptor of FIG. 35.
Figure 39:
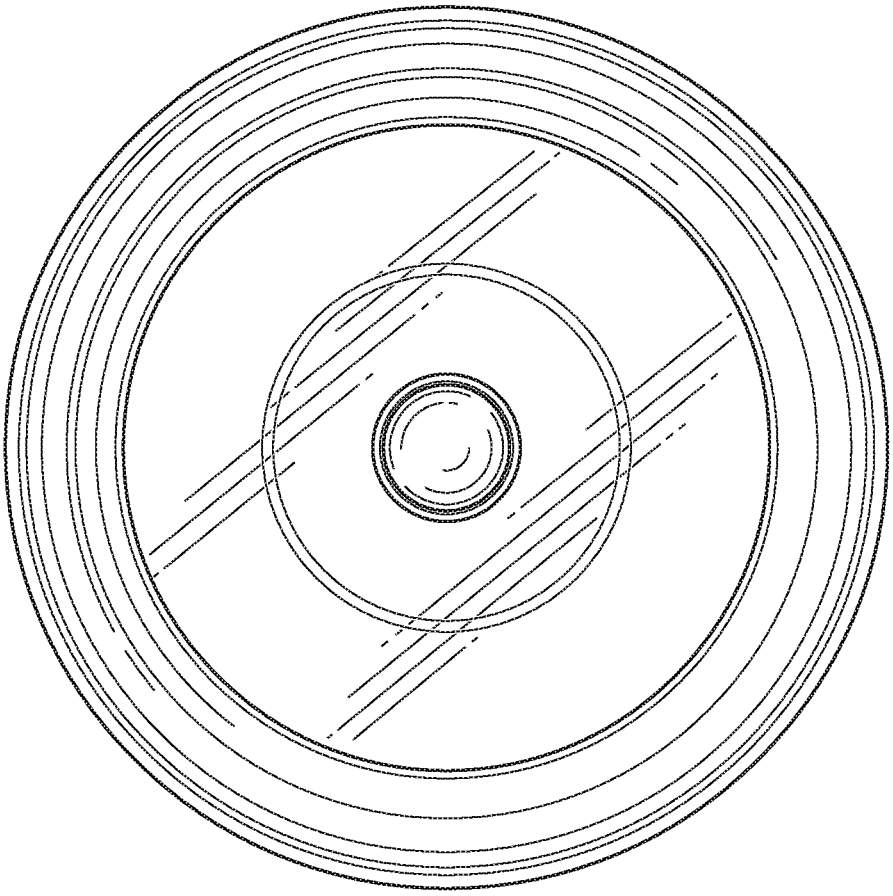
FIG. 39 shows a bottom plan view of the light source and adaptor of FIG. 35.

FIG. 35 shows light source 100 received in and connected to adaptor 900. Tines 908 can be seen as having been deformed away from one another by the housing of light source 100. FIG. 36 shows a bottom perspective view of light source 100 connected to adaptor 900. FIG. 37 shows a side elevation view of light source 100 connected to adaptor 900. FIG. 38 shows a top plan view of light source 100 connected to adaptor 900. Moreover, FIG. 39 shows a bottom plan view of light source 100 connected to adaptor 900.

Figure 40:
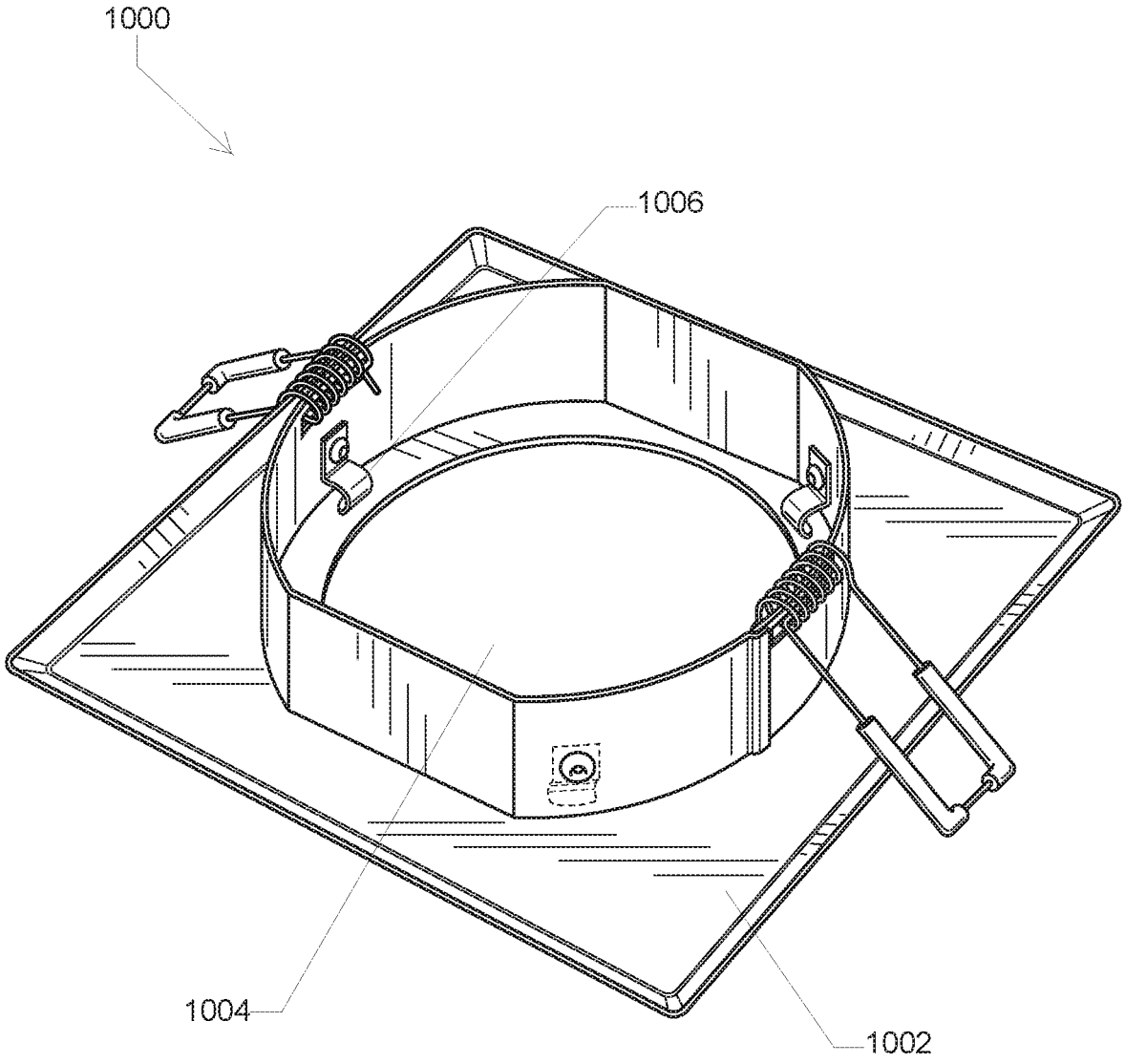
FIG. 40 shows a perspective view of another example trim.

FIG. 40 shows an example trim 1000, comprising trim base 1002, a trim opening 1004 in trim base 1002, and trim connector clips 1006 which can act as the trim connectors. These trim connector clips 1006 can be configured to be resiliently deformed by a received component which can comprise a light source or an adaptor such as adaptor 900, when the received component is coupled to trim 1000 such that a resilient force of trim connector clips 1006 pushes against the received component to secure the received component to trim 1000. For example, lip 914 of second connector 904 (shown in FIG. 34) can be received in trim 1000 and deform connector clips 1006.

Moreover, while FIG. 40 shows trim 1000 as having three connector clips evenly spaced around trim opening 1004, it is contemplated that in other examples the trim may have a different number of connector clips that may be positioned differently. Moreover, in other examples the design of the clips can be different that those of connector clips 1006.

Figure 41:
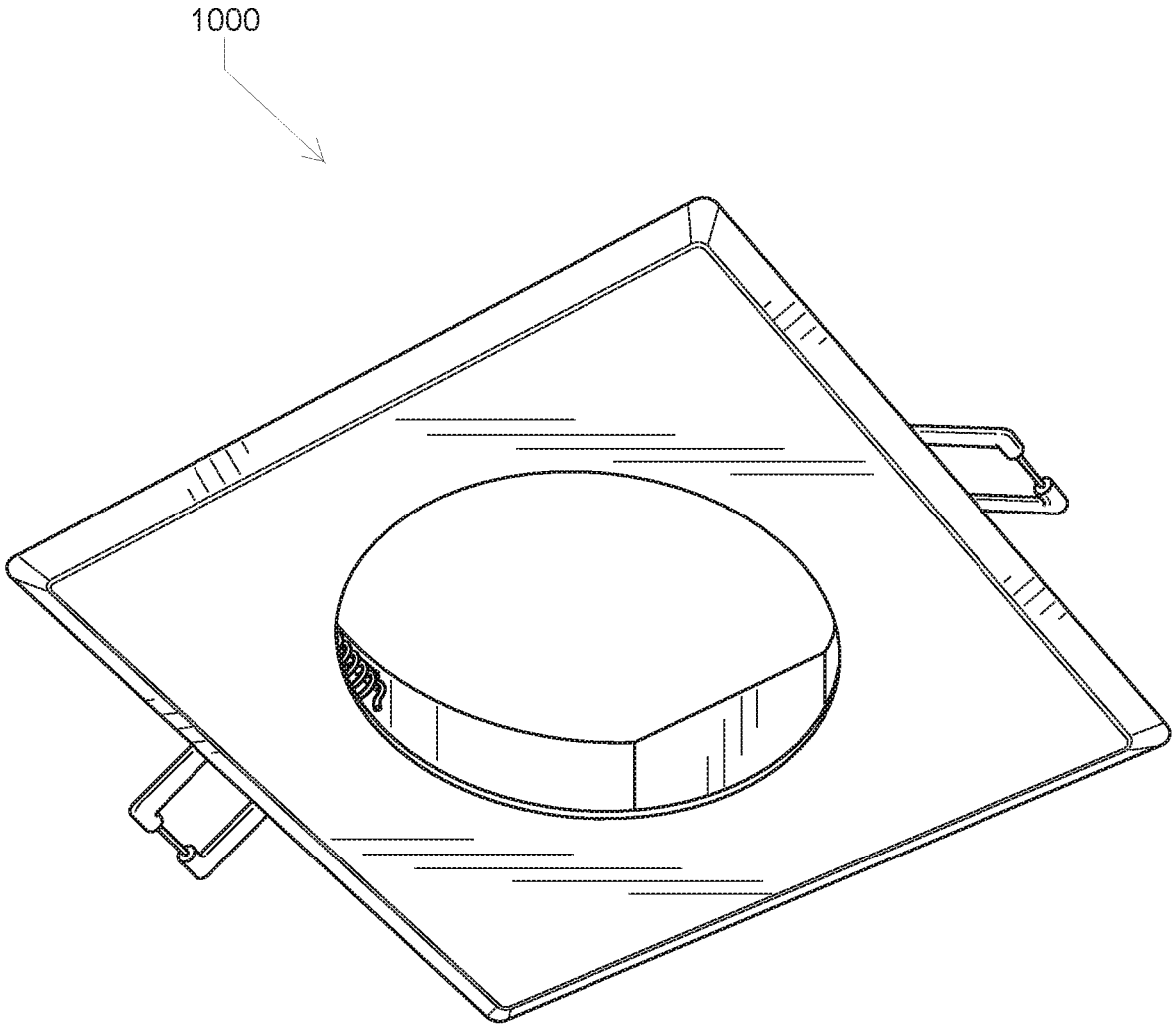
FIG. 41 shows another perspective view of the trim of FIG. 40.
Figure 42:
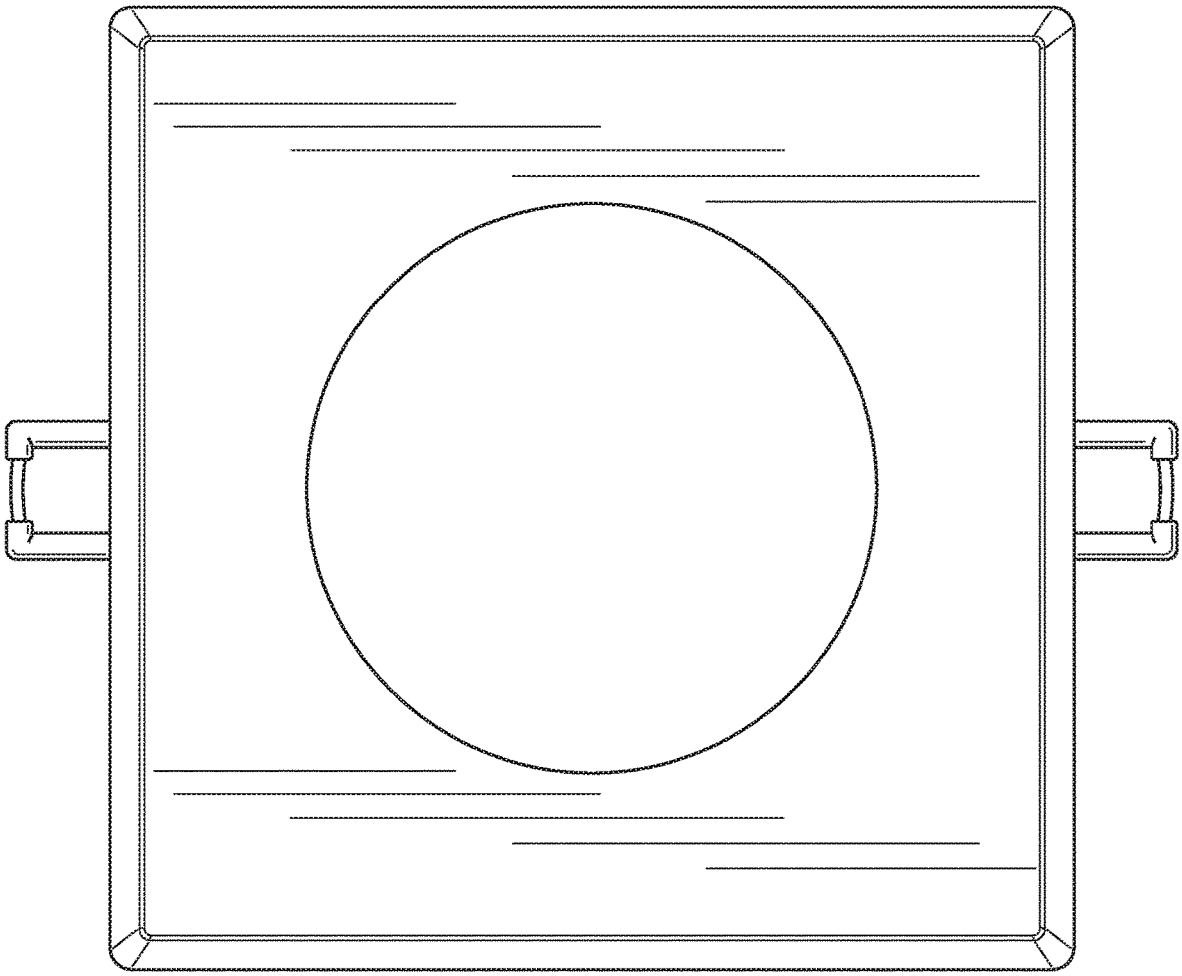
FIG. 42 shows a bottom plan view of the trim of FIG. 40.
Figure 43:
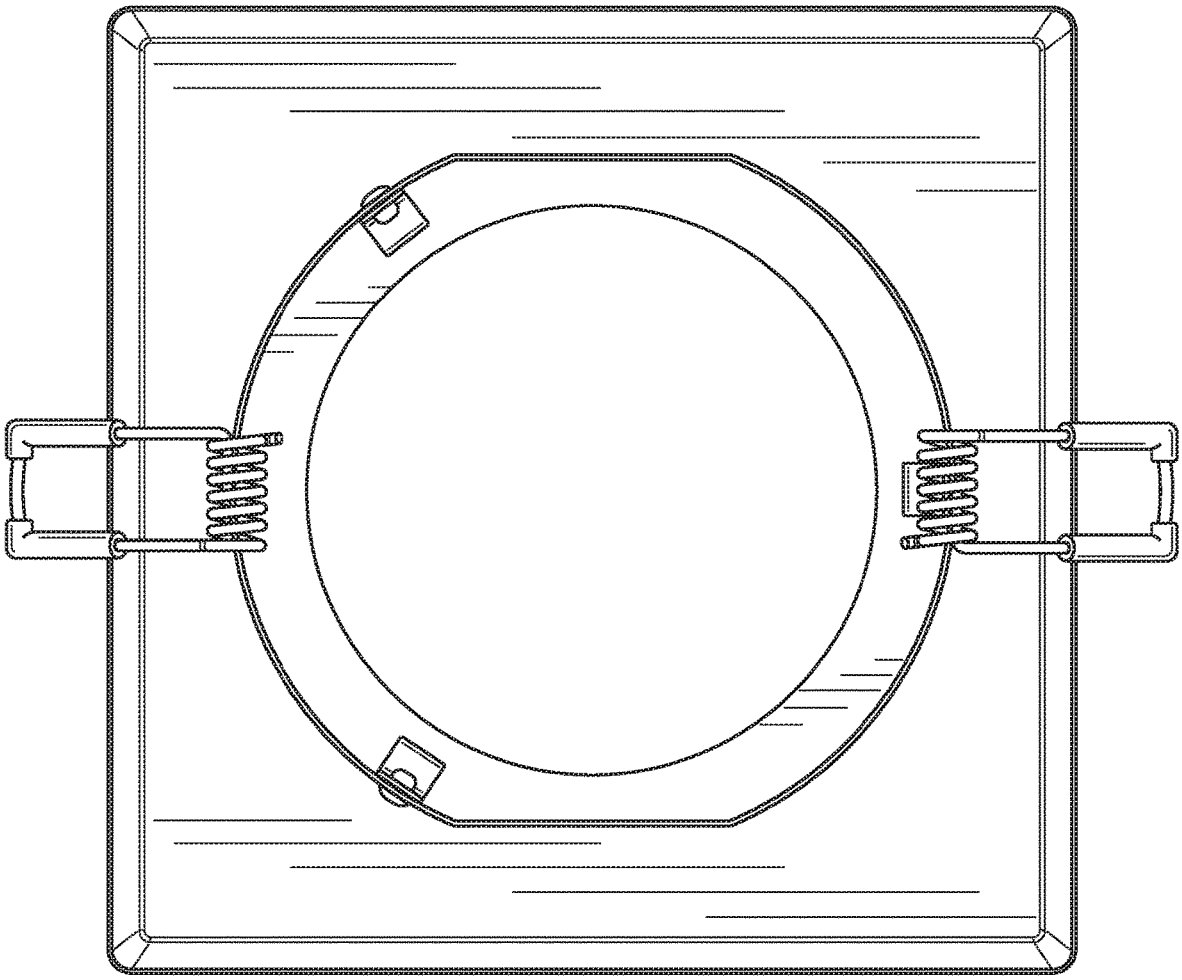
FIG. 43 shows a top plan view of the trim of FIG. 40.
Figure 44:
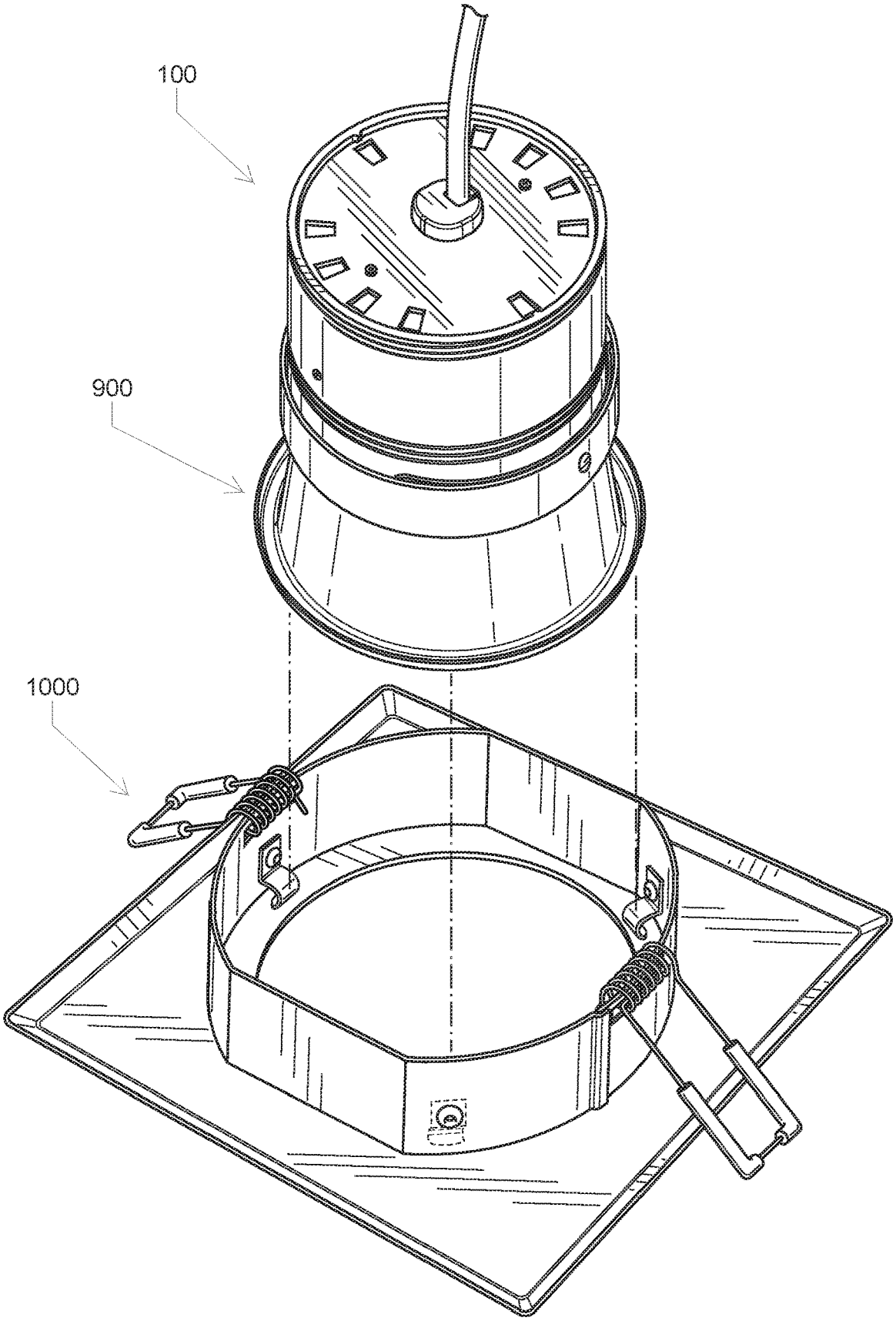
FIG. 44 shows a perspective view of the light source of FIG. 1, the adaptor of FIG. 34, and the trim of FIG. 40.
Figure 45:
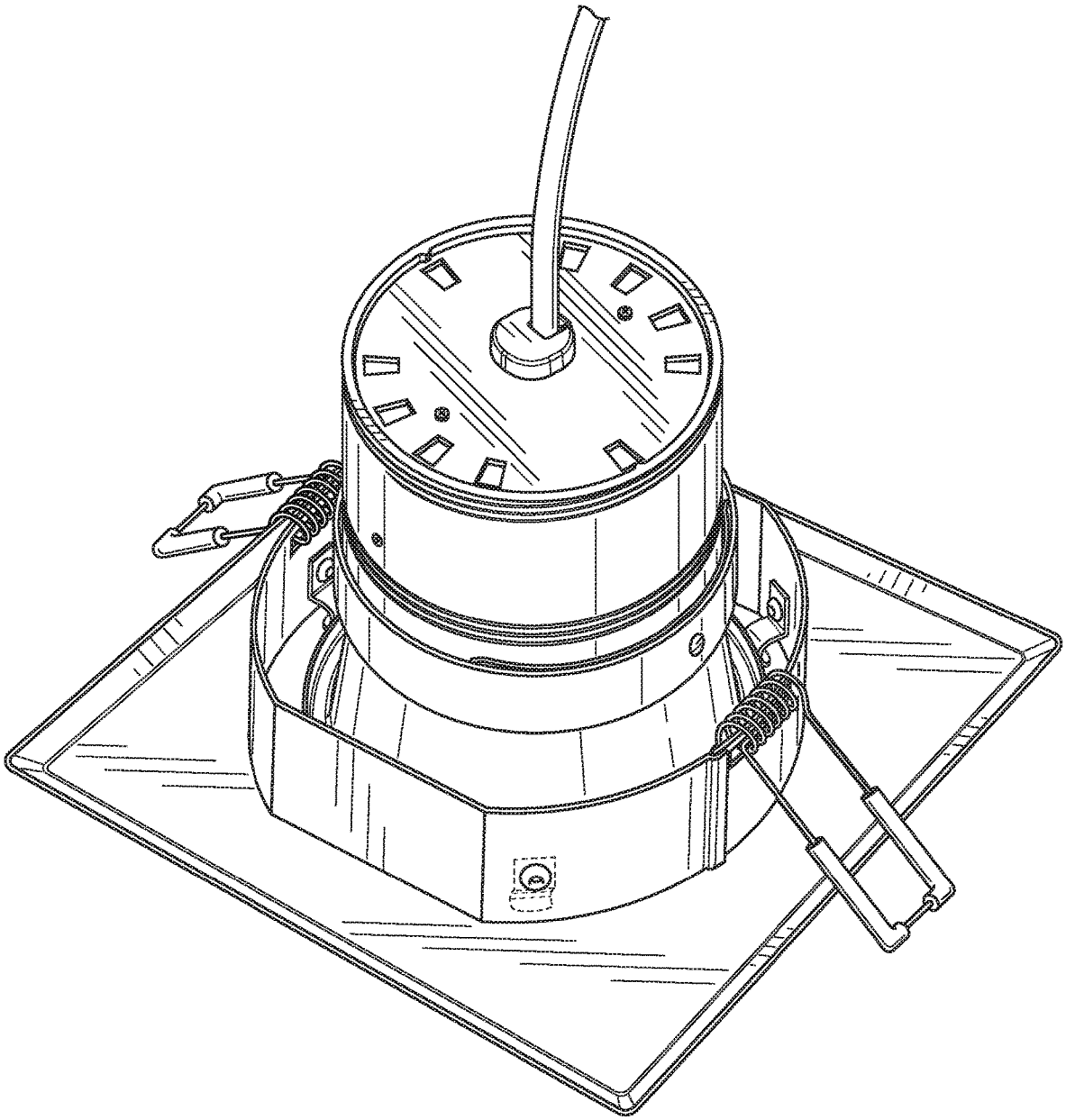
FIG. 45 shows a perspective view of the light source of FIG. 1, the adaptor of FIG. 34, and the trim of FIG. 40 connected together.
Figure 46:
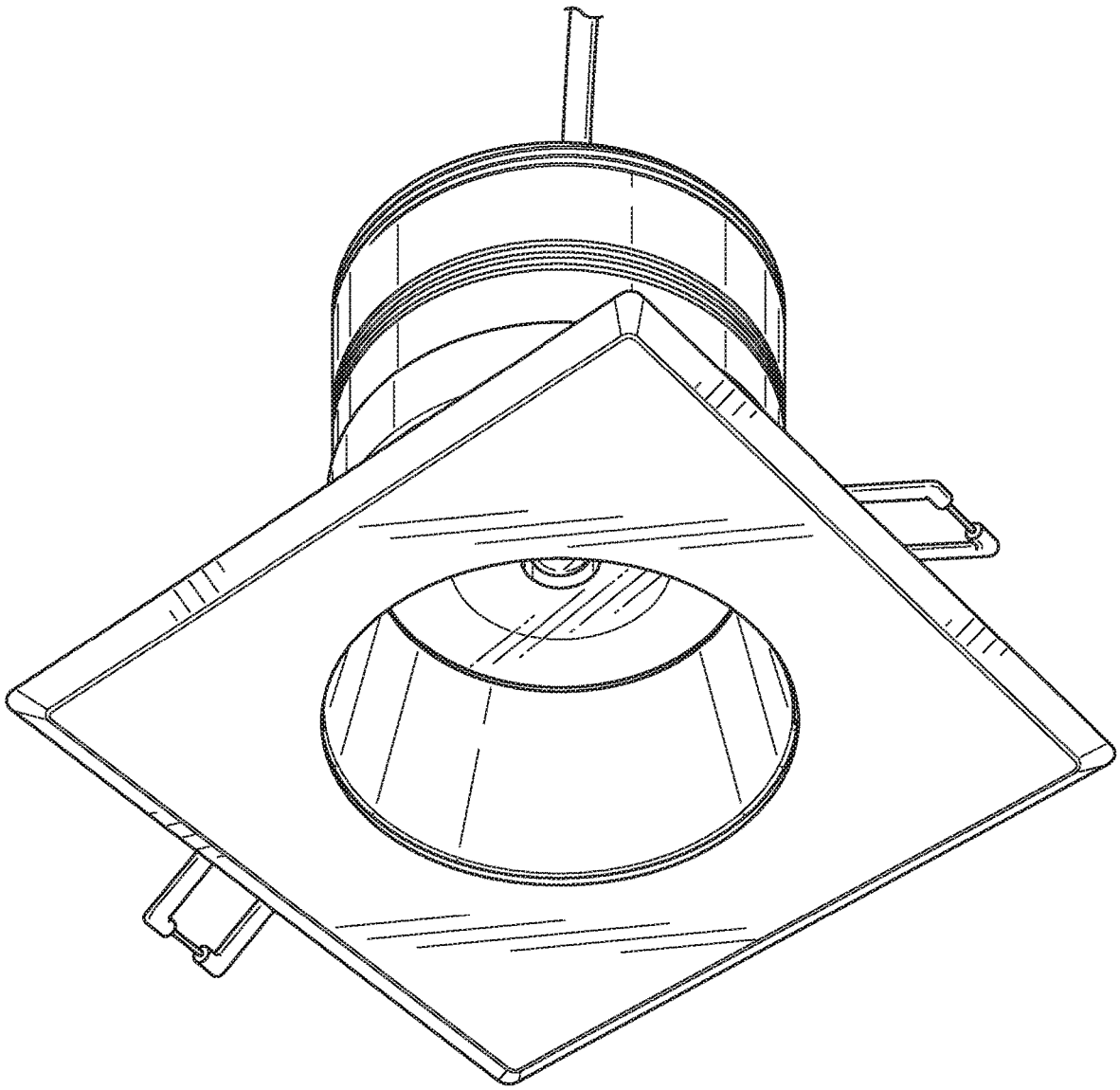
FIG. 46 shows another perspective view of the light source of FIG. 1, the adaptor of FIG. 34, and the trim of FIG. 40 connected together.
Figure 47:
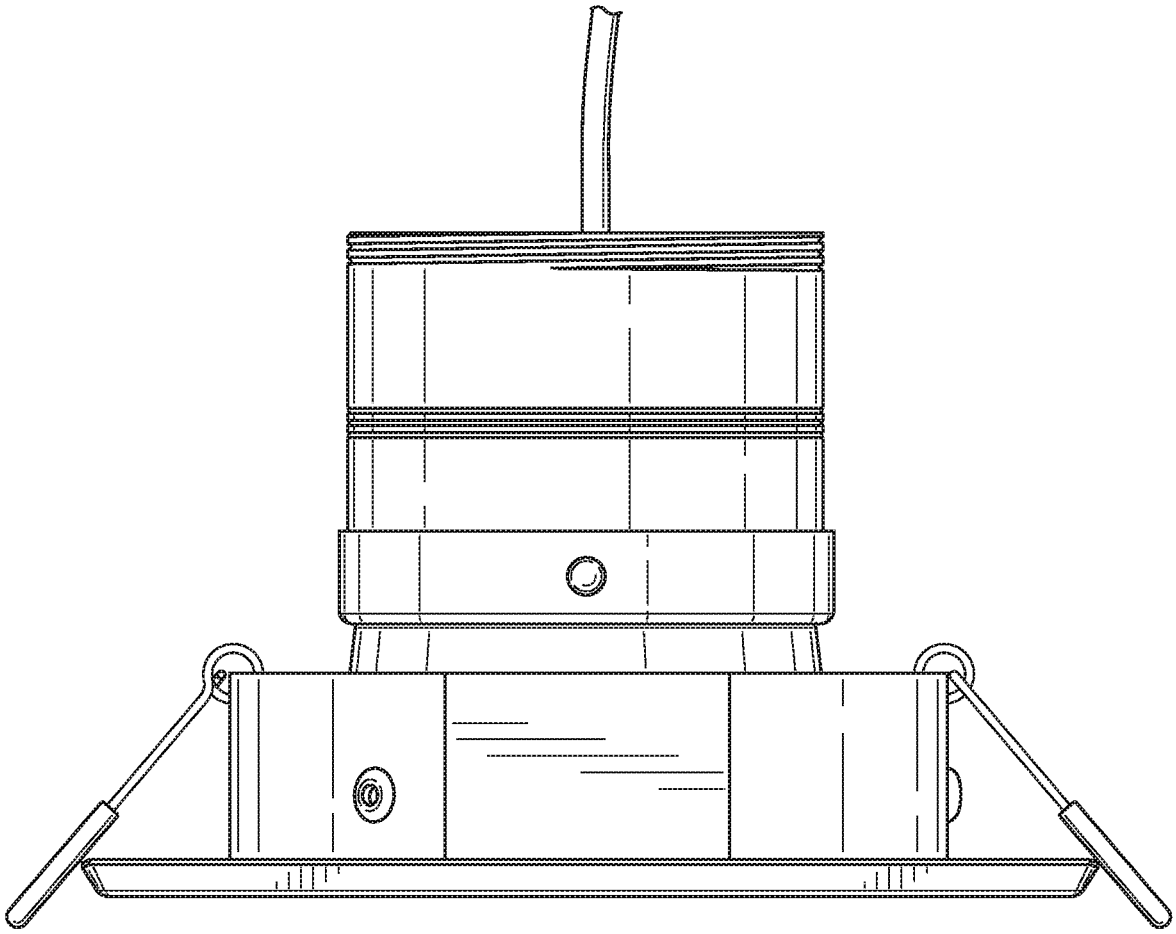
FIG. 47 shows a side elevation view of the light source of FIG. 1, the adaptor of FIG. 34, and the trim of FIG. 40 connected together.
Figure 48:
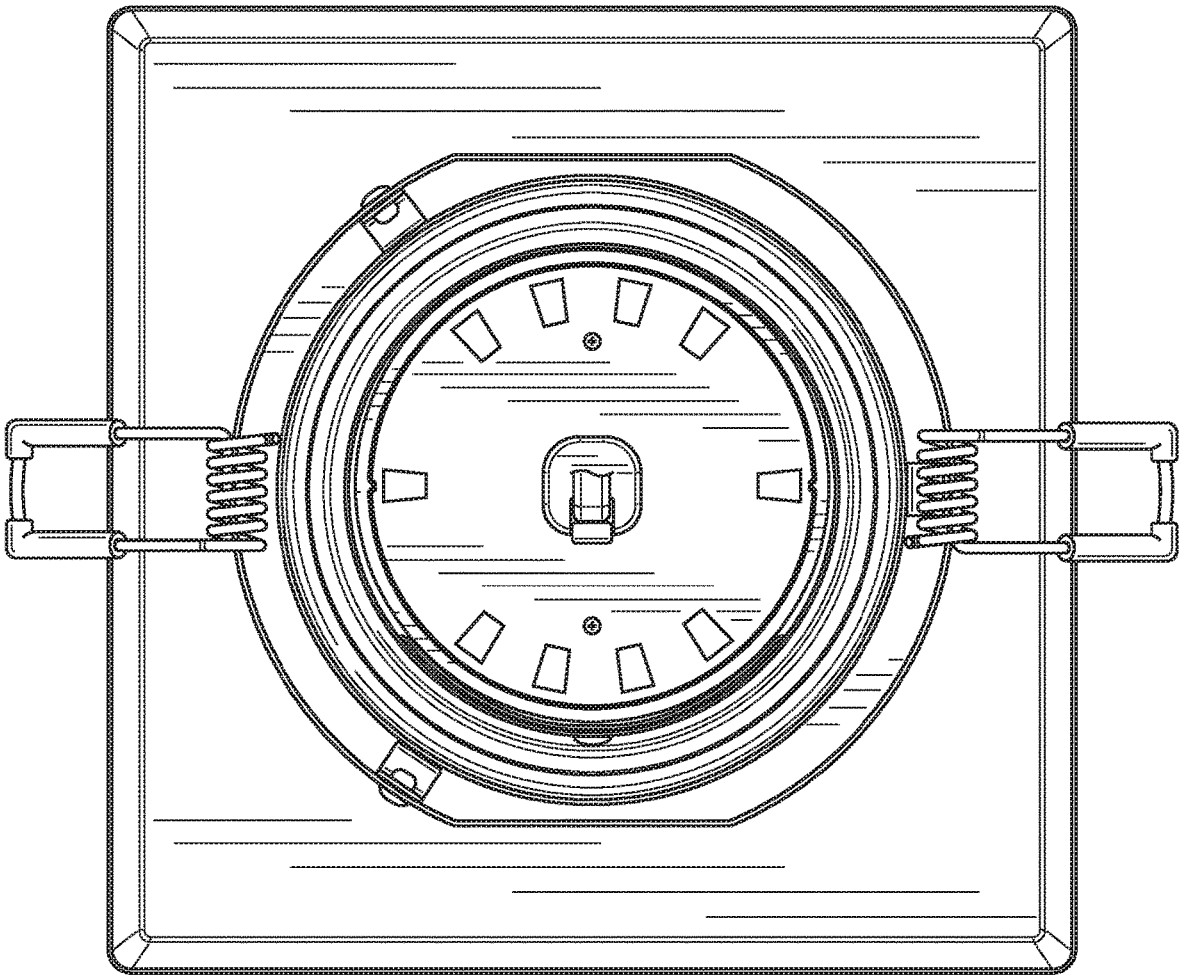
FIG. 48 shows a top plan view of the light source of FIG. 1, the adaptor of FIG. 34, and the trim of FIG. 40 connected together.
Figure 49:
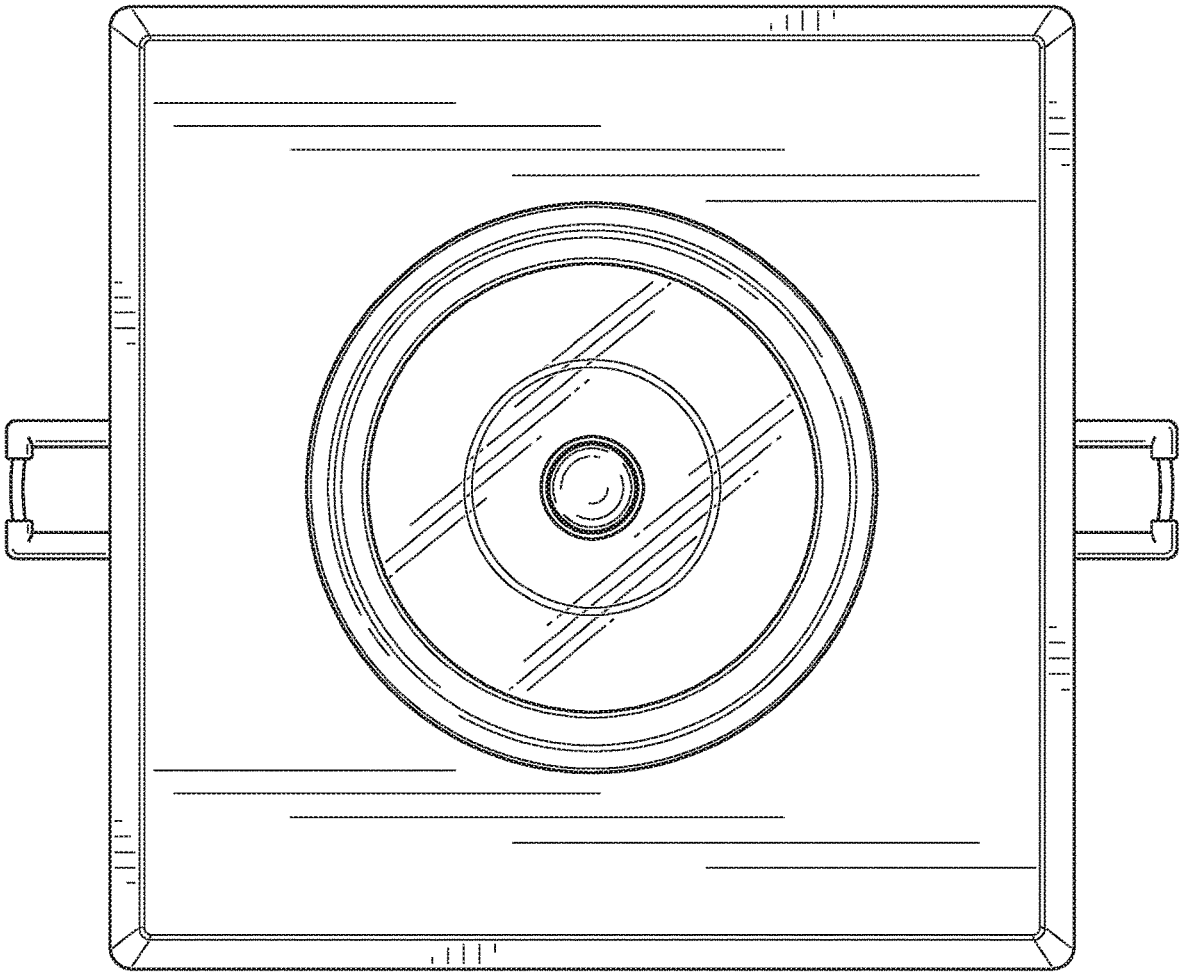
FIG. 49 shows a bottom plan view of the light source of FIG. 1, the adaptor of FIG. 34, and the trim of FIG. 40 connected together.

FIG. 41 shows a bottom perspective view of trim 1000. FIG. 42 shows a bottom plan view of trim 1000. FIG. 43 shows a top plan view of trim 1000. FIG. 44, in turn, shows light source 100 connected to adaptor 900, and adaptor 900 being inserted into trim 1000. FIG. 45 shows light source 100 connected to adaptor 900, and adaptor 900 inserted into and connected to trim 1000. FIG. 46 shows a bottom perspective view of light source 100, adaptor 900, and trim 1000 connected together. FIG. 47 shows a side elevation view of light source 100, adaptor 900, and trim 1000 connected together. FIG. 48 shows a top plan view of light source 100, adaptor 900, and trim 1000 connected together. FIG. 49 shows a bottom plan view of light source 100, adaptor 900, and trim 1000 connected together.

Figure 50:
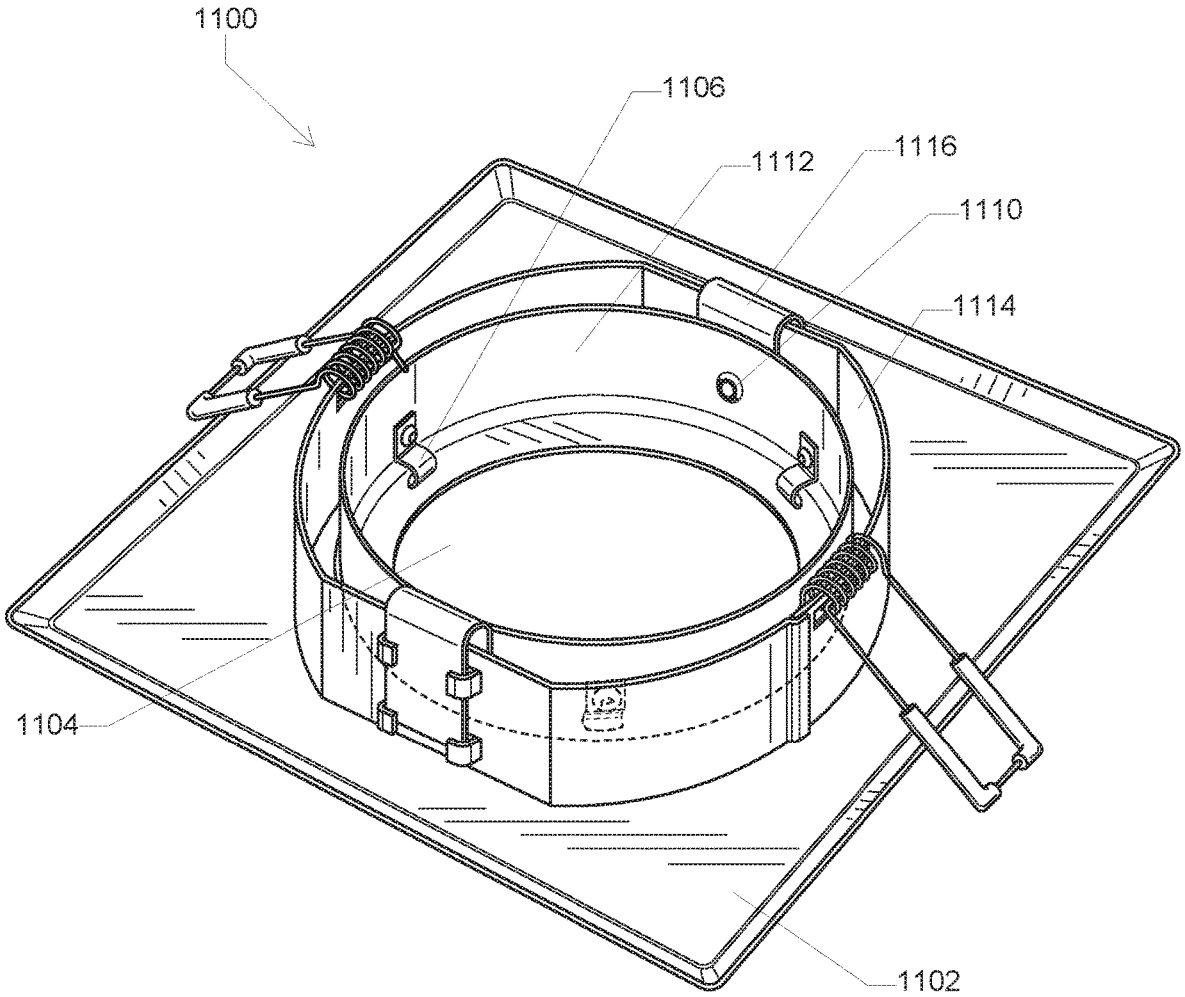
FIG. 50 shows a perspective view of another example trim.

FIG. 50 shows an example trim 1100, comprising a trim base 1102, a trim opening 1104 in trim base 1102, and trim connector clips 1106. Clips 1106 are, in turn, secured to a support portion 1112. Support portion 1112 itself is pivotably connected via connecting members 1116 to a portion 1114 of trim base 1102. Support portion 1112 can pivot about two diametrically opposite pivot points 1110 (only one is visible in FIG. 50) relative to portion 1114 of trim base 1102. As such, trim connector clips 1106 can form a part of the trim connector that can be movably and/or pivotably coupled to trim base 1102.

In some examples, not shown, support portion 1112 can be reversibly connectable to portion 1114 or other portion of trim base 1102. Such a detachable support portion, that can reversibly connect to both a light source/adaptor and a trim, can also be described itself as another example adaptor. The first connector of such an adaptor can comprise clips 1106, and the second connector can comprise components such as connecting members 1116 that can reversibly connect to portion 1114 or other portions of trim base 1102. Moreover, in such an adaptor the first connector can be described as being pivotably connected to the second connector, with the second connector being able to reversibly tilt along an axis relative to the first connector.

Figure 51:
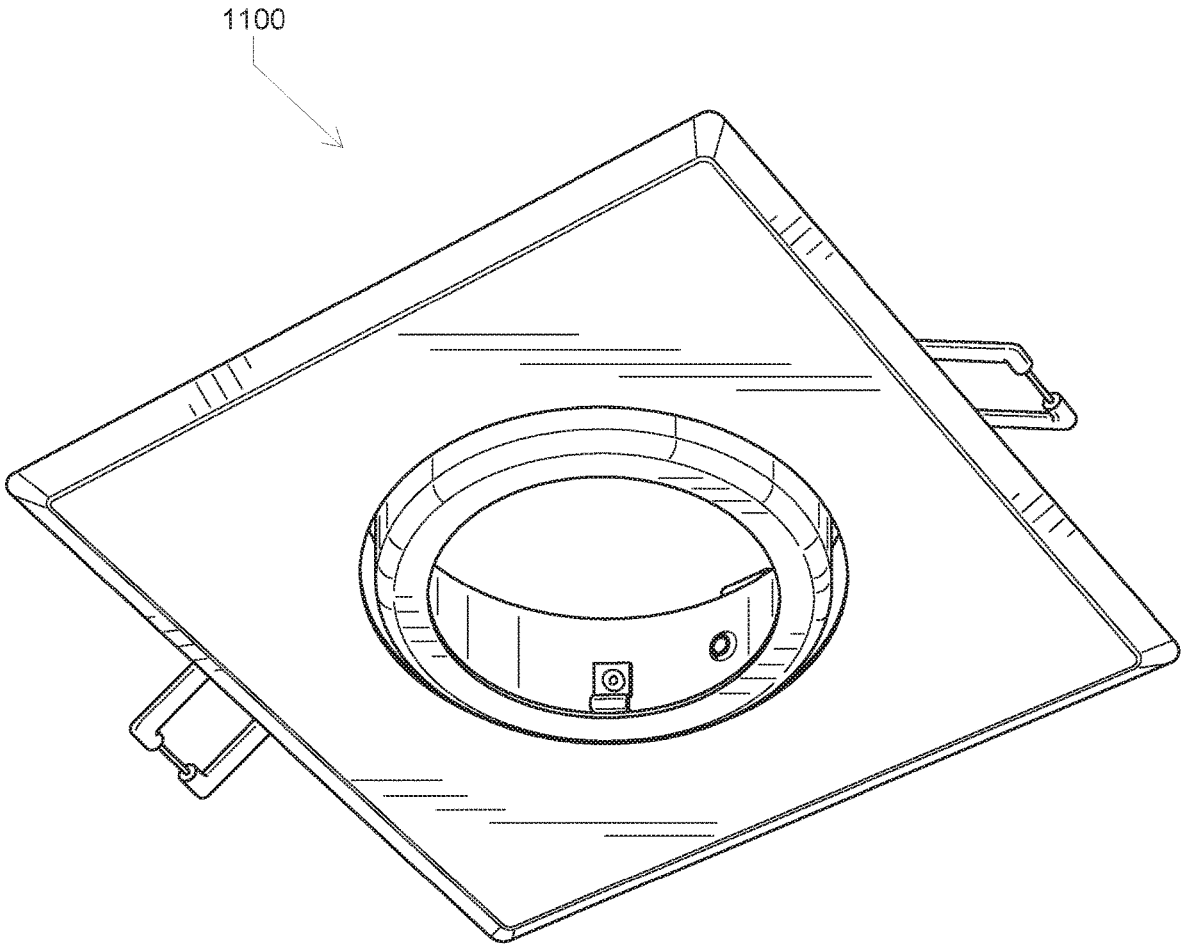
FIG. 51 shows another perspective view of the trim of FIG. 50.
Figure 52:
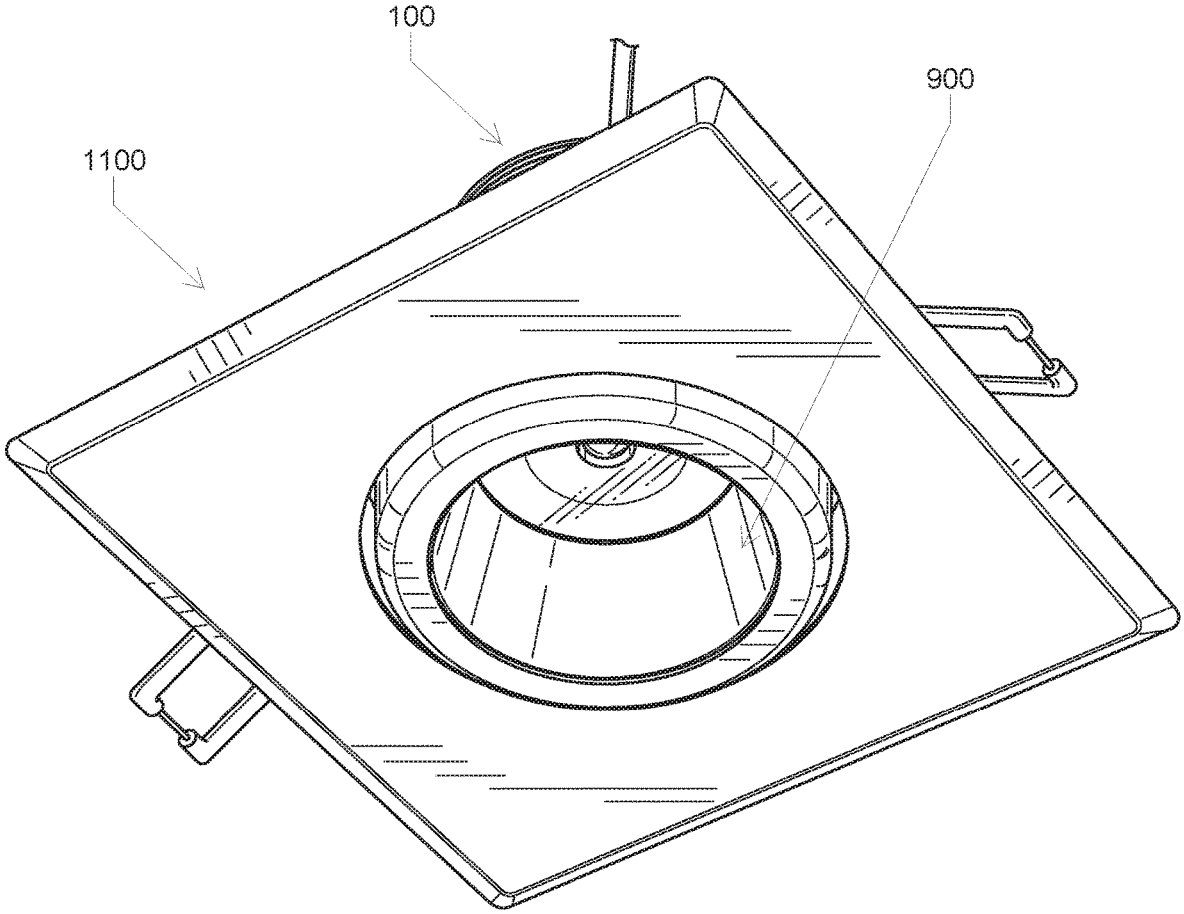
FIG. 52 shows a perspective view of the light source of FIG. 1, the adaptor of FIG. 34, and the trim of FIG. 50 connected together in an untilted position.
Figure 53:
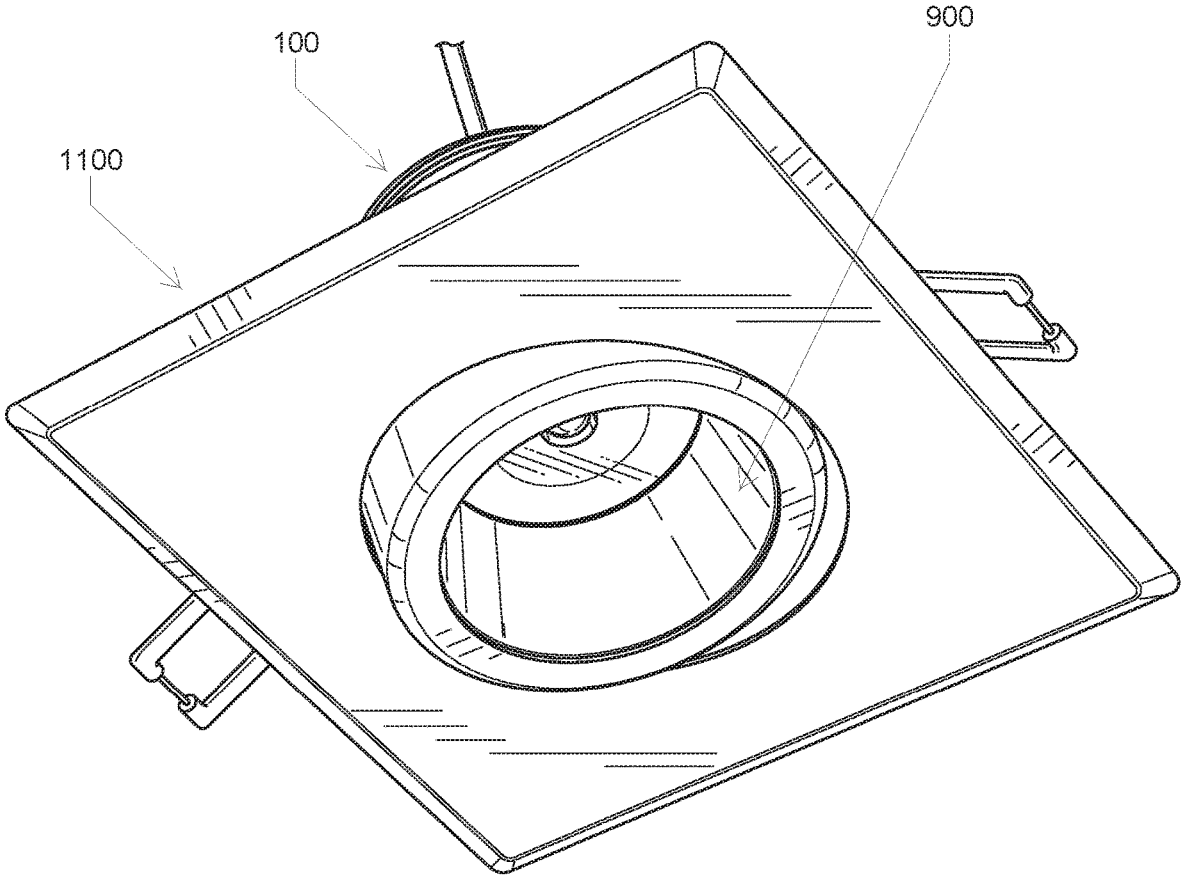
FIG. 53 shows a perspective view of the light source of FIG. 1, the adaptor of FIG. 34, and the trim of FIG. 50 connected together in a tilted position.

FIG. 51 shows a bottom perspective view of trim 1100. FIG. 52 shows trim 1100 connected to adaptor 900, which is in turn connected to light source 100. In FIG. 52 trim 1100 is shown in the untilted position. FIG. 53, in turn, shows trim 1100 in a tilted position, connected to adaptor 900 which is in turn connected to light source 100. As such, FIGS. 52 and 53 depict a light fixture, capable of being modularly assembled from light sources, adaptors, and trims, which light fixture can reversibly tilt about one axis.

Figure 54:
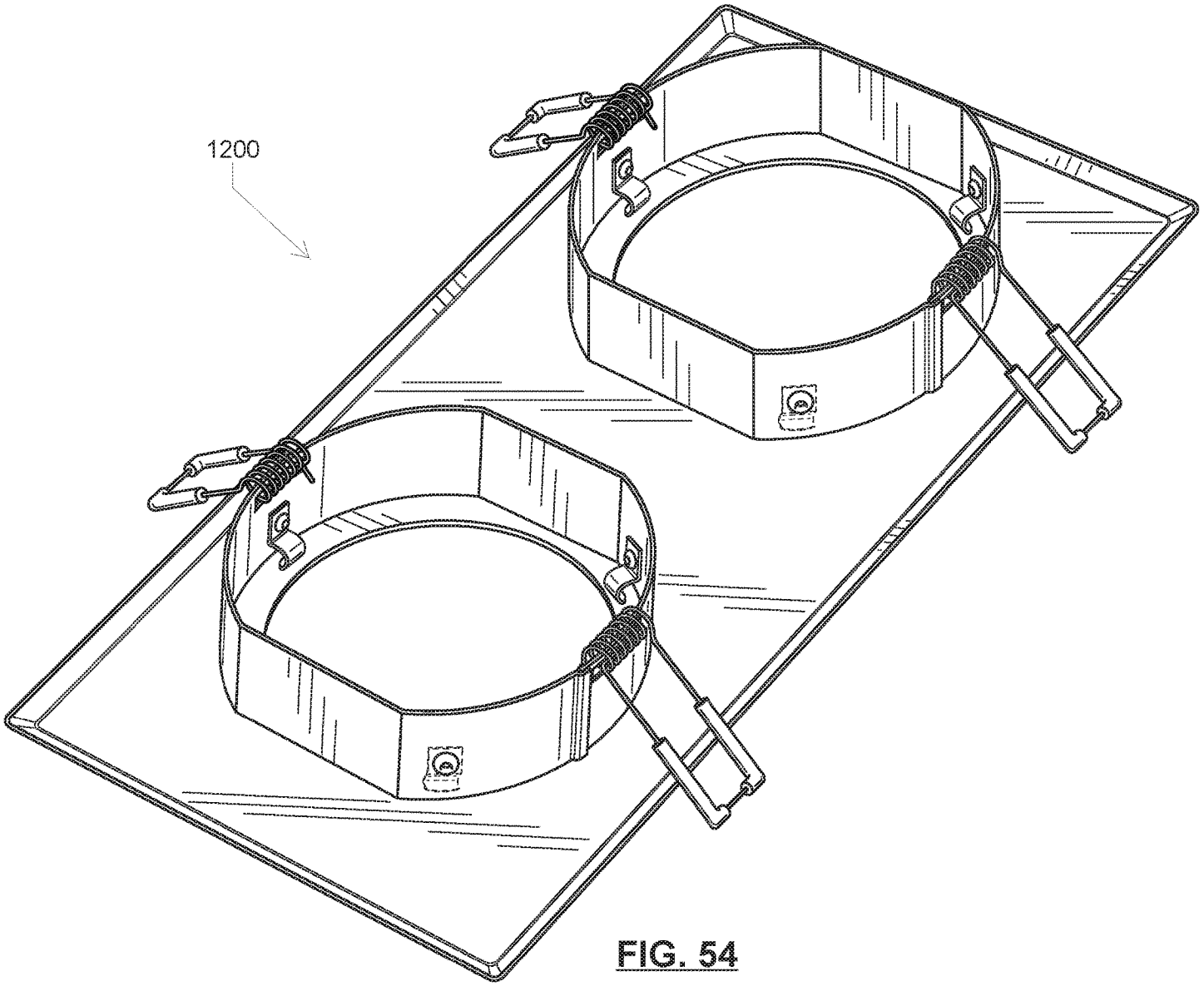
FIG. 54 shows a perspective view of another example trim.
Figure 55:
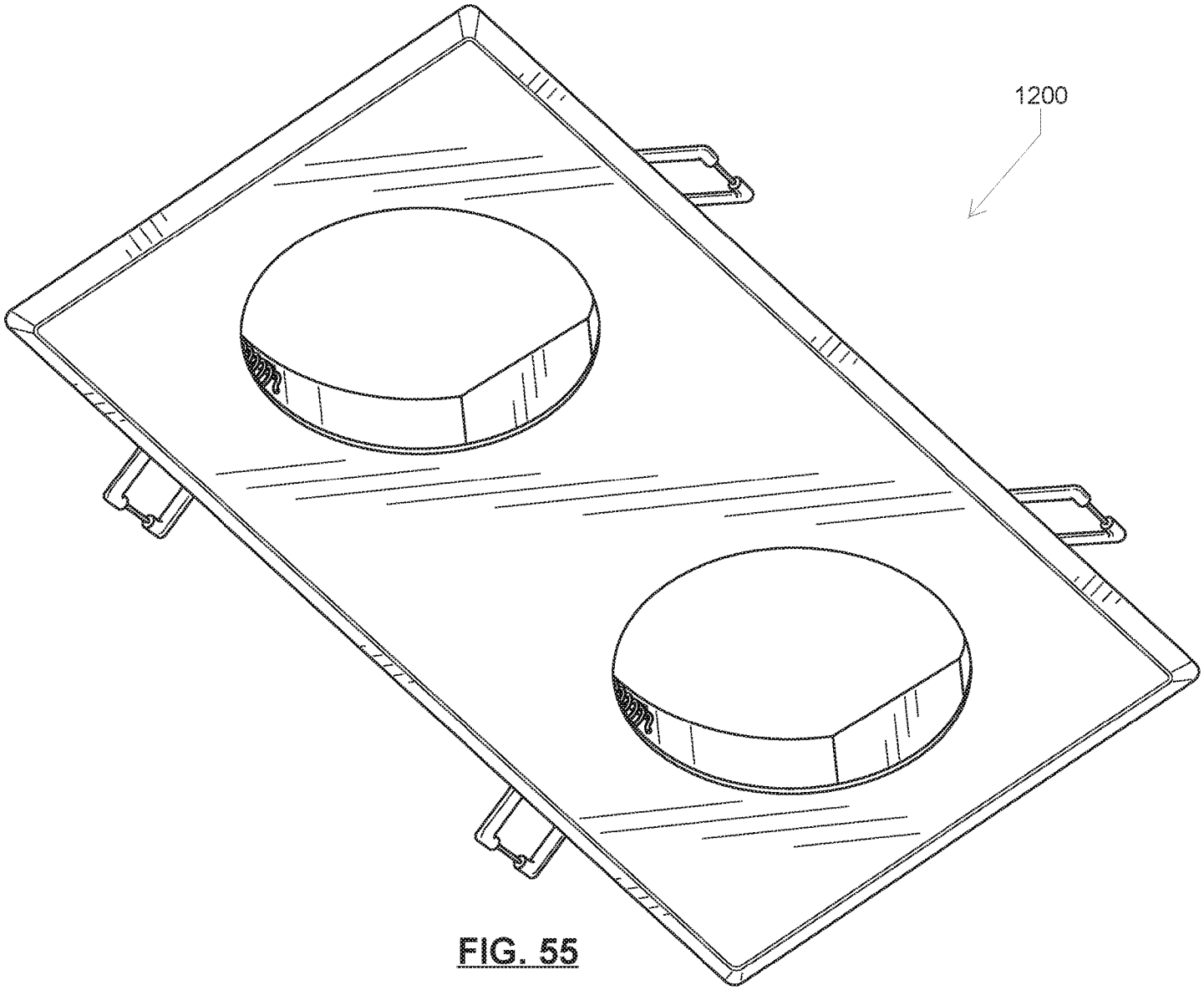
FIG. 55 shows another perspective view of the trim of FIG. 54.
Figure 56:
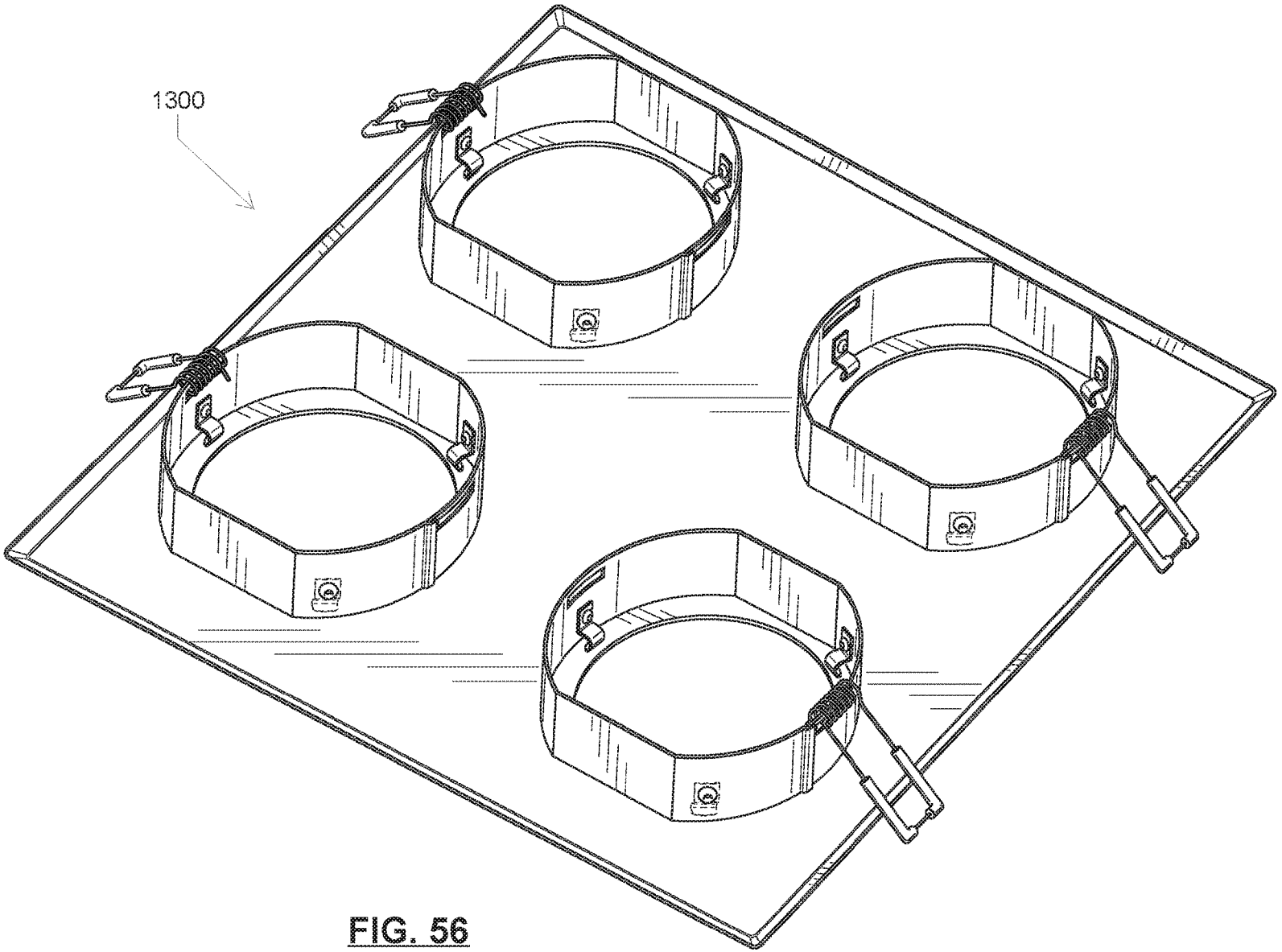
FIG. 56 shows a perspective view of another example trim.
Figure 57:
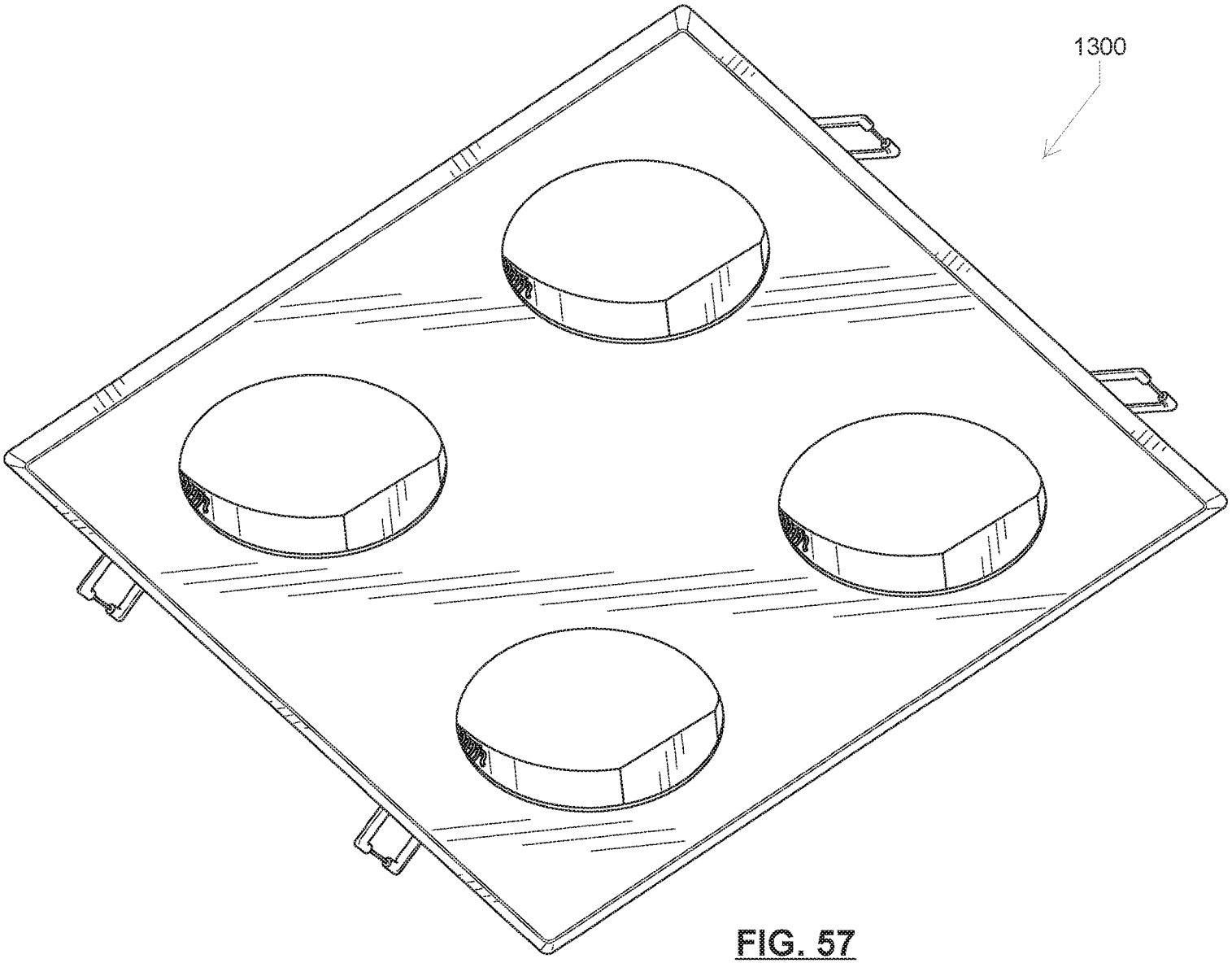
FIG. 57 shows another perspective view of the trim of FIG. 56.

FIG. 54 shows an example trim 1200, which is a double trim. Each of the two trims has a structure similar to trim 1000. FIG. 55 shows a bottom perspective view of trim 1200. FIG. 56 shows an example trim 1300, which is a quadruple trim arranged in a square. Each of the four trims has a structure similar to trim 1000. FIG. 57 shows a bottom perspective view of trim 1300. Multiple trims, in linear, square, or other arrangements are contemplated for trim 1000, and for the other trims disclosed herein.

The example light sources, adaptors, and trims described herein can be combined in many different combinations. Since light sources tend to be relatively expensive to produce, a few different types of light sources such as light sources 100 or 200 can be produced. These light sources can then reversibly connect to one of a large variety of trims or to adaptors which can in turn connect to trims. Adaptors and trims are relatively less expensive to produce, and may be subject to less or no testing or certification. As such, large varieties of adaptors and trims can be relatively quickly and inexpensively produced. Since light fixtures can be modularly assembled from the light sources, trims, and adaptors, the large variety of trims and adaptors can provide a large selection of light fixtures, which can be produced and stocked more quickly and less expensively than if an equal number and variety of light fixtures had to be produced in one piece and including a dedicated light fixture.

The spiral threading coupling between the light source, adaptor, and trim can provide for a quick, reversible, and yet mechanically strong coupling. Moreover, in cases where the connections between the light source, adaptor, and trim are to be tested and certified for being air-tight or moisture/vapor impermeable to predetermined thresholds, the spiral threading couplings can be designed to meet these thresholds.

In addition, the light fixtures described herein can be packaged as kits comprising a light source and one or more of: one or more trims and one or more adaptors. These light sources, adaptors, and trims can be similar to those described herein.

The light fixtures described herein can be installed by first obtaining a light source similar to a light source described herein, including but not limited to light sources 100 and 200. Next, the light source can be coupled to a trim to form the light fixture, and the coupling can be reversible. In some examples, coupling the light source to the trim can be indirect, comprising coupling the light source to an adaptor and coupling the adaptor to the trim. In other examples, the light source can be directly coupled to the trim.

Next, the light fixture can be inserted into an opening in the substrate in which the fixture is to be installed. After the inserting, the light fixture can be secured to the substrate, for example using resiliently- or spring-biased clips of the trim. In some examples, the light source need not be inserted into an opening in the substrate, and can be secured to a surface of the substrate.

The above-described are examples and alterations and modifications may be effected thereto, by those of skill in the art, without departing from the scope of the invention which is defined solely by the claims appended hereto.

The invention claimed is:

1. A light fixture configured for modular assembly, the light fixture comprising:

a light source, comprising a housing and a light emitter disposed inside of the housing, the housing having a housing connector;

an adaptor having a first connector and a second connector, the first connector being reversibly securable to the housing connector, wherein the adaptor has at least a portion having an inner frustoconical shape that is adapted to shape light emitted by the light emitter; and a trim being reversibly securable to the second connector of the adaptor, the trim comprising a trim base having a first face and an opposed second face and a trim opening extending through the first and second faces to allow passage of light emitted by the light emitter, and wherein the housing connector is directly reversibly securable to the first connector of the adaptor, and the second end of the adaptor is directly reversibly securable to the trim, and no other components are reversibly secured between the housing, the adaptor and the trim, and wherein the trim is also compatible to be alternately directly reversibly securable to the housing connector.

2. The light fixture of claim 1, wherein the housing connector comprises a housing spiral threading.

3. The light fixture of claim 1, wherein the trim comprises:

a trim connector coupled to the trim base, the trim connector configured to reversibly couple the trim to the adaptor; and the trim base is coupled to at least one connector element for securing the light fixture to a substrate.

4. The light fixture of claim 1, wherein the housing terminates in a first end, and the housing connector is proximate the first end, and the light source further comprises: a heat sink disposed inside of the housing and secured to the housing; and a connector in electrical communication with the light emitter, the connector configured to avow electrically connecting the light emitter to a power source external to the light source, and wherein the light emitter is in thermal communication with the heat sink, and the light emitter is positioned to allow a light emitted by the light emitter to exit the housing through the first end.

5. The light fixture of claim 2, wherein the housing spiral threading is disposed on an outer surface of the housing.

6. The light fixture of claim 2, wherein the adaptor is reversibly secured to the light source, and the adaptor comprises: the first connector reversibly securable to the housing spiral threading; and the second connector being coupled to the first connector.

7. The light fixture of claim 6, wherein the adaptor further comprises a light conduit extending from the first connector to the second connector.

8. The light fixture of claim 6, wherein the first connector is pivotably coupled to the second connector, the second connector being able to reversibly tilt along an axis relative to the first connector.

9. The light fixture of claim 6, wherein the first connector is moveably coupled to the second connector, the second connector being able to reversibly tilt along three different axes relative to the first connector.

10. The light fixture of claim 7, wherein the light conduit has a small open end and a large open end opposite the small open end;

the first connector comprises a first adaptor spiral threading proximate the small open end, the first adaptor spiral threading configured to be reversibly mateable with the housing spiral threading for reversibly securing the adaptor to the housing; and the second connector comprises a second adaptor spiral threading proximate the large open end, the second adaptor spiral threading configured for reversibly securing the adaptor to the trim.

11. The light fixture of claim 10, wherein one or more of:

the first connector comprises a spiral threading disposed on an inner surface of the light conduit proximate the small open end; and the second connector comprises a respective spiral threading disposed on an outer surface of the light conduit proximate the large open end.

12. The light fixture of claim 9, wherein the first connector comprises a hollow spherical segment having an outer equatorial diameter; and the second connector comprises a receiving component having an inner space receiving the hollow spherical segment, the inner space having a first open end having a first diameter and a second open end opposite the first open end, the second open end having a second diameter, the inner space having an inner diameter measured at a point between the first open end and the second open end, the first diameter and the second diameter being smaller than the outer equatorial diameter and the inner diameter being larger than the outer equatorial diameter, whereby the hollow spherical segment is captured in the inner space.

13. The light fixture of claim 3, wherein the trim connector comprises a trim spiral threading proximate the trim opening.

14. The light fixture of claim 3, wherein the trim connector comprises at least one clip coupled to the trim base proximate the trim opening, the clip configured to be resiliently deformed by a received component comprising one of the light source and the adaptor when the received component is coupled to the trim such that a resilient force of the clip pushes against the received component to secure the received component to the trim.

15. The light fixture of claim 3, wherein the trim connector is movably coupled to the trim base.

16. A method for assembling a modular light fixture, the method comprising: providing a light source, the light source comprising a housing and a light emitter disposed inside of the housing, the housing having a housing connector;

coupling the light source to an adaptor using the housing connector, to form the light fixture, the coupling being reversible, wherein the adaptor comprises: a first connector and a second connector, the first connector reversibly couplable with the housing connector, and at least a portion having an inner frustoconical shape that is adapted to shape light emitted by the light emitter; wherein the trim comprises: a trim base having a first face and an opposed second face and a trim opening extending through the first and second faces to allow passage of light emitted by the light emitter; and a trim connector coupled to the trim base, the trim connector reversibly coupleable to the second connector of the adaptor, and wherein the housing connector is directly reversibly couplable to the first connector of the adaptor, and the second end of the adaptor is directly reversibly couplable to the trim connector, and no other components are reversibly couplable between the housing, the adaptor and the trim, and wherein the housing connector and the trim connector are also compatible to be alternately directly reversibly couplable.

17. The method of claim 16, wherein: the first connector of the adaptor comprises a first connector spiral threading and the second connector is coupled to the first connector, the second connector of the adaptor comprises a second connector spiral threading; and wherein: the housing connector comprises a housing spiral threading proximate the first end; and the trim connector comprises a trim spiral threading proximate the trim opening and at least one connector element coupled to the trim base for securing the light fixture to a substrate.

18. The method of claim 16, further comprising inserting the light fixture into an opening in the substrate and securing the trim to the substrate.

19. The method of claim 16, wherein the housing terminates in a first end, and the housing connector is proximate the first end, and wherein the light source further comprises:

a heat sink disposed inside of the housing and secured to the housing, the light emitter being in thermal communication with the heat sink, the light emitter is positioned to allow a light emitted by the light emitter to exit the housing through the first end; and a connector in electrical communication with the light emitter, the connector configured to allow electrically connecting the light emitter to a power source external to the light source.

20. The light fixture of claim 4, wherein the housing comprises a cylindrical portion proximate the first end, the housing spiral threading being on the cylindrical portion.

21. The light fixture of claim 4, wherein the heat sink comprises:

a heat sink base having a substantially circular shape, the heat sink base receivable in the cylindrical portion;

an annular extension extending out of a plane defined by the heat sink base and from a first side of the heat sink base; and a plurality of blades extending radially from the annular extension, the blades configured to facilitate heat exchange between the heat sink and an environment surrounding the heat sink by increasing a surface area of the heat sink.

22. The light fixture of claim 4, wherein the light emitter comprises a light emitting diode (LED).

* * * * *